US007397457B2

(12) United States Patent
Sugino et al.

(10) Patent No.: US 7,397,457 B2
(45) Date of Patent: Jul. 8, 2008

(54) CRYSTAL DISPLAY DEVICE

(75) Inventors: Michiyuki Sugino, Chiba (JP); Yuji Kikuchi, Kuroiso (JP); Toshihiko Osada, Sakura (JP); Takashi Yoshii, Chiba (JP); Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 596 days.

(21) Appl. No.: 10/490,020

(22) PCT Filed: Nov. 11, 2002

(86) PCT No.: PCT/JP02/11746

§ 371 (c)(1),
(2), (4) Date: Mar. 19, 2004

(87) PCT Pub. No.: WO03/041044

PCT Pub. Date: May 15, 2003

(65) Prior Publication Data

US 2004/0263495 A1 Dec. 30, 2004

(30) Foreign Application Priority Data

| | | |
|---|---|---|
| Nov. 9, 2001 | (JP) | 2001-344078 |
| Aug. 20, 2002 | (JP) | 2002-238956 |
| Aug. 29, 2002 | (JP) | 2002-250201 |
| Sep. 4, 2002 | (JP) | 2002-258826 |
| Sep. 4, 2002 | (JP) | 2002-258827 |
| Sep. 24, 2002 | (JP) | 2002-277488 |
| Sep. 26, 2002 | (JP) | 2002-280964 |
| Oct. 28, 2002 | (JP) | 2002-312265 |

(51) Int. Cl.
*G09G 3/36* (2006.01)

(52) U.S. Cl. ..... 345/89; 345/92; 345/94; 345/100; 345/204

(58) Field of Classification Search ..... 345/87, 345/89, 92, 94, 100, 204
See application file for complete search history.

(56) References Cited

U.S. PATENT DOCUMENTS

| | | | | |
|---|---|---|---|---|
| 5,119,084 | A | 6/1992 | Kawamura et al. | |
| 5,347,294 | A | 9/1994 | Usui et al. | |
| 6,473,131 | B1 * | 10/2002 | Neugebauer et al. | 348/572 |
| 6,747,621 | B2 * | 6/2004 | Miyake | 345/87 |
| 2002/0047821 | A1 | 4/2002 | Miyake | |

FOREIGN PATENT DOCUMENTS

JP 03-096993 A 4/1991

(Continued)

*Primary Examiner*—Richard Hjerpe
*Assistant Examiner*—Leonid Shapiro
(74) *Attorney, Agent, or Firm*—Birch, Stewart, Kolasch & Birch, LLP

(57) ABSTRACT

An edge detecting circuit detects whether a particular pixel belongs to an edge by determining whether the differential value of the pixel from the neighboring pixel is equal to or greater than a threshold. Based on the detection result, an emphasis converter stops OS drive when the image of a pixel area is regarded as an edge image in accordance with the detected result of the edge detecting circuit and implements OS drive when the image of a pixel area is not regarded as an edge image. In this way, the edge detecting circuit detects edge portions of the input video, whereby OS drive in the emphasis converter can be controlled so as to be turned on and off.

12 Claims, 59 Drawing Sheets

FOREIGN PATENT DOCUMENTS

| | | | | |
|---|---|---|---|---|
| JP | 4-288589 | L | | 10/1992 |
| JP | 04-318516 | A | | 11/1992 |
| JP | 04-365094 | A | | 12/1992 |
| JP | 09-106262 | | * | 4/1997 |
| JP | 9-106262 | A | | 4/1997 |

* cited by examiner

| | | Address (current image data: 8 bit) | | | | | | | | | | | | | | |
|---|---|---|---|---|---|---|---|---|---|---|---|---|---|---|---|---|
| | | 0 | 1 | 2 | 3 | 4 | 5 | | | | 250 | 251 | 252 | 253 | 254 | 255 |
| Address (previous image data: 8 bit) | 0 | 0 | 2 | 4 | 6 | 8 | 9 | | | | 252 | 253 | 254 | 255 | 255 | 255 |
| | 1 | 0 | 1 | 2 | 5 | 7 | | | | | | 253 | 254 | 255 | 255 | 255 |
| | 2 | 0 | 0 | 2 | 4 | 6 | | | | | | 253 | 254 | 255 | 255 | 255 |
| | 3 | 0 | 1 | 1 | 3 | 4 | | | | | | 253 | 254 | 255 | 255 | 255 |
| | 4 | 0 | 2 | 3 | 3 | | | | | | | | 254 | 255 | 255 | 255 |
| | 5 | 0 | | | | | | | | | | | | | | 255 |
| | | | | | | | | | | | | | | | | |
| | | | | | | | | | | | | | | | | |
| | | | | | | | | | | | | | | | | |
| | 250 | 0 | | | | | | | | | | | | | | 255 |
| | 251 | 0 | 0 | 0 | 1 | | | | | | | 251 | 253 | 255 | 255 | 255 |
| | 252 | 0 | 0 | 0 | 1 | 2 | | | | | | 250 | 252 | 255 | 255 | 255 |
| | 253 | 0 | 0 | 0 | 1 | 2 | | | | | | 250 | 251 | 253 | 255 | 255 |
| | 254 | 0 | 0 | 0 | 1 | 2 | | | | | | 249 | 250 | 252 | 254 | 255 |
| | 255 | 0 | 0 | 0 | 1 | 2 | 3 | | | | 247 | 249 | 250 | 252 | 254 | 255 |

FIG. 15

Current frame data

Previous frame data

| | 0 | 32 | 64 | 96 | 128 | 160 | 192 | 224 | 255 |
|---|---|---|---|---|---|---|---|---|---|
| 0 | 0 | 32 | 64 | 96 | 128 | 160 | 192 | 224 | 255 |
| 32 | 0 | 32 | 64 | 96 | 128 | 160 | 192 | 224 | 255 |
| 64 | 0 | 32 | 64 | 96 | 128 | 160 | 192 | 224 | 255 |
| 96 | 0 | 32 | 64 | 96 | 128 | 160 | 192 | 224 | 255 |
| 128 | 0 | 32 | 64 | 96 | 128 | 160 | 192 | 224 | 255 |
| 160 | 0 | 32 | 64 | 96 | 128 | 160 | 192 | 224 | 255 |
| 192 | 0 | 32 | 64 | 96 | 128 | 160 | 192 | 224 | 255 |
| 224 | 0 | 32 | 64 | 96 | 128 | 160 | 192 | 224 | 255 |
| 255 | 0 | 32 | 64 | 96 | 128 | 160 | 192 | 224 | 255 |

FIG. 16

Current frame data

| Previous frame data | | 0 | 32 | 64 | 96 | 128 | 160 | 192 | 224 | 255 |
|---|---|---|---|---|---|---|---|---|---|---|
| Non-conversion parameter area | 0 | | | | | | | | | |
| | 32 | | | | | | | | | |
| | 64 | | | | | | | | | |
| | 96 | | | | | | | | | |
| | 128 | | | | | | | | | |
| | 160 | | | | | | | | | |
| | 192 | | | | | | | | | |
| | 224 | | | | | | | | | |
| | 255 | | | | | | | | | |
| Conversion parameter area | 0 | | | | | | | | | |
| | ⋮ | | | | | | | | | |
| | 255 | | | | | | | | | |

FIG. 18

Current frame data

Previous frame data

| | 0 | 32 | 64 | 96 | 128 | 160 | 192 | 224 | 255 |
|---|---|---|---|---|---|---|---|---|---|
| 0 | 0 | 51 | 118 | 165 | 194 | 214 | 230 | 242 | 255 |
| 32 | 0 | 32 | 120 | 159 | 183 | 206 | 226 | 240 | 255 |
| 64 | 0 | 12 | 64 | 110 | 150 | 182 | 209 | 234 | 255 |
| 96 | 0 | 0 | 48 | 96 | 140 | 175 | 204 | 232 | 255 |
| 128 | 0 | 0 | 43 | 81 | 128 | 167 | 201 | 232 | 255 |
| 160 | 0 | 0 | 35 | 66 | 117 | 160 | 196 | 229 | 255 |
| 192 | 0 | 0 | 2 | 56 | 105 | 152 | 192 | 227 | 255 |
| 224 | 0 | 0 | 0 | 50 | 85 | 139 | 186 | 224 | 255 |
| 255 | 0 | 0 | 0 | 44 | 75 | 136 | 181 | 215 | 255 |

Table content in ROM 3

FIG. 27

Current frame data

| Previous frame data | 0 | 32 | 64 | 96 | 128 | 160 | 192 | 224 | 255 |
|---|---|---|---|---|---|---|---|---|---|
| 0 | 0 | 51 | 118 | 165 | 194 | 214 | 230 | 242 | 255 |
| 32 | 0 | 32 | 120 | 159 | 183 | 206 | 226 | 240 | 255 |
| 64 | 0 | 12 | 64 | 110 | 150 | 182 | 209 | 234 | 255 |
| 96 | 0 | 0 | 48 | 96 | 140 | 175 | 204 | 232 | 255 |
| 128 | 0 | 0 | 43 | 81 | 128 | 167 | 201 | 232 | 255 |
| 160 | 0 | 0 | 35 | 66 | 117 | 160 | 196 | 229 | 255 |
| 192 | 0 | 0 | 2 | 56 | 105 | 152 | 192 | 227 | 255 |
| 224 | 0 | 0 | 0 | 50 | 85 | 139 | 186 | 224 | 255 |
| 255 | 0 | 0 | 0 | 44 | 75 | 136 | 181 | 215 | 255 |

FIG. 28

Current frame data

Previous frame data

| | 0 | 32 | 64 | 96 | 128 | 160 | 192 | 224 | 255 |
|---|---|---|---|---|---|---|---|---|---|
| 0 | 0 | 70 | 147 | 182 | 206 | 227 | 241 | 255 | 255 |
| 32 | 0 | 32 | 94 | 142 | 177 | 202 | 224 | 239 | 255 |
| 64 | 0 | 0 | 64 | 116 | 157 | 193 | 218 | 241 | 255 |
| 96 | 0 | 0 | 31 | 96 | 141 | 177 | 209 | 234 | 255 |
| 128 | 0 | 0 | 18 | 71 | 128 | 169 | 203 | 232 | 255 |
| 160 | 0 | 0 | 0 | 53 | 111 | 160 | 199 | 230 | 255 |
| 192 | 0 | 0 | 0 | 29 | 92 | 148 | 192 | 228 | 255 |
| 224 | 0 | 0 | 0 | 13 | 55 | 133 | 183 | 224 | 255 |
| 255 | 0 | 0 | 0 | 0 | 48 | 117 | 173 | 220 | 255 |

FIG. 29

Current frame data

Previous frame data

| | 0 | 32 | 64 | 96 | 128 | 160 | 192 | 224 | 255 |
|---|---|---|---|---|---|---|---|---|---|
| 0 | 0 | 32 | 64 | 96 | 128 | 160 | 192 | 224 | 255 |
| 32 | 0 | 32 | 64 | 96 | 128 | 160 | 192 | 224 | 255 |
| 64 | 0 | 32 | 64 | 96 | 128 | 160 | 192 | 224 | 255 |
| 96 | 0 | 32 | 64 | 96 | 128 | 160 | 192 | 224 | 255 |
| 128 | 0 | 32 | 64 | 96 | 128 | 160 | 192 | 224 | 255 |
| 160 | 0 | 32 | 64 | 96 | 128 | 160 | 192 | 224 | 255 |
| 192 | 0 | 32 | 64 | 96 | 128 | 160 | 192 | 224 | 255 |
| 224 | 0 | 32 | 64 | 96 | 128 | 160 | 192 | 224 | 255 |
| 255 | 0 | 32 | 64 | 96 | 128 | 160 | 192 | 224 | 255 |

FIG. 30

Current frame data

| Previous frame data | | 0 | 32 | 64 | 96 | 128 | 160 | 192 | 224 | 225 |
|---|---|---|---|---|---|---|---|---|---|---|
| LEVEL 0 | 0 | | | | | | | | | |
| | 32 | | | | | | | | | |
| | 64 | | | | | | | | | |
| | 96 | | | | | | | | | |
| | 128 | | | | | | | | | |
| | 160 | | | | | | | | | |
| | 192 | | | | | | | | | |
| | 224 | | | | | | | | | |
| | 255 | | | | | | | | | |
| LEVEL 1 | 0 | | | | | | | | | |
| | ⋮ | | | | | | | | | |
| | 255 | | | | | | | | | |
| LEVEL 2 | 0 | | | | | | | | | |
| | ⋮ | | | | | | | | | |
| | 255 | | | | | | | | | |

FIG. 35

Current frame data

| Previous frame data | 0 | 32 | 64 | 96 | 128 | 160 | 192 | 224 | 255 |
|---|---|---|---|---|---|---|---|---|---|
| 0 | 0 | 70 | 147 | 182 | 206 | 227 | 241 | 255 | 255 |
| 32 | 0 | 32 | 94 | 142 | 177 | 202 | 224 | 239 | 255 |
| 64 | 0 | 0 | 64 | 116 | 157 | 193 | 218 | 241 | 255 |
| 96 | 0 | 0 | 31 | 96 | 141 | 177 | 209 | 234 | 255 |
| 128 | 0 | 0 | 18 | 71 | 128 | 169 | 203 | 232 | 255 |
| 160 | 0 | 0 | 0 | 53 | 111 | 160 | 199 | 230 | 255 |
| 192 | 0 | 0 | 0 | 29 | 92 | 148 | 192 | 228 | 255 |
| 224 | 0 | 0 | 0 | 13 | 55 | 133 | 183 | 224 | 255 |
| 255 | 0 | 0 | 0 | 0 | 48 | 117 | 173 | 220 | 255 |

Table content in ROM 3a

FIG. 42

Current frame data

Previous frame data

| | 0 | 32 | 64 | 96 | 128 | 160 | 192 | 224 | 255 |
|---|---|---|---|---|---|---|---|---|---|
| 0 | 0 | 51 | 118 | 165 | 194 | 214 | 230 | 242 | 255 |
| 32 | 0 | 32 | 120 | 159 | 183 | 206 | 226 | 240 | 255 |
| 64 | 0 | 12 | 64 | 110 | 150 | 182 | 209 | 234 | 255 |
| 96 | 0 | 0 | 48 | 96 | 140 | 175 | 204 | 232 | 255 |
| 128 | 0 | 0 | 43 | 81 | 128 | 167 | 201 | 232 | 255 |
| 160 | 0 | 0 | 35 | 66 | 117 | 160 | 196 | 229 | 255 |
| 192 | 0 | 0 | 2 | 56 | 105 | 152 | 192 | 227 | 255 |
| 224 | 0 | 0 | 0 | 50 | 85 | 139 | 186 | 224 | 255 |
| 255 | 0 | 0 | 0 | 44 | 75 | 136 | 181 | 215 | 255 |

Table content in ROM 3b

FIG. 43

Current frame data

Previous frame data

| | 0 | 32 | 64 | 96 | 128 | 160 | 192 | 224 | 255 |
|---|---|---|---|---|---|---|---|---|---|
| 0 | 0 | 32 | 64 | 96 | 128 | 160 | 192 | 224 | 255 |
| 32 | 0 | 32 | 64 | 96 | 128 | 160 | 192 | 224 | 255 |
| 64 | 0 | 32 | 64 | 96 | 128 | 160 | 192 | 224 | 255 |
| 96 | 0 | 32 | 64 | 96 | 128 | 160 | 192 | 224 | 255 |
| 128 | 0 | 32 | 64 | 96 | 128 | 160 | 192 | 224 | 255 |
| 160 | 0 | 32 | 64 | 96 | 128 | 160 | 192 | 224 | 255 |
| 192 | 0 | 32 | 64 | 96 | 128 | 160 | 192 | 224 | 255 |
| 224 | 0 | 32 | 64 | 96 | 128 | 160 | 192 | 224 | 255 |
| 255 | 0 | 32 | 64 | 96 | 128 | 160 | 192 | 224 | 255 |

Table content in ROM 3c

FIG. 45

Current frame data

| Previous frame data | | 0 | 32 | 64 | 96 | 128 | 160 | 192 | 224 | 225 |
|---|---|---|---|---|---|---|---|---|---|---|
| Non-conversion table area | 0 | | | | | | | | | |
| | 32 | | | | | | | | | |
| | 64 | | | | | | | | | |
| | 96 | | | | | | | | | |
| | 128 | | | | | | | | | |
| | 160 | | | | | | | | | |
| | 192 | | | | | | | | | |
| | 224 | | | | | | | | | |
| | 255 | | | | | | | | | |
| Weak-conversion table area | 0 | | | | | | | | | |
| | ・・・ | | | | | | | | | |
| | 255 | | | | | | | | | |
| Strong-conversion table area | 0 | | | | | | | | | |
| | ・・・ | | | | | | | | | |
| | 255 | | | | | | | | | |

Table content in ROM 3d

FIG. 47

Current frame data

Previous frame data

| | 0 | 32 | 64 | 96 | 128 | 160 | 192 | 224 | 255 |
|---|---|---|---|---|---|---|---|---|---|
| 0 | 0 | 51 | 118 | 165 | 194 | 214 | 230 | 242 | 255 |
| 32 | 0 | 32 | 120 | 159 | 183 | 206 | 226 | 240 | 255 |
| 64 | 0 | 12 | 64 | 110 | 150 | 182 | 209 | 234 | 255 |
| 96 | 0 | 0 | 48 | 96 | 140 | 175 | 204 | 232 | 255 |
| 128 | 0 | 0 | 43 | 81 | 128 | 167 | 201 | 232 | 255 |
| 160 | 0 | 0 | 35 | 66 | 117 | 160 | 196 | 229 | 255 |
| 192 | 0 | 0 | 2 | 56 | 105 | 152 | 192 | 227 | 255 |
| 224 | 0 | 0 | 0 | 50 | 85 | 139 | 186 | 224 | 255 |
| 255 | 0 | 0 | 0 | 44 | 75 | 136 | 181 | 215 | 255 |

(a) Table content in ROM 300b

Current frame data

Previous frame data

| | 0 | 32 | 64 | 96 | 128 | 160 | 192 | 224 | 255 |
|---|---|---|---|---|---|---|---|---|---|
| 0 | 0 | 70 | 147 | 182 | 206 | 227 | 241 | 255 | 255 |
| 32 | 0 | 32 | 94 | 142 | 177 | 202 | 224 | 239 | 255 |
| 64 | 0 | 0 | 64 | 116 | 157 | 193 | 218 | 241 | 255 |
| 96 | 0 | 0 | 31 | 96 | 141 | 177 | 209 | 234 | 255 |
| 128 | 0 | 0 | 18 | 71 | 128 | 169 | 203 | 232 | 255 |
| 160 | 0 | 0 | 0 | 53 | 111 | 160 | 199 | 230 | 255 |
| 192 | 0 | 0 | 0 | 29 | 92 | 148 | 192 | 228 | 255 |
| 224 | 0 | 0 | 0 | 13 | 55 | 133 | 183 | 224 | 255 |
| 255 | 0 | 0 | 0 | 0 | 48 | 117 | 173 | 220 | 255 |

(b) Table content in ROM 300a

FIG. 50

Current frame data

| Previous frame data | 0 | 32 | 64 | 96 | 128 | 160 | 192 | 224 | 255 |
|---|---|---|---|---|---|---|---|---|---|
| 0 | 0 | 32 | 64 | 96 | 128 | 160 | 192 | 224 | 255 |
| 32 | 0 | 32 | 64 | 96 | 128 | 160 | 192 | 224 | 255 |
| 64 | 0 | 32 | 64 | 96 | 128 | 160 | 192 | 224 | 255 |
| 96 | 0 | 32 | 64 | 96 | 128 | 160 | 192 | 224 | 255 |
| 128 | 0 | 32 | 64 | 96 | 128 | 160 | 192 | 224 | 255 |
| 160 | 0 | 32 | 64 | 96 | 128 | 160 | 192 | 224 | 255 |
| 192 | 0 | 32 | 64 | 96 | 128 | 160 | 192 | 224 | 255 |
| 224 | 0 | 32 | 64 | 96 | 128 | 160 | 192 | 224 | 255 |
| 255 | 0 | 32 | 64 | 96 | 128 | 160 | 192 | 224 | 255 |

Table content in ROM 300c

FIG. 52

Current frame data

| Previous frame data | | 0 | 32 | 64 | 96 | 128 | 160 | 192 | 224 | 225 |
|---|---|---|---|---|---|---|---|---|---|---|
| LEVEL 0 | 0 | | | | | | | | | |
| | 32 | | | | | | | | | |
| | 64 | | | | | | | | | |
| | 96 | | | | | | | | | |
| | 128 | | | | | | | | | |
| | 160 | | | | | | | | | |
| | 192 | | | | | | | | | |
| | 224 | | | | | | | | | |
| | 255 | | | | | | | | | |
| LEVEL 1 | 0 | | | | | | | | | |
| | ⋮ | | | | | | | | | |
| | 255 | | | | | | | | | |
| LEVEL 2 | 0 | | | | | | | | | |
| | ⋮ | | | | | | | | | |
| | 255 | | | | | | | | | |

Table content in ROM 300d

FIG. 54

Current frame data

| Previous frame data | 0 | 32 | 64 | 96 | 128 | 160 | 192 | 224 | 255 |
|---|---|---|---|---|---|---|---|---|---|
| 0 | 0 | 51 | 118 | 165 | 194 | 214 | 230 | 242 | 255 |
| 32 | 0 | 32 | 120 | 159 | 183 | 206 | 226 | 240 | 255 |
| 64 | 0 | 12 | 64 | 110 | 150 | 182 | 209 | 234 | 255 |
| 96 | 0 | 0 | 48 | 96 | 140 | 175 | 204 | 232 | 255 |
| 128 | 0 | 0 | 43 | 81 | 128 | 167 | 201 | 232 | 255 |
| 160 | 0 | 0 | 35 | 66 | 117 | 160 | 196 | 229 | 255 |
| 192 | 0 | 0 | 2 | 56 | 105 | 152 | 192 | 227 | 255 |
| 224 | 0 | 0 | 0 | 50 | 85 | 139 | 186 | 224 | 255 |
| 255 | 0 | 0 | 0 | 44 | 75 | 136 | 181 | 215 | 255 |

(a) Table content in ROM 430b

Current frame data

| Previous frame data | 0 | 32 | 64 | 96 | 128 | 160 | 192 | 224 | 255 |
|---|---|---|---|---|---|---|---|---|---|
| 0 | 0 | 70 | 147 | 182 | 206 | 227 | 241 | 255 | 255 |
| 32 | 0 | 32 | 94 | 142 | 177 | 202 | 224 | 239 | 255 |
| 64 | 0 | 0 | 64 | 116 | 157 | 193 | 218 | 241 | 255 |
| 96 | 0 | 0 | 31 | 96 | 141 | 177 | 209 | 234 | 255 |
| 128 | 0 | 0 | 18 | 71 | 128 | 169 | 203 | 232 | 255 |
| 160 | 0 | 0 | 0 | 53 | 111 | 160 | 199 | 230 | 255 |
| 192 | 0 | 0 | 0 | 29 | 92 | 148 | 192 | 228 | 255 |
| 224 | 0 | 0 | 0 | 13 | 55 | 133 | 183 | 224 | 255 |
| 255 | 0 | 0 | 0 | 0 | 48 | 117 | 173 | 220 | 255 |

(b) Table content in ROM 430a

FIG. 57

Current frame data

Previous frame data

| | 0 | 32 | 64 | 96 | 128 | 160 | 192 | 224 | 255 |
|---|---|---|---|---|---|---|---|---|---|
| 0 | 0 | 32 | 64 | 96 | 128 | 160 | 192 | 224 | 255 |
| 32 | 0 | 32 | 64 | 96 | 128 | 160 | 192 | 224 | 255 |
| 64 | 0 | 32 | 64 | 96 | 128 | 160 | 192 | 224 | 255 |
| 96 | 0 | 32 | 64 | 96 | 128 | 160 | 192 | 224 | 255 |
| 128 | 0 | 32 | 64 | 96 | 128 | 160 | 192 | 224 | 255 |
| 160 | 0 | 32 | 64 | 96 | 128 | 160 | 192 | 224 | 255 |
| 192 | 0 | 32 | 64 | 96 | 128 | 160 | 192 | 224 | 255 |
| 224 | 0 | 32 | 64 | 96 | 128 | 160 | 192 | 224 | 255 |
| 255 | 0 | 32 | 64 | 96 | 128 | 160 | 192 | 224 | 255 |

Table content in ROM 430c

FIG. 60

Current frame data

| Previous frame data | | 0 | 32 | 64 | 96 | 128 | 160 | 192 | 224 | 225 |
|---|---|---|---|---|---|---|---|---|---|---|
| LEVEL 0 | 0 | | | | | | | | | |
| | 32 | | | | | | | | | |
| | 64 | | | | | | | | | |
| | 96 | | | | | | | | | |
| | 128 | | | | | | | | | |
| | 160 | | | | | | | | | |
| | 192 | | | | | | | | | |
| | 224 | | | | | | | | | |
| | 255 | | | | | | | | | |
| LEVEL 1 | 0 | | | | | | | | | |
| | ⋮ | | | | | | | | | |
| | 255 | | | | | | | | | |
| LEVEL 2 | 0 | | | | | | | | | |
| | ⋮ | | | | | | | | | |
| | 255 | | | | | | | | | |

Table content in ROM 430h

FIG. 61

Current frame data

| Previous frame data | | 0 | 32 | 64 | 96 | 128 | 160 | 192 | 224 | 225 |
|---|---|---|---|---|---|---|---|---|---|---|
| LEVEL 0 | 0 | | | | | | | | | |
| | 32 | | | | | | | | | |
| | 64 | | | | | | | | | |
| | 96 | | | | | | | | | |
| | 128 | | | | | | | | | |
| | 160 | | | | | | | | | |
| | 192 | | | | | | | | | |
| | 224 | | | | | | | | | |
| | 255 | | | | | | | | | |
| LEVEL 0-1 | 0 | | | | | | | | | |
| | • • • | | | | | | | | | |
| | 255 | | | | | | | | | |
| LEVEL 0-2 | 0 | | | | | | | | | |
| | • • • | | | | | | | | | |
| | 255 | | | | | | | | | |
| LEVEL 1 | 0 | | | | | | | | | |
| | • • • | | | | | | | | | |
| | 255 | | | | | | | | | |
| LEVEL 1-1 | 0 | | | | | | | | | |
| | • • • | | | | | | | | | |
| | 255 | | | | | | | | | |
| LEVEL 1-2 | 0 | | | | | | | | | |
| | • • • | | | | | | | | | |
| | 255 | | | | | | | | | |

Table content in ROM 430i

CRYSTAL DISPLAY DEVICE

TECHNICAL FIELD

The present invention relates to a liquid crystal display for image display using a liquid crystal display panel, and in particular relates to a liquid crystal display wherein the optical response characteristic of the liquid crystal display panel can be improved.

BACKGROUND ART

Recently, as personal computers and television receivers have become lighter and thinner, reduction in thickness and weight of display devices has also been wanted. In answer to such demands, flat panel type displays such as liquid crystal displays (LCDs) have been developed in place of cathode ray tubes (CRTs).

An LCD is a display device which produces desired image signals by applying electric fields across a liquid crystal layer having anisotropic dielectric constants, injected between a pair of substrates so that the strength of the electric fields is controlled to thereby control the amount of light passing through the substrates. Such LCDs are typical examples of handy flat panel type displays. Of these, TFT LCDs that employ thin-film transistors (TFT) as switching elements are mainly in use.

Lately, since LCDs have been not only used as the display devices of computers but also used widely as the display devices of television receivers, the need for rendering motion pictures has been increased. However, since the conventional LCDs are low in response speed, they have a drawback that it is difficult to reproduce motion pictures.

In order to make the LCD's response speed problem better, there is a known liquid crystal driving method wherein in accordance with the combination of the input image data of the previous frame and the input image data of the current frame, either a higher (overshot) drive voltage than the predetermined gray scale level voltage that corresponds to the input image data of the current frame or a lower (undershot) drive voltage is supplied to the liquid crystal display panel. In this specification of the present application, this driving scheme should be defined as overshoot (OS) drive.

FIG. 1 shows a schematic configuration of a conventional overshoot drive circuit. Specifically, the input image data (current data) of the N-th frame being about to be displayed and the input image data (previous data) of the (N−1)-th frame being stored in a frame memory 1 are loaded into an emphasis converter 2, wherein the patterns of the gray scale level transitions between both the data and the input image data of the N-th frame are looked up with the applied voltage data table stored in a table memory (ROM) 3 so as to identify applied voltage data, and write-gray scale level data (emphasis-converted data) needed for image display of the N-th frame is determined based on the thus obtained applied voltage data (emphasis conversion parameters) so as to be supplied to a liquid crystal display panel 4. Here, emphasis converter 2 and table memory 3 constitute a write-gray scale level determining means.

The applied voltage data (emphasis conversion parameters) stored in the above table memory 3 is obtained beforehand from the actual measurement of the optical response characteristics of liquid crystal display panel 4. When, for example, the number of display signal levels, i.e., the amount of display data, is 256 gray scales represented by 8 bits, every level of 256 gray scales may have a piece of applied voltage data, as shown in FIG. 2. Alternatively, it is also possible that only the measurements for nine representative gray scale levels, one for every 32 gray scale levels, have been stored and the applied voltage data for other gray scale levels is determined by linear interpolation of the above measurements or other operations.

There has been a problem in that it takes long time to make a transition from a certain half gray scale level to another half gray scale level, so that it is impossible for a general liquid crystal display panel to display the half gray scales within the period of one frame (e.g., 16.7 msec. for a case of progressive scan of 60 Hz). This not only produces afterglow but also hinders correct half gray scale display. Use of the above-described overshoot drive circuit, however, enables display of the aimed half gray scale level within a short time as shown in FIG. 3.

In the case where the liquid crystal response speed is improved by way of the signal processing as above, OS drive is performed by making a comparative operation between the input image data of the previous frame and the current frame data and outputting the emphasis-converted data.

However, if the emphasis-converted data is mis-optimized, errors in data between frames are enhanced, so that video noise which does not originate from due input data will be generated. FIGS. 4 and 5 show the relationships between the applied voltage to the liquid crystal display panel and the transmittance when the input video data changes from black to a certain half gray scale value.

Since in FIG. 4 the emphasis-converted data is optimized in conformity with the liquid crystal display panel characteristic, the target brightness can be realized within one frame, while three frames are needed for the normal drive to reach the target brightness. On the other hand, shown in FIG. 5 is a case where the brightness reaches a level higher than the target because excessive emphasis-converted data is used.

Since the cases explained with reference to FIGS. 4 and 5 are assumed that the input image data changes from black to a certain half gray scale level and continues to be set at that half gray scale level, the output data reaches the target brightness level while the error of the output data is absorbed within one frame. However, if the input data changes repeatedly, e.g., black→half gray scale→black→half gray scale, the error will rapidly increase.

In terms of normally received television signals this problem causes undue images (so-called noise) that are laid over edges such as face contours, character contours, etc., resulting in image degradation such as unnatural hue, white spots, flickering, etc.

Further, when the response speed of the liquid crystal display panel is taken into consideration, it is difficult to output the optimal emphasis-converted data at any time because of variations in cell gap, change in the viscosity of the liquid crystal material due to ambient temperature and other factors.

The present invention has been devised in view of the above problems, and is to provide a liquid crystal display which is capable of eliminating the adverse effects from accelerative drive by detecting edges of the input image and turning on and off the accelerative drive for every pixel.

Further, since in the conventional liquid crystal display shown in FIG. 1, the input image data for the current frame is emphasis-converted and supplied to the liquid crystal display panel, based on the gray scale level transitions of the input image data from one frame to the next, if some noise is laid over the input image data, the noise also is emphasis-converted and supplied to the liquid crystal display panel, causing image degradation such as white spots, flickering etc., resulting from the emphasized noise.

FIG. 6 is an illustrative view showing a case where noise is laid over 3×3 pixels of data. For instance, suppose that noise shown in FIG. 6(*b*) is added (the pixels of the 135th and 130th gray scale levels are the noise added portions) when data of the 128th gray scale level is supplied to all the pixels as shown in FIG. 6(*a*). In the normal drive mode, the input gray scale levels are output straight through, so that the display data (write-gray scale levels) shown in FIG. 6(*b*) is displayed on the liquid crystal display panel.

On the other hand, when OS drive for data emphasis conversion is implemented, this affects the data to enlarge the transition width. So the noise added portions are emphasized to reach the 140th and 135th gray scale levels as shown in FIG. 6(*c*), hence the noise is displayed prominently. In this way, if a signal source of a poor S/N ratio is supplied to an OS drive configuration, the noise is also emphasized more than that in the normal drive mode, this gives a problem in that the image quality of the displayed image is degraded.

To deal with this, Japanese Patent Application Laid-open No. Hei 3-96993, for example, proposes a configuration, wherein the differential signal as to the video data to be displayed on the liquid crystal display between the current data and the data one frame period or one field period before is detected, and when the magnitude of the differential signal is smaller than the predetermined level, the difference is determined to be noise and the input video data is output straight through, while, when the magnitude of the differential signal is greater than the predetermined level, the input video data is added with the above differential signal so as to output the video data with its afterimage removed.

This scheme is realized by provision of a coefficient circuit composed of a multiplier for multiplying the input signal by a predetermined coefficient or using a ROM table, having an input/output characteristic shown in FIG. 7. More specifically, when the value of the differential signal (motion detection signal) between the pieces of data one frame period or one field period apart, to be supplied to the coefficient circuit, falls within the ranges from 0 to +a and from 0 to −a, or when the magnitude is smaller than the predetermined value |a|, the input video data is output straight through.

On the other hand, when the value of the differential signal (motion detection signal) supplied to the coefficient circuit falls outside of the ranges 0 to +a and 0 to −a, or when the magnitude is greater than the predetermined value |a|, the input signal multiplied by a coefficient having the same polarity as that of the input signal is output and added to the input video data, so that the input video data is emphasis-converted to cancel the afterimage from the image displayed on the LCD device.

However, in the above disclosure of Japanese Patent Application Laid-open No. Hei 3-96993, a coefficient circuit composed of the multiplier or the ROM table is used to obtain output video data in conformity with the magnitude of the differential signal of the video data between the current data and the data one frame period or one field period before, so it is only possible to deal with one-dimensional noise depending on temporal variations. Therefore it has been impossible to prevent image degradation of the displayed image, in a perfect manner.

The present invention has been devised in view of the above problem, and is to provide a liquid crystal display which is capable of positively eliminating the adverse effects from OS drive by enabling switching between the OS drive and normal drive based on multidimensional noise detection result.

In the conventional liquid crystal display shown in FIG. 1, when the emphasizing process (OS drive) by write-gray scale level determining portion 2 is implemented, noise and the like, which are high frequency components, superimposed on the input image data, are further emphasized by the OS drive, posing the image degradation problem in that noise stands out as white spots (in the case of the liquid crystal display panel operated in the normally black mode).

For example, playback of an analog VTR entails noise that is attributed to the tape and head system during signal reproduction, or playback of a tape that is obtained after repeated duplication results in a poor signal to noise ratio producing much noise. If the above-described OS drive is implemented for the input image data superimposed with such noise, even the noise is emphasized and results in image degradation of the displayed image.

Further, when a user who prefers a clear and vivid image adjusts the contour enhancement correcting function of a television system etc., to a severe level, the contour enhanced portions are further emphasized by OS drive to a too strong level and unnatural hues, flickering, etc., arise, degrading the image quality of the displayed image.

Moreover, the video signals for DVD and digital broadcasting are compressed by MPEG-2. In MPEG, it is usually known that the lower the transfer bit rate of codes (the higher the compression rate), the more the coding noise stands out and the more the image quality degrades. As typical coding noise in MPEG, block noise and mosquito noise are well known.

Block noise is a phenomenon whereby boundaries of blocks appear clearly and are seen like tiles. This takes place when the image signal within each block has only low frequency components and the neighboring blocks have different frequency component values. Mosquito noise is flickering noise appearing around edges as if mosquitoes were flying. This noise is generated due to loss of high frequency components that are included in the original image signal, through quantization.

In this way, when coded image data that is encoded based on a coding scheme that implements blockwise orthogonal transformation is input/decoded to perform image display, block distortion whereby boundaries of process blocks appear in the flat portion of the decoded image, and mosquito noise that causes haze around edge portions of characters and contours occur. These noises are emphasized by OS drive, degrading the image quality of the displayed image.

The present invention has been devised in view of the above problem, and is to provide a liquid crystal display which improves the liquid crystal response speed for half gray scale images by implementing overshoot drive while preventing noise etc. from being excessively emphasized, to thereby improve the image quality of the displayed image.

Usually, at the previous stage of the aforementioned overshoot drive circuit, various video adjustments are implemented according to user's preference, hence OS drive (emphasis conversion process) is executed for the input image data which has undergone the video adjustments. Accordingly, depending on the video adjustment result, OS drive may pose a problem in that the image quality of the displayed image is degraded by the occurrence of the adverse effects (unnatural hues, flickering, etc.) therefrom.

For example, when a user who prefers a clear and vivid picture applies rather intensive contour enhancement correction by video adjustment, the contour enhanced portions are further emphasized by OS drive to a too strong level and produce white spots (in the case of a liquid crystal display panel operated in the normally black mode), unnatural hues, flickering and others, resulting in degradation of the image quality of the displayed image.

Since the optical response characteristics of liquid crystal display panels are different depending on the alignment mode of liquid crystal, the electrode structure for applying electric fields across the liquid crystal material and other factors, there exist some gray scale level transition patterns of which the liquid crystal response speed can be well improved by OS drive (emphasis conversion process) and others of which the liquid crystal response speed can not be improved very much by OS drive (emphasis conversion process).

When a picture obtained as a result of the user's video adjustments for input image data as to gray scale level characteristics such as black (white) extension, black (white) level adjustment, brightness adjustment and the like, includes many gray scale level transition patterns of which the liquid crystal response speed cannot be improved very much by OS drive (emphasis conversion process), implementation of OS drive only enlarges data errors between frames, resulting in generation of video noise which does not exist in the original input image data.

Illustratively, there are gray scale level transitions in which the target gray scale level cannot be achieved within one frame even if OS drive is effected. For such transitions, if OS drive is effected for the next frame, the applied voltage of data is determined on the basis that the previous gray scale level has reached the target gray scale level despite the fact the gray scale level has not yet been reached. As a result, gray scale levels which are deviated from due gray scale levels to be displayed are displayed, so that the desired image cannot be displayed. If this is repeated, the error of the output data increase rapidly, posing the problem in that whitened or blackened pixels are reproduced.

The present invention has been devised in view of the above problem, and is to provide a liquid crystal display which can inhibit image degradation due to adverse effects from overshoot drive, by controlling overshoot drive in response to the user's video adjustment for the input image data.

As it has been known that the response speed of liquid crystal greatly depends on the temperature, Japanese Patent Application Laid-open No. Hei 4-318516, for example, discloses a liquid crystal display panel driver that continuously controls and keeps the response speed of gray scale change in an optimal condition without loss of display quality in order to deal with any change of the temperature of liquid crystal display panel.

This configuration includes: RAM for storing one frame of digital image data for display; a temperature sensor for detecting the temperature of the liquid crystal display panel; and a data converting circuit which compares the aforementioned digital image data with the image data that is read out, by a one-frame delay, from the RAM and, if the current image data has changed from the image data one frame before, implements emphasis conversion of the current image data in the direction of the change, in accordance with the detected temperature of the above temperature sensor, whereby display of the liquid crystal display panel is driven based on the image data output from this data converting circuit.

Specifically, suppose that the temperature of the liquid crystal display panel to be detected by the temperature sensor is classified into, for example, three ranges Th, Tm and Tl (Th>Tm>Tl) and three mode signals, corresponding to these ranges, to be output from the A/D converter to the data converting circuit are defined as Mh, Mm and Ml, while in the ROM of the data converting circuit, "3", the number equal to that of the mode signals, tables of image data, which can be accessed by designating the addresses or the value of the current image data and that of the image data delayed by one frame, are stored beforehand. One table which corresponds to the input mode signal is selected, and the image data stored in the table at the memory location designated by the addresses, i.e., the value of the current image data and that of the image data delayed by one frame is read out to be output to the drive circuit of the liquid crystal display panel.

Next, FIG. 8 is a rear view showing a schematic configurational example of a direct backlight type liquid crystal display. In FIG. 8, 4 designates a liquid crystal display panel, 11 fluorescent lamps for illuminating the liquid crystal display panel 4 from the rear, 12 an inverter transformer for energizing fluorescent lamps 11, 13 a power supply unit, 14 a video processing circuit board, 15 a sound processing circuit board and 16 a temperature sensor.

Of these, items releasing heat that greatly affects the response speed characteristic of liquid crystal display panel 4 are inverter transformer 12 and power supply unit 13. It is preferred that temperature sensor 16 is arranged inside liquid crystal display panel 4, from its due objective, but this is difficult, so the sensor should be attached to another member such as a circuit board.

Therefore, when, for example, the constituents 11 to 15 are arranged as shown in FIG. 8, temperature sensor 16 is attached to sound processing circuit board 15, which is least affected by generation of heat from inverter transformer 12 and power supply unit 13, and the detected output from this temperature sensor 16 is made use of by an overshoot drive circuit provided in video processing circuit board 14.

The above-described conventional liquid crystal display, however, has the following problems.

(1) If, for example, the applied voltage data (emphasis conversion parameters) stored in OS table memory 3 is broken, or the calculation algorithm for linear interpolation or the like in emphasis converter 2 is broken, due to some device trouble, it becomes impossible to supply the liquid crystal display panel 4 with correct applied voltages of data (emphasis-converted data) corresponding to the input image data, whereby the image quality of the displayed image is markedly degraded, thus hindering the attention to the picture.

(2) Further, in the case of the above-described conventional liquid crystal display, in the normal installed state (stand-mounted state) shown in FIG. 9(*a*) temperature sensor 16 is arranged at the place where it has least influence of heat from inverter transformer 12, power supply unit 13 and other components. However, when the screen is set at the vertically inverted state (in the suspended state from ceiling) as shown in FIG. 9(*b*) or when rotated by 90 degrees (in the portrait orientation state) as shown in FIG. 9(*c*), the heat flow path changes hence temperature sensor 16 is significantly affected by generation of heat from the other members, so it is no longer possible to detect the exact temperature of liquid crystal display panel 4.

As a result, correct applied voltages of data (emphasis-converted data) corresponding to the temperature of liquid crystal display panel 4 cannot be supplied to liquid crystal display panel 4, causing the problem of image quality of the displayed image being significantly degraded by generation of shadow tailing due to application of insufficient applied voltages of data (emphasis-converted data) to liquid crystal display panel 4 or by generation of white spots due to application of excessive applied voltages of data (emphasis-converted data) to liquid crystal display panel 4 (in the case of the normally black mode).

Further, if this liquid crystal display is put in a place where air is blown onto it from a room air-conditioner or in a sunny place or direct sunshine, part of liquid crystal display panel 4 may decrease or increase in temperature, producing varying temperature distribution across the surface of liquid crystal display panel 4. Resultantly, excessive applied voltages of data (emphasis-converted data) may be supplied to liquid crystal display panel 4 in partial areas, producing white spots, or insufficient applied voltages of data (emphasis-converted data) may be supplied to liquid crystal display panel 4 causing shadow tailing (when in the normally black mode), hence image quality of the displayed image is significantly degraded. This problem of varying temperature distribution across the surface of liquid crystal display panel 4 depending on the place of installation becomes more noticeable when the display screen size becomes greater.

(3) Moreover, when coded image data that is encoded based on a coding scheme that implements orthogonal transformation for every block consisting of, for example, M×N pixels, is input/decoded to perform image display, block distortion whereby boundaries of processed blocks appear in the flat portion of the decoded image, and mosquito noise that causes haze around edge portions of characters and contours occur, depending on the compression ratio of the image coded data. When overshoot drive is applied to these noises, the noises are emphasized, resulting in degradation of the image quality of the displayed image.

Similarly and also, in the case where a picture signal having a poor S/N ratio is input, the noise is emphasized when overshoot drive is effected, causing degradation of the image quality of the displayed image. In this way, depending on the property of the input image, overshoot drive causes adverse effect, thus degrading the image quality of the displayed image.

The present invention has been devised in view of the above problem, and is to provide a liquid crystal display which prevents degradation of the image quality of the displayed image by stopping overshoot drive when an awkward picture is displayed by execution of overshoot drive, due to device trouble, due to the installed state of the device and due to the property of the input image.

DISCLOSURE OF INVENTION

In order to achieve the above objects, the present invention is configured as follows.

The present invention is a liquid crystal display for image display using a liquid crystal display panel, comprising: a means of determining emphasis-converted data for compensating an optical response characteristic of the liquid crystal display panel in accordance with, at least, a gray scale level transition of input image data from a previous vertical period to a current vertical period; an edge detecting means for detecting an edge portion contained in the input image data; and a selecting means for selecting either the emphasis-converted data or the input image data, based on a detection result of the edge portion and supplying the selected one as display image data to the liquid crystal display panel.

The present invention includes: a subtracter for subtracting the input image data from the emphasis-converted data; a multiplier for multiplying an output signal from the subtracter by a weight coefficient which is variably controlled based on a detection result of the edge portion; and, an adder for adding an output signal from the multiplier to the input image data so as to determine the display image data.

The present invention includes: a conversion table memory storing an emphasis conversion parameter for converting the input image data into the emphasis-converted data; and a non-conversion table memory storing a non-conversion parameter for outputting the input image data as it is, wherein the display image data is determined by reference to either the conversion table memory or the non-conversion table memory, by performing selective switching therebetween based on a detection result of the edge portion.

The present invention includes a table memory that stores an emphasis conversion parameter for converting the input image data into the emphasis-converted data and a non-conversion parameter for outputting the input image data as it is, wherein the display image data is determined by reference to either a reference table area holding the emphasis conversion parameter and a reference table area holding the non-conversion parameter, by performing selective switching therebetween based on the detection result of the edge portion.

The present invention includes: an emphasis converter means for determining emphasis-converted data for input image data for compensating an optical characteristic of the liquid crystal display panel, in accordance with a gray scale level transition from a previous vertical period to a current vertical period; a noise detecting means for detecting noise contained in the input image data; and a selector for selecting either the input image data and the emphasis-converted data, based on a detection result from the noise detecting means and supplying the selected one to the liquid crystal display panel.

The present invention is characterized in that the noise detecting means detects two-dimensional noise based on a correlation between pixels of the input image data with respect to a horizontal direction and a vertical direction.

The present invention is characterized in that the noise detecting means detects three-dimensional noise based on a correlation between pixels of the input image data with respect to a horizontal direction and a vertical direction and based on a correlation between pixels of the input image data with respect to a temporal direction.

The present invention is characterized in that the emphasis converter means includes a table memory storing emphasis conversion parameters for representative gray scale level transition patterns of display data gray scale levels.

The present invention is a liquid crystal display for image display using a liquid crystal display panel, comprising: an emphasis converter means for determining emphasis-converted data for input image data for compensating an optical characteristic of the liquid crystal display panel, in accordance with a gray scale level transition from a previous vertical period to a current vertical period; a characteristic quantity detecting means for detecting a characteristic quantity of the input image data; and a selecting means for selecting either the emphasis-converted data or the input image data, based on the detected characteristic quantity and supplying the selected one as display image data to the liquid crystal display panel.

The present invention is a liquid crystal display for image display using a liquid crystal display panel, comprising: a video processor means for implementing a predetermined video adjustment process for input image data, in accordance with a user's video adjustment command; and a write-gray scale level determining means for determining emphasis-converted data for compensating an optical response characteristic of the liquid crystal display panel in accordance with, at least, a gray scale level transition of the input image data from a previous vertical period to a current vertical period, wherein the write-gray scale level determining means selects either the emphasis-converted data or the input image data, based on the user's video adjustment command content and outputs the selected one as display image data to the liquid crystal display panel.

The present invention is characterized in that the write-gray scale level determining means comprises: a subtracter for subtracting the input image data from the emphasis-converted data; a multiplier for multiplying an output signal from the subtracter by a weight coefficient which is selected in accordance with the user's video adjustment command content; and, an adder for adding an output signal from the multiplier to the input image signal so as to determine the display image data.

The present invention is characterized in that the write-gray scale level determining means comprises: a conversion table memory storing an emphasis conversion parameter for converting the input image data into the emphasis-converted data; and a non-conversion table memory storing a non-conversion parameter for outputting the input image data as it is, and determines the display image data by reference to either the conversion table memory or the non-conversion table memory, by performing selective switching therebetween based on the user's video adjustment command content.

The present invention is characterized in that the write-gray scale level determining means comprises: a table memory that stores an emphasis conversion parameter for converting the input image data into the emphasis-converted data and a non-conversion parameter for outputting the input image data as it is, and determines the display image data by reference to either a reference table area holding the emphasis conversion parameter and a reference table area holding the non-conversion parameter, by performing selective switching therebetween based on the user's video adjustment command content.

The present invention is a liquid crystal display for image display using a liquid crystal display panel, comprising: a video processor means for implementing a predetermined video adjustment process for input image data, in accordance with a user's video adjustment command; and a write-gray scale level determining means for determining emphasis-converted data for compensating an optical response characteristic of the liquid crystal display panel in accordance with, at least, a gray scale level transition of the input image data from a previous vertical period to a current vertical period, wherein the write-gray scale level determining means varies the emphasis-converted data for compensating the optical response characteristic of the liquid crystal display panel based on the user's video adjustment command content and supplies the resultant varied emphasis-converted data as display image data to the liquid crystal display panel.

The present invention is characterized in that the write-gray scale level determining means comprises: a subtracter for subtracting the input image data from the emphasis-converted data; a multiplier for multiplying an output signal from the subtracter by a weight coefficient which is variably controlled in accordance with the user's video adjustment command content; and, an adder for adding an output signal from the multiplier to the input image data so as to determine the display image data.

The present invention is characterized in that the write-gray scale level determining means comprises: a plurality of conversion table memories each storing a different emphasis conversion parameter for converting the input image data into the emphasis-converted data, and determines the display image data, by reference to one of the plural conversion table memories, by performing selective switching therebetween based on the user's video adjustment command content.

The present invention is characterized in that the write-gray scale level determining means comprises: a table memory storing a plurality of reference table areas each holding a different emphasis conversion parameter for converting the input image data into the emphasis-converted data, and determines the display image data, by reference to one of the plurality of reference table areas, by performing selective switching therebetween based on the user's video adjustment command content.

The present invention is characterized in that the video processing means adjusts a frequency characteristic of the input image data, based on the user's video adjustment command.

The present invention is characterized in that the video processing means adjusts a gray scale level characteristic of the input image data, based on the user's video adjustment command.

The present invention is a liquid crystal display for image display using a liquid crystal display panel, comprising: a write-gray scale level determining means which determines emphasis-converted data for compensating an optical response characteristic of the liquid crystal display panel, by implementing emphasis conversion for input image data in accordance with a gray scale level transition from a previous vertical period to a current vertical period and selects either the emphasis-converted data or the input image data, based on a user's command to supply the selected one as write-gray scale level data to the liquid crystal display panel.

The present invention is characterized in that the write-gray scale level determining means comprises: a conversion table memory storing an emphasis conversion parameter for converting the input image data into the emphasis-converted data that compensates the optical response characteristic of the liquid crystal display panel, in accordance with the gray scale level transition from the previous vertical period to the current vertical period; a subtracter for subtracting the input image data from the emphasis-converted data determined using the emphasis conversion parameter; a multiplier for multiplying an output signal from the subtracter by a weight coefficient which is selected in accordance with a user's command; and an adder for adding an output signal from the multiplier to the input image data so as to determine the write-gray scale level data.

The present invention is characterized in that the write-gray scale level determining means comprises: a conversion table memory storing a emphasis conversion parameter for converting the input image data into the emphasis-converted data that compensates the optical response characteristic of the liquid crystal display panel, in accordance with the gray scale level transition from the previous vertical period to the current vertical period; a non-conversion table memory storing a non-conversion parameter for outputting the input image data as it is; a selector implementing selective switching between the conversion table memory and the non-conversion table memory, in accordance with a user's command; and a write-gray scale level determining portion that determines the write-grayscale level data by reference to either the conversion table memory or the non-conversion table memory, which is selected by the selector.

The present invention is characterized in that the write-gray scale level determining means comprises: a table memory storing an emphasis conversion parameter for converting the input image data into the emphasis-converted data that compensates the optical response characteristic of the liquid crystal display panel, in accordance with a gray scale level transition from the previous vertical period to the current vertical period and a non-conversion parameter for outputting the input image data as it is; a selector implementing selective switching between a reference table area holding the emphasis conversion parameter and a reference table area holding the non-conversion parameter, based on a user's command; and, a write-gray scale level determining portion that determines the write-gray scale level data by reference to the reference table area in the table memory, which is selected by the selector.

The present invention is a liquid crystal display for image display using a liquid crystal display panel, comprising: a write-gray scale level determining means which determines emphasis-converted data for compensating an optical response characteristic of the liquid crystal display panel, by implementing emphasis conversion for input image data in accordance with a gray scale level transition from a previous vertical period to a current vertical period; and an installed state detecting means for detecting an installed state of the liquid crystal display, wherein the write-gray scale level determining means selects either the emphasis-converted data or the input image data based on the detected installed state of the liquid crystal display to supply the selected one as write-gray scale level data to the liquid crystal display panel.

The present invention is characterized in that the write-gray scale level determining means comprises: a conversion table memory storing an emphasis conversion parameter for converting the input image data into the emphasis-converted data that compensates the optical response characteristic of the liquid crystal display panel, in accordance with the gray scale level transition from the previous vertical period to the current vertical period; a subtracter for subtracting the input image data from the emphasis-converted data determined using the emphasis conversion parameter; a multiplier for multiplying an output signal from the subtracter by a weight coefficient which is selected in accordance with the installed state of the liquid crystal display; and an adder for adding an output signal from the multiplier to the input image data so as to determine the write-gray scale level data.

The present invention is characterized in that the write-gray scale level determining means comprises: a conversion table memory storing an emphasis conversion parameter for converting the input image data into the emphasis-converted data that compensates the optical response characteristic of the liquid crystal display panel, in accordance with the gray scale level transition from the previous vertical period to the current vertical period; a non-conversion table memory storing a non-conversion parameter for outputting the input image data as it is; a selector implementing selective switching between the conversion table memory and the non-conversion table memory, in accordance with the installed state of the liquid crystal display; and a write-gray scale level determining portion that determines the write-gray scale level data by reference to either the conversion table memory or the non-conversion table memory, which is selected by the selector.

The present invention is characterized in that the write-gray scale level determining means comprises: a table memory storing an emphasis conversion parameter for converting the input image data into the emphasis-converted data that compensates the optical response characteristic of the liquid crystal display panel, in accordance with the gray scale level transition from the previous vertical period to the current vertical period and a non-conversion parameter for outputting the input image data as it is; a selector implementing selective switching between a reference table area holding the emphasis conversion parameter and a reference table area holding the non-conversion parameter, based on the installed state of the liquid crystal display; and, a write-gray scale level determining portion that determines the write-gray scale level data by reference to the reference table area in the table memory, which is selected by the selector.

The present invention is a liquid crystal display for image display using a liquid crystal display panel, comprising: a write-gray scale level determining means which determines emphasis-converted data for compensating an optical response characteristic of the liquid crystal display panel, by implementing emphasis conversion for input image data in accordance with a gray scale level transition from a previous vertical period to a current vertical period; and an installed state detecting means for detecting an installed state of the liquid crystal display, wherein the write-gray scale level determining means varies the emphasis-converted data for compensating the optical response characteristic of the liquid crystal display panel based on a detected installed state of the liquid crystal display to supply the resultant varied emphasis-converted data as write-gray scale level data to the liquid crystal display panel.

The present invention is characterized in that the write-gray scale level determining means comprises: a conversion table memory storing an emphasis conversion parameter for converting the input image data into the emphasis-converted data that compensates the optical response characteristic of the liquid crystal display panel, in accordance with the gray scale level transition from the previous vertical period to the current vertical period; a subtracter for subtracting the input image data from the emphasis-converted data determined using the emphasis conversion parameter; a multiplier for multiplying an output signal from the subtracter by a weight coefficient which is variably controlled in accordance with the installed state of the liquid crystal display; and an adder for adding an output signal from the multiplier to the input image data so as to determine the write-gray scale level data.

The present invention is characterized in that the write-gray scale level determining means comprises: a plurality of conversion table memories each storing a different emphasis conversion parameter for converting the input image data into the emphasis-converted data that compensates the optical response characteristic of the liquid crystal display panel, in accordance with the gray scale level transition from the previous vertical period to the current vertical period; a selector for selecting one of the plurality of conversion table memories based on the installed state of the liquid crystal display; and, a write-gray scale level determining portion for determining the write-gray scale level data with reference to the conversion table memory selected by the selector.

The present invention is characterized in that the write-gray scale level determining means comprises: a table memory having a plurality of reference table areas each holding a different emphasis conversion parameter for converting the input image data into the emphasis-converted data that compensates the optical response characteristic of the liquid crystal display panel, in accordance with the gray scale level transition from the previous vertical period to the current vertical period; a selector for selecting one of the plurality of reference table areas based on the installed state of the liquid crystal display; and a write-gray scale level determining portion for determining the write-gray scale level data with reference to the reference table area in the table memory, which is selected by the selector.

The present invention is characterized in that the installed state detecting means is a vertical inversion sensor for detecting a state of vertical inversion of the liquid crystal display panel.

The present invention is characterized in that the installed state detecting means is an in-plane rotation sensor for detecting an in-plane rotated state of the liquid crystal display panel.

The present invention is a liquid crystal display for image display using a liquid crystal display panel, comprising: an emphasis converter means for determining emphasis-converted data for input image data for compensating an optical characteristic of the liquid crystal display panel, in accordance with a gray scale level transition from a previous vertical period to a current vertical period; a characteristic quantity detecting means for detecting a high frequency component contained in the input image data as a characteristic quantity of the input image data; and a control means which variably controls the emphasis-converted data from the emphasis converter means, based on the detected characteristic quantity and outputs the resultant controlled emphasis-converted data to the liquid crystal display panel.

The present invention is characterized in that the characteristic quantity detecting means detects the high frequency component exceeding a threshold which is variably controlled in accordance with a video adjustment command for the input image data.

The present invention is characterized in that the characteristic quantity detecting means detects the high frequency component exceeding a threshold which is variably controlled in accordance with an encoding parameter of the input image data.

The present invention includes a multiplier means for multiplying the emphasis-converted data by a weight coefficient, wherein the control means reduces the resultant controlled emphasis-converted data by variably controlling a value of the coefficient in accordance with the characteristic quantity and outputs the resultant reduced controlled emphasis-converted data to the liquid crystal display panel.

The present invention includes: a subtracter means for subtracting the input image data from the emphasis-converted data; a multiplier means for multiplying an output signal from the subtracter means by a weight coefficient; and, an adder means for adding an output signal from the multiplier means to the input image data to output the sum to the liquid crystal display panel, wherein the control means reduces the resultant controlled emphasis-converted data by variably controlling a value of the weight coefficient in accordance with the characteristic quantity and outputs the resultant reduced controlled emphasis-converted data to the liquid crystal display panel.

The present invention includes a table memory storing a plurality of different emphasis conversion parameters, wherein the emphasis converter means determines the emphasis-converted data based on the emphasis conversion parameters stored in the table memory, and the control means reduces the resultant controlled emphasis-converted data by selecting the emphasis conversion parameters to which the emphasis converter means refers, in accordance with the characteristic quantity and outputs the resultant reduced controlled emphasis-converted data to the liquid crystal display panel.

The present invention is a liquid crystal display for image display using a liquid crystal display panel, comprising: an emphasis converter means for determining emphasis-converted data for input image data for compensating an optical characteristic of the liquid crystal display panel, in accordance with a gray scale level transition from a previous vertical period to a current vertical period; a characteristic quantity detecting means for detecting a differential value between a plurality of pixels in the input image data, as a characteristic quantity of the input image data; and a control means which variably controls the emphasis-converted data from the emphasis converter means, in accordance with the detected characteristic quantity and outputs the resultant controlled emphasis-converted data to the liquid crystal display panel.

The present invention is characterized in that the characteristic quantity detecting means detects the differential value between the plurality of pixels exceeding a threshold which is variably controlled in accordance with an encoding parameter of the input image data.

The present invention includes a multiplier means for multiplying the emphasis-converted data by a weight coefficient, wherein the control means reduces the resultant controlled emphasis-converted data by variably controlling a value of the weight coefficient in accordance with the characteristic quantity and outputs the resultant reduced controlled emphasis-converted data to the liquid crystal display panel.

The present invention includes: a subtracter means for subtracting the input image data from the emphasis-converted data; a multiplier means for multiplying an output signal from the subtracter means by a weight coefficient; and, an adder means for adding an output signal from the multiplier means to the input image data to output the sum to the liquid crystal display panel, wherein the control means reduces the resultant controlled emphasis-converted data by variably controlling a value of the coefficient in accordance with the characteristic quantity and outputs the resultant reduced controlled emphasis-converted data to the liquid crystal display panel.

The present invention includes a table memory storing a plurality of different emphasis conversion parameters, wherein the emphasis converter means determines the emphasis-converted data based on the emphasis conversion parameters stored in the table memory, wherein the control means reduces the resultant controlled emphasis-converted data by selecting the emphasis conversion parameters to which the emphasis converter means refers, in accordance with the characteristic quantity and outputs the resultant reduced controlled emphasis-converted data to the liquid crystal display panel.

The above inventions provide the following operations and effects.

In the above configurations according to the present inventions, edges in the input image are detected and when a pixel is determined to be at an edge, accelerative drive is turned off for that pixel and the non-converted input image data is output as the display image data to the liquid crystal display panel. Therefore, image degradation due to adverse effects from overshoot drive can be prevented, whereby it is possible to realize high-quality image display.

In the above configurations according to the present inventions, noise contained in the input image data is detected, and based on the detection result, either the input image data or the emphasis-converted data is selected to be output to the liquid crystal display panel. Therefore, it is possible to positively prevent adverse effects due to overshoot drive.

In the above configurations according to the present inventions, since the amount of overshoot drive can be controlled based on the characteristic quantity of the input image data, it is possible to realize high quality image display with correct reproduction of half gray scales by compensating the response characteristic of the liquid crystal display panel while reducing image degradation occurring due to excessive emphasis of noise etc., to as low as possible.

In the above configurations according to the present inventions, since the amount of overshoot drive can be variably controlled based on the video adjustment command from the user, it is possible to inhibit image degradation of the displayed image by canceling adverse effects due to overshoot drive resulting from the video adjustment.

In the above configurations according to the present inventions, it is possible to prevent image degradation of the displayed image by stopping overshoot drive under the command of the user if an incorrect image is displayed due to device failure, the installed state of the device or the properties of the input image when overshoot drive is implemented.

In the above configurations according to the present inventions, since pertinent write-gray scale level data is supplied to the liquid crystal display panel by stopping overshoot drive or by varying the degree of emphasis in overshoot drive, in accordance with the installed state of the device, it is possible to prevent image degradation of the displayed image in whatever position the device is set.

BRIEF DESCRIPTION OF DRAWINGS

FIG. 15 is a block diagram showing an edge detecting circuit in the third embodiment of a liquid crystal display of the present invention.

FIG. 16 is an illustrative view showing another ROM configuration (table content example) in the third embodiment of a liquid crystal display of the present invention.

FIG. 18 is a schematic illustration showing one example of ROM table content in the fourth embodiment.

FIG. 27 is a schematic illustration showing the table content in an OS table memory that stores high-level emphasis parameters used in example 4.

FIG. 28 is a schematic illustration showing the table content in an OS table memory that stores low-level emphasis parameters used in example 4.

FIG. 29 is a schematic illustration showing the table content in an OS table memory that stores non-conversion parameters used in example 4.

FIG. 30 is a schematic illustration showing the table content in an OS table memory that stores two kinds of emphasis parameters and non-conversion parameters used in example 4.

FIG. 35 is a schematic illustration showing the table content of an OS table memory for use in the seventh embodiment.

FIG. 42 is a schematic illustration showing the table content of a weak-conversion table memory for use in the ninth embodiment.

FIG. 43 is a schematic illustration showing the table content of a non-conversion table memory for use in the ninth embodiment.

FIG. 45 is a schematic illustration showing the table content of a table memory for use in the tenth embodiment.

FIG. 47 is a schematic illustration showing the table content of an OS table memory for use in the eleventh embodiment.

FIG. 50 is a schematic illustration showing the table content of a non-conversion table memory for use in the twelfth embodiment.

FIG. 52 is a schematic illustration showing the table content of a table memory for use in the thirteenth embodiment.

FIG. 54 is a schematic illustration showing the table content of an OS table memory for use in the fourteenth embodiment.

FIG. 57 is a schematic illustration showing the table content of a non-conversion table memory for use in the sixteenth embodiment.

FIG. 60 is a schematic illustration showing the table content of a table memory for use in the eighteenth embodiment.

FIG. 61 is a schematic illustration showing the table content of a table memory for use in the nineteenth embodiment of a liquid crystal display of the present invention.

BEST MODE FOR CARRYING OUT THE INVENTION

Figures 1, 2:
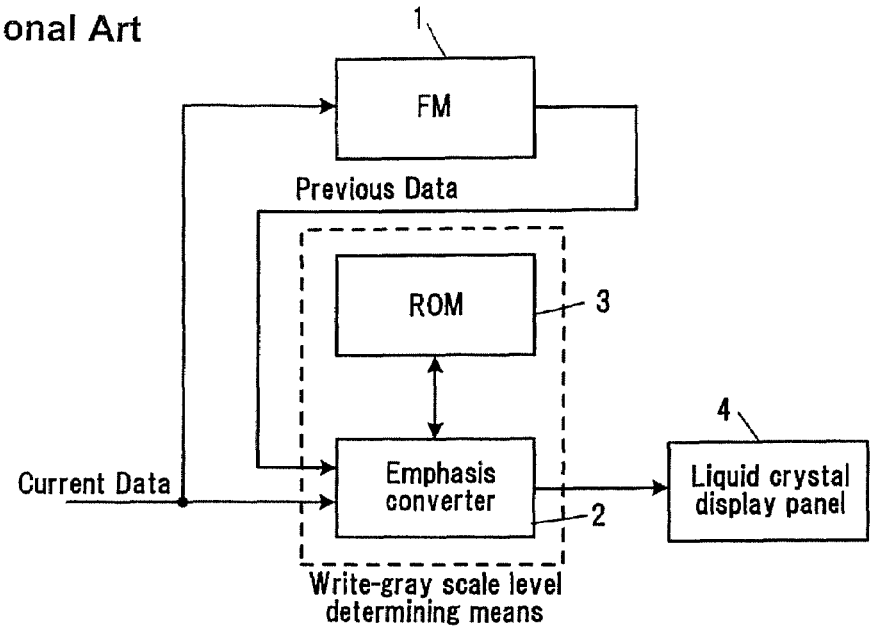
FIG. 1 Conventional Art
Conventional Art FIG. 2
FIG. 1 is a block diagram showing a schematic configuration of an overshoot drive circuit in a conventional liquid crystal display.
FIG. 2 is a schematic illustration showing one example of the table content in an OS table memory used in an overshoot drive circuit.
Figure 3:
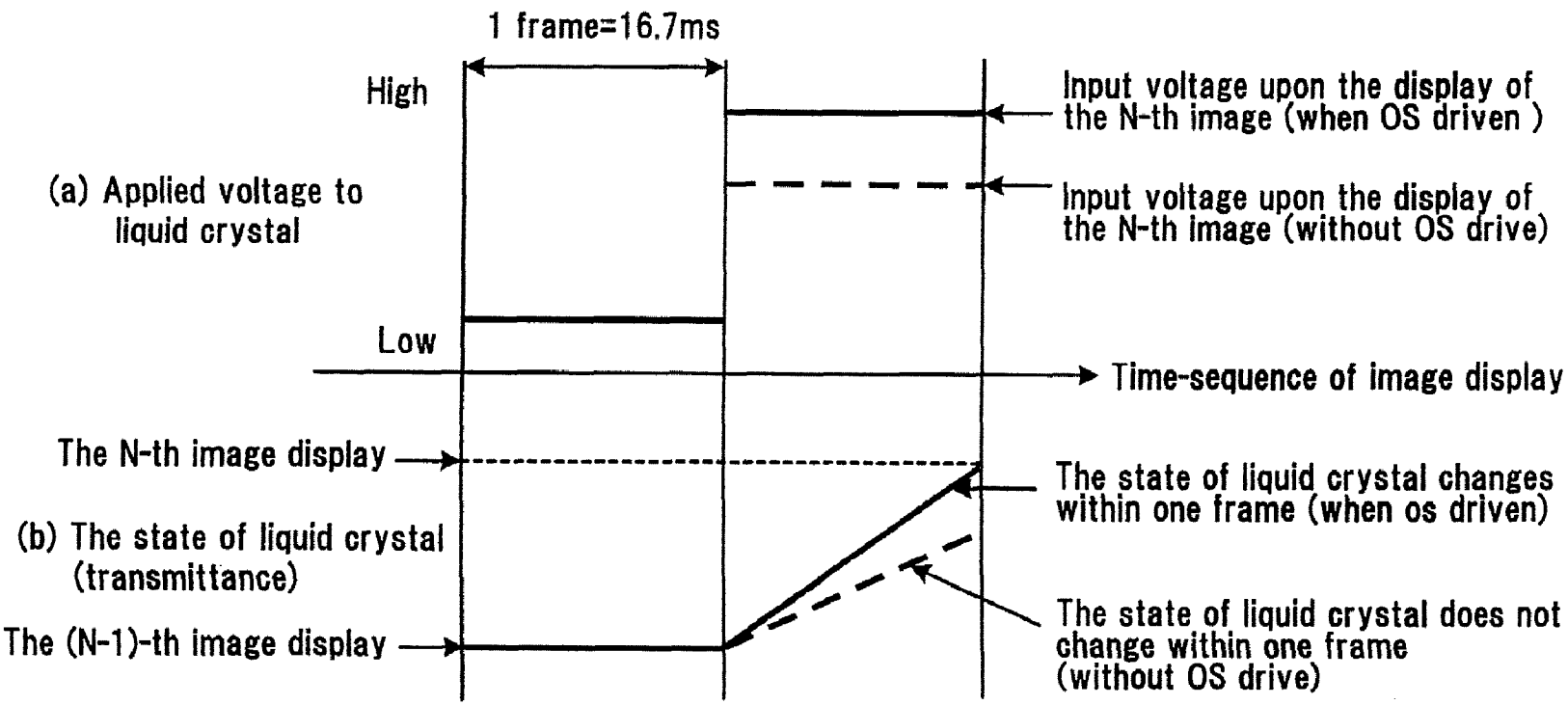
Conventional Art FIG. 3
FIG. 3 is an illustrative view showing the relationship between the voltages applied to liquid crystal and the responses of the liquid crystal.
Figure 4:
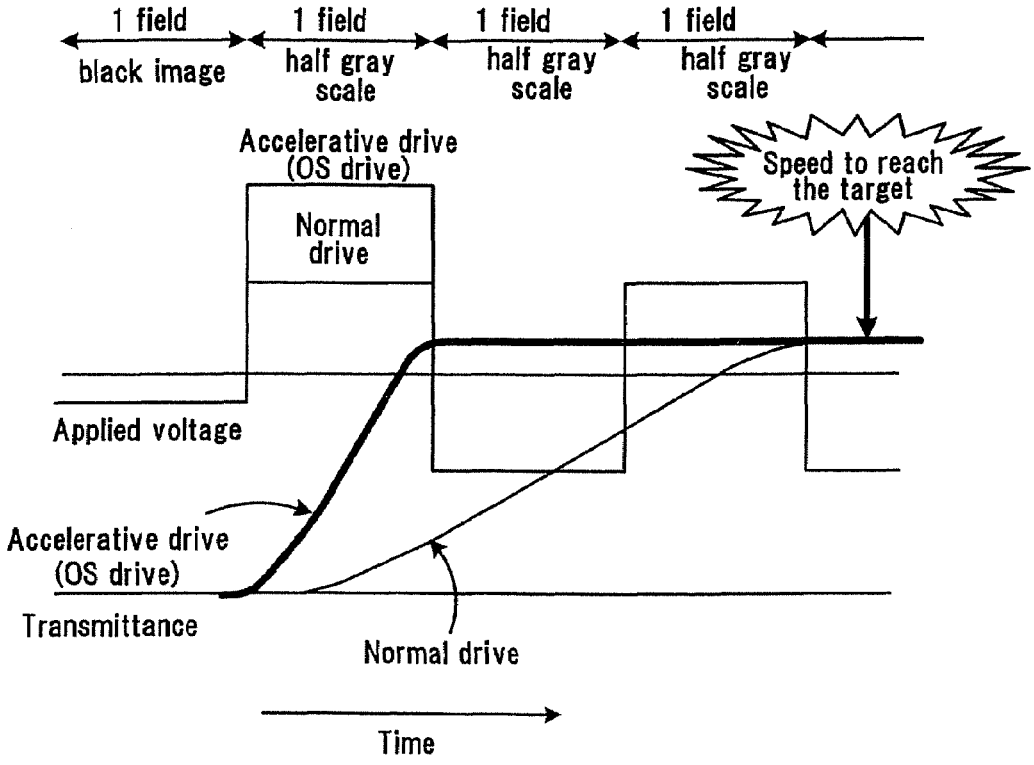
FIG. 4 Conventional Art
FIG. 4 is a chart showing the relationship between the transmittance and the applied voltage when the optimal OS drive is realized in the prior art.
Figure 5:
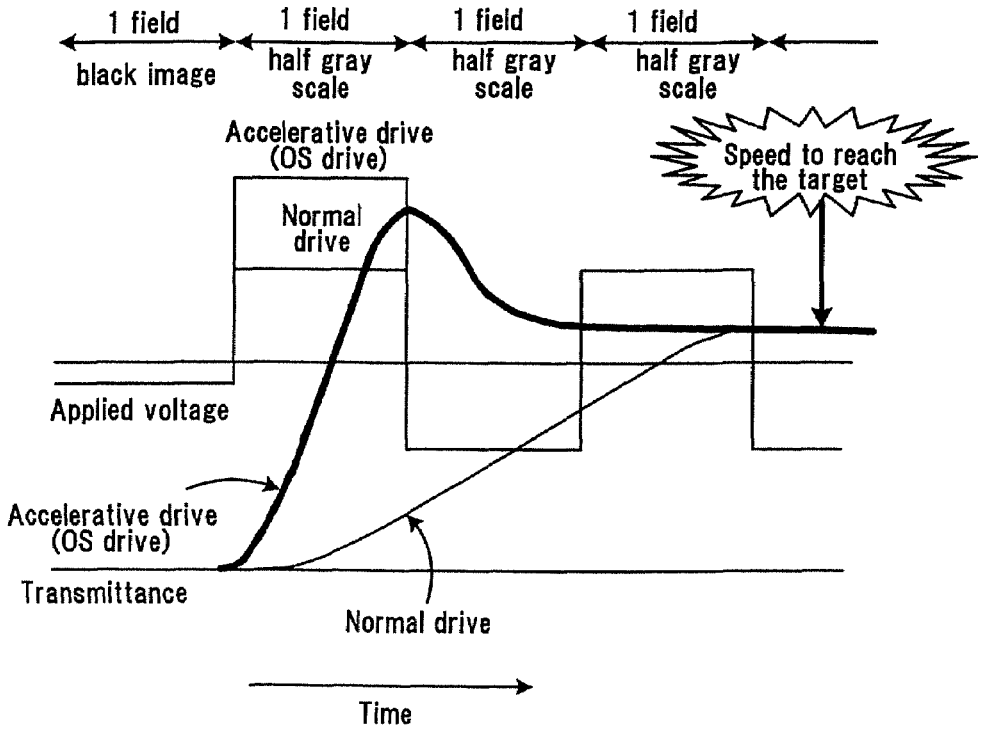
FIG. 5 Conventional Art
FIG. 5 is a chart showing the relationship between the transmittance and the applied voltage when the optimal OS drive could not be realized in the prior art.
Figure 6:
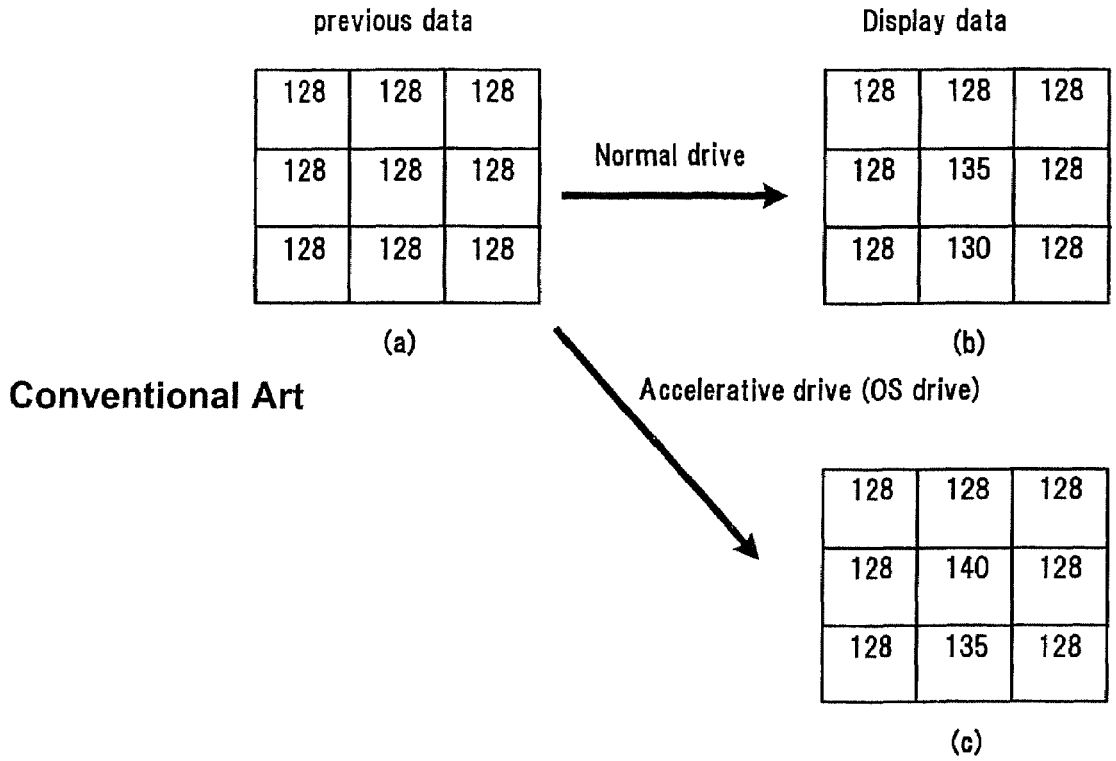
FIG. 6 is an illustrative view showing display data when noise is laid over the input image data.
Figure 7:
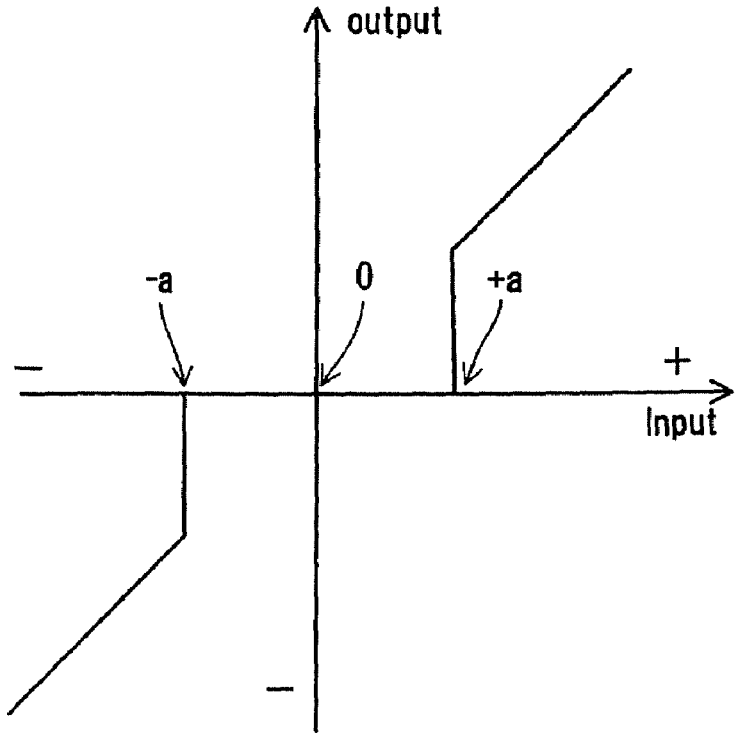
FIG. 7 Conventional Art
FIG. 7 is an illustrative view showing the input/output characteristic of an afterimage cancellation circuit in a conventional liquid crystal display.
Figure 8:
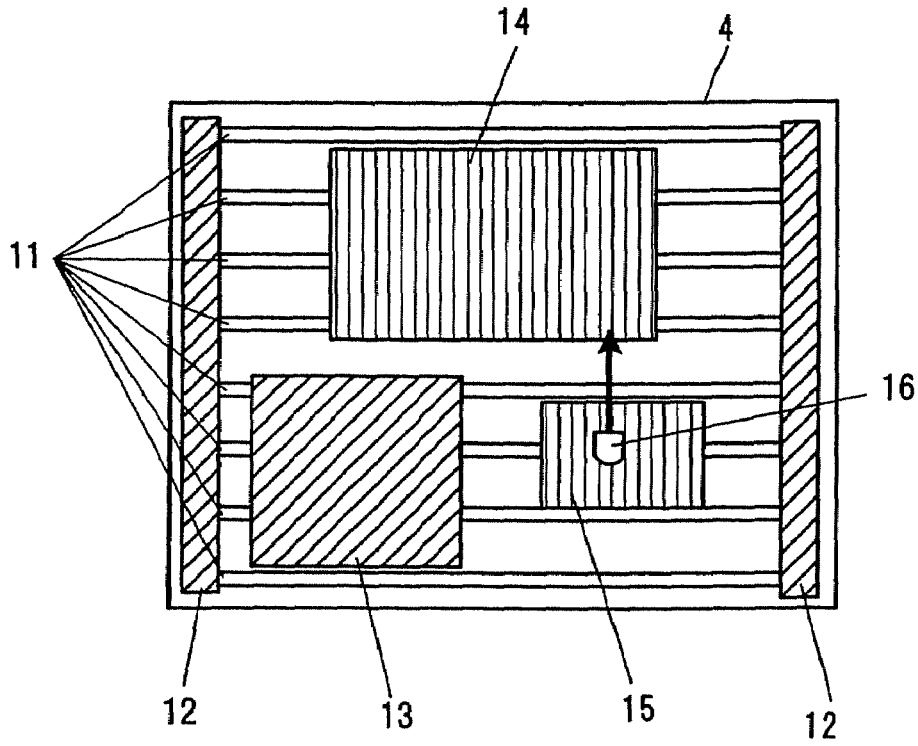
Conventional Art FIG. 8
FIG. 8 is an illustrative view showing a schematic configuration example of a direct backlight type liquid crystal display, viewed from the rear side thereof.

The embodiments of the present invention will be described hereinbelow.

THE FIRST EMBODIMENT

Now, the first embodiment of a liquid crystal display of the present invention will be described in detail with reference to FIGS. 10 and 11. The same components as those in the above-described conventional example are allotted with the same reference numerals and description for those is omitted. Here, FIG. 10 is a block diagram showing a schematic configuration of a liquid crystal display of this embodiment, and FIG. 11 is a block diagram showing an edge detecting circuit in the liquid crystal display of the present embodiment.

Figure 10:
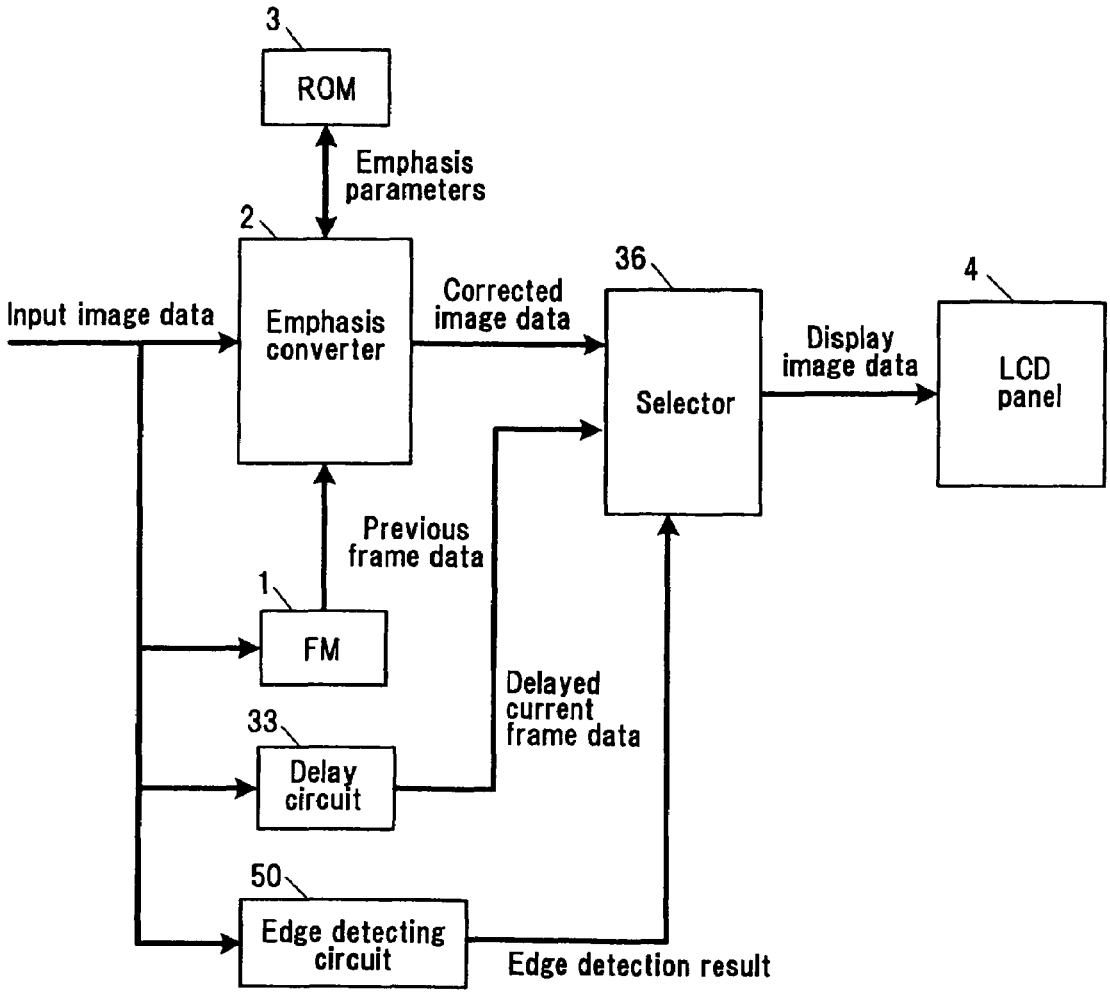
FIG. 10 a block diagram showing the schematic configuration of the first embodiment of a liquid crystal display of the present invention.
Figure 11:
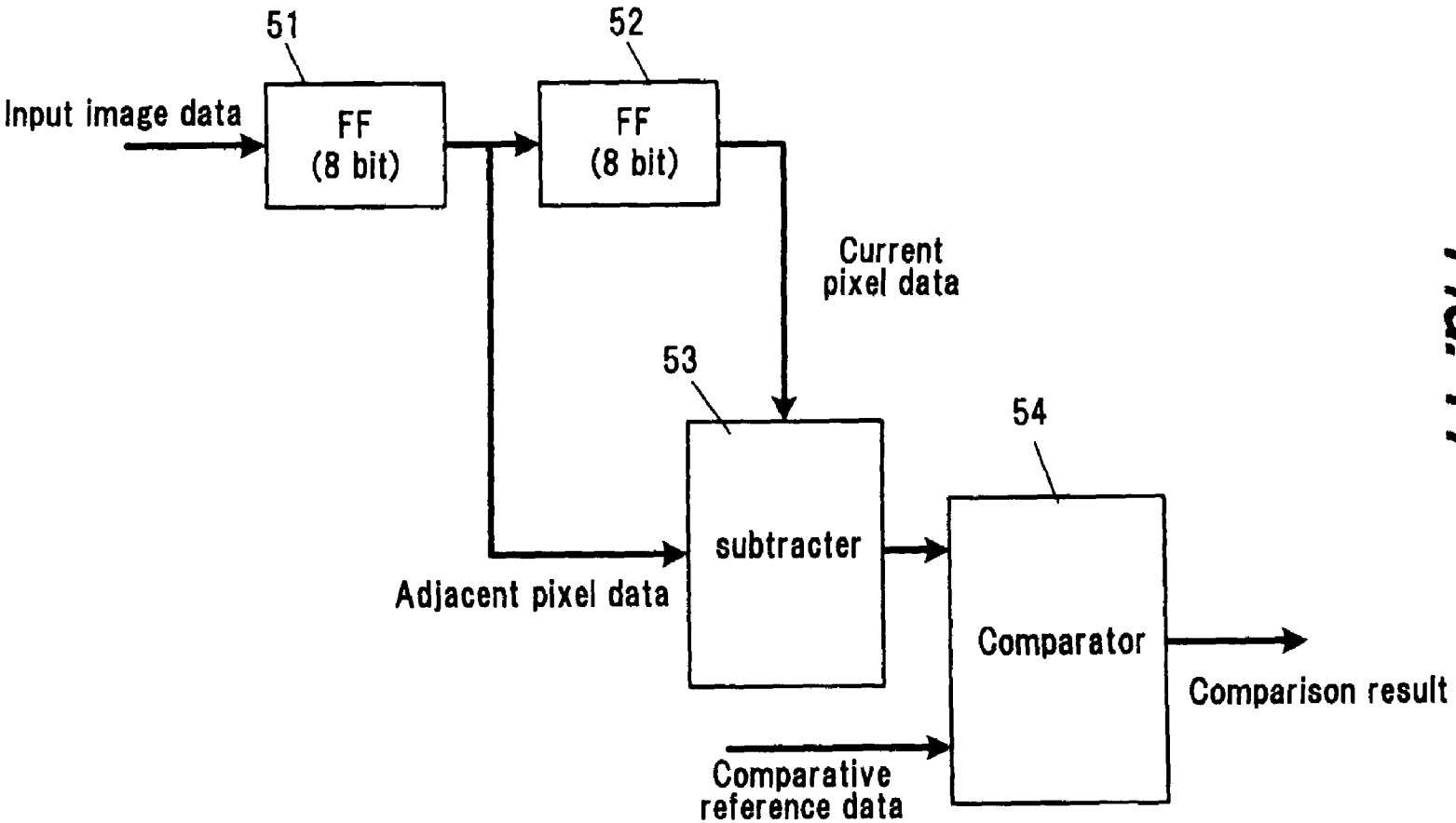
FIG. 11 is a block diagram showing an edge detecting circuit in the first embodiment of a liquid crystal display of the present invention.

As shown in FIG. 10, the liquid crystal display of the present embodiment includes a delay circuit 33 for compensating the operation processing time of an emphasis converter 2 in order to make the input image data in phase, with respect to the time axis, with the emphasized data; an edge detecting circuit 50 for detecting edges within the input image data; and a selector 36 for selecting either the current field input image data or the emphasized data from the emphasis converter 2, pixel by pixel, based on the edge detection result from edge detecting circuit 50, and outputting the selected data as the display image data to a liquid crystal panel 4.

Emphasis converter 2 compares the current field image data with the image data one field before, output from an FM1, and reads out the emphasis conversion parameters corresponding to gray scale level transitions between both pieces of data from ROM 3 and determines the emphasized data (corrected image data) to be output to liquid crystal display panel 4 for all the gray scale level transitions, by implementing linear interpolation or other operations on the emphasis conversion parameters.

Next, a constitutional configurational example of edge detecting circuit 50 will be described with reference to FIG. 11. Though description herein will be given assuming that the input image data is an R signal of 8 bit data, obviously this will not limit the invention. The input image data is latched by an 8 bit flip-flop (to be abbreviated as FF, hereinbelow) 51 and then by another flip-flop (to be abbreviated as FF, hereinbelow) 52. Here, these two blocks, FF 51 and FF 52, constitute a shift register.

Thereby, the relationship between the data held by FF 51 and the data held by FF 52 is that of neighboring pixels of data. Both the data held at FF 51 and FF52 are input to a subtracter 53 so that the difference between the neighboring pixels is supplied to a comparator 54. This comparator 54 compares the output from subtracter 53 with a reference data for comparison to verify whether the pixel is at an edge and outputs the comparison result as an edge detection result to selector 36.

In this way, it is possible to determine whether the current input pixel data is at an edge or not, and based on the detected result, selector 36 can select one from the current field input image data from delay circuit 33 and the emphasized data from the emphasis converter 2 and supply the selected one to liquid crystal display panel 4. Illustratively, when data "1" that represents the presence of an edge is input as the edge detection result, selector 36 directly outputs the current field input image data, which has not been emphasis-converted, as the pixel data to liquid crystal display panel 4.

As described above, according to the liquid crystal display of this embodiment, accelerative drive is turned off and the normal drive is effected for the pixel areas that have been determined to belong to image edges. Therefore, adverse effects from the accelerative drive such as unnatural hues, white spots, flickering and the like occurring at and around edges can be removed, whereby it is possible to realize high-quality image display.

Here, though in the above first embodiment the write-gray scale level determining means is constituted of ROM 3 and computing unit 2, a two-dimensional function f (pre, cur) defined by, for instance, two variables, i.e., the gray scale level before transition and the gray scale level after transition, may be provided instead of provision of ROM 3, so as to determine the corrected image data (emphasis-converted data) for compensating the optical response characteristic of liquid crystal display panel 4.

THE SECOND EMBODIMENT

Next, the second embodiment of a liquid crystal display of the present invention will be described with reference to FIG. 12. The same components as those in the above first embodiment are allotted with the same reference numerals and description for those is omitted. Here, FIG. 12 is a block diagram showing a schematic configuration of exemplary components in the liquid crystal display of the present embodiment.

Figure 12:
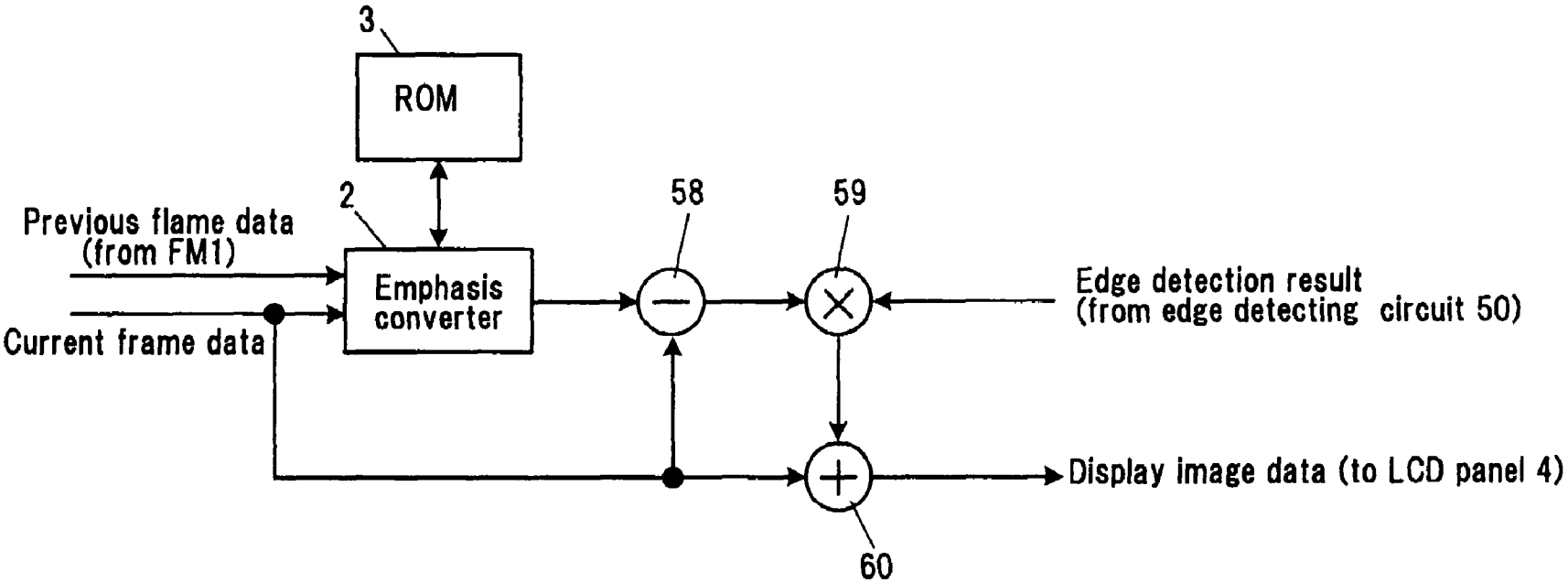
FIG. 12 is a block diagram showing a schematic configuration of exemplary components in the second embodiment of a liquid crystal display of the present invention.

The liquid crystal display of this embodiment, instead of having selector 36 in the first embodiment, includes: as shown in FIG. 12, a subtracter 58 for subtracting the input image data from the corrected image data (emphasized data) obtained by emphasis converter 2; a multiplier 59 for multiplying the output data from the subtracter 58 by a weight coefficient k ($0 \leqq k \leqq 1$); and an adder 60 which adds the output data from multiplier 21 to the input image data so as to provide display image data.

Here, the weight coefficient k in multiplier 59 is variable based on the edge detection result from edge detecting circuit 50. Specifically, when data "0" that represents no edge detection is input as the edge detection result, the weight coefficient k is set at 1 so that the emphasized data is output to liquid crystal panel 4. On the other hand, when data "1" that represents the presence of an edge is input, the weight coefficient k is set at 0 so that the input image data does not undergo emphasis conversion but is supplied as is, as the display image data, to liquid crystal panel 4.

As described above, also in this embodiment, accelerative drive is turned off and the normal drive is effected for the pixels that have been determined to belong to image edges. Therefore, adverse effects from the accelerative drive such as unnatural hues, white spots, flickering and the like occurring at and around edges can be removed, whereby it is possible to realize high-quality image display. Further, the setup of making the weight coefficient k variable enables more flexible control of the image display data.

THE THIRD EMBODIMENT

Figure 13:
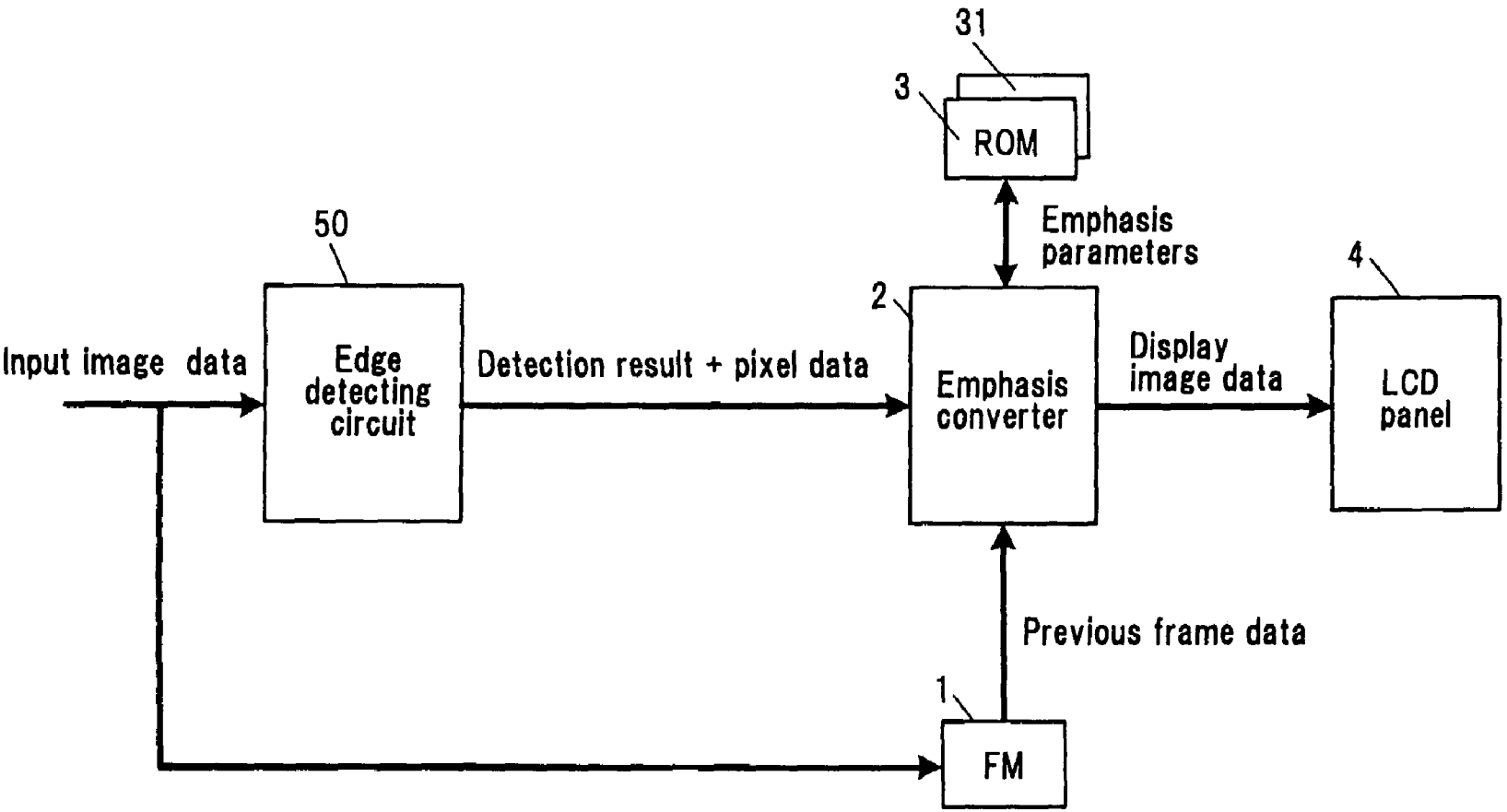
FIG. 13 a block diagram showing the schematic configuration of the third embodiment of a liquid crystal display of the present invention.
Figure 14:
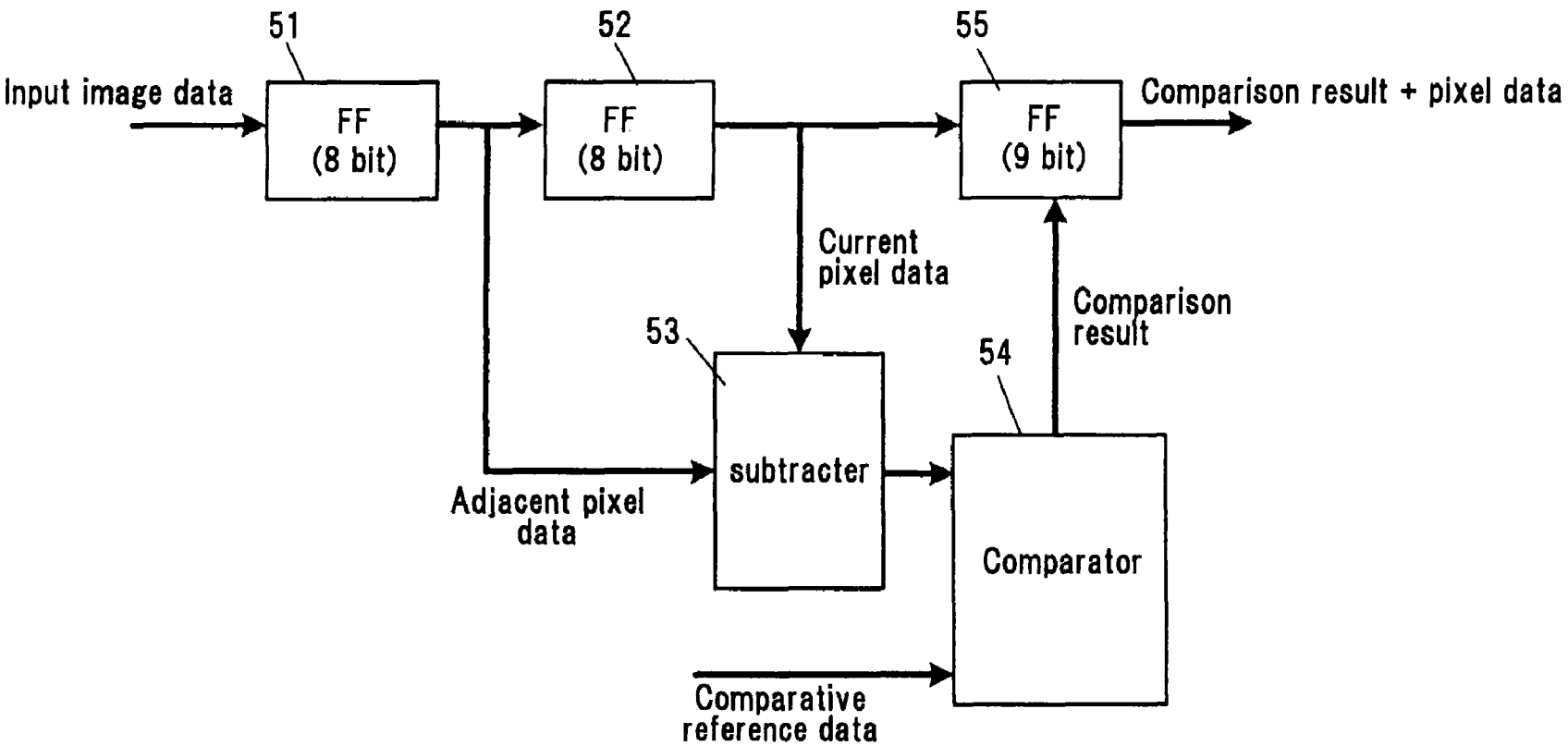
FIG. 14 is an illustrative view showing the example of table content in ROM 21 (non-conversion table memory) in the third embodiment of a liquid crystal display of the present invention.

Next, the third embodiment of a liquid crystal display of the present invention will be described with reference to FIGS. 13 through 16. The same components as those in the above first embodiment are allotted with the same reference numerals and description for those is omitted. Here, FIG. 13 is a block diagram showing a schematic configuration of the liquid crystal display of the present embodiment; FIG. 14 is an illustrative view showing the non-conversion table content in ROM in the liquid crystal display of this embodiment; FIG. 15 is a block diagram showing an edge detecting circuit in the liquid crystal display of this embodiment; and FIG. 16 is an illustrative view showing another ROM configuration in the liquid crystal display of this embodiment.

The liquid crystal display of the present embodiment has ROM 31 (non-conversion table memory) that stores non-conversion parameters (i.e., the through-table shown in FIG. 14) in addition to ROM 3 (conversion table memory) that stores emphasis conversion parameters, as shown in FIG. 13, and selection control is made for every pixel between accelerative drive and normal drive, by selectively referring to either ROM 3 or ROM 31 based on the edge detection result from edge detecting circuit 50.

Here, edge detecting circuit 50 of this embodiment is composed, as shown in FIG. 15, of 8 bits FF51 and FF52 for latching the input image data (8 bit data), a subtracter 53 for performing subtraction of data held at FF51 and FF52 to determine the differential value between neighboring pixels, a comparator 54 for comparing the differential value between neighboring pixels from subtractor 53 with comparative reference data, and in addition, a flip-flop (FF) 15 that produces 9 bit data by joining the comparison result (1 bit) from comparator 54 and the 8 bit pixel data from FF52 and outputs it.

For example, when 8 bit data "00 . . . 0011" is input from FF52 and data "1" that represents the presence of an edge is output from comparator 54, FF55 joins "1" and "00 . . . 0011" to generate 9 bit data "100 . . . 0011" and outputs it to emphasis converter 2. On the other hand, when data "0" that represents no edge is input, FF55 joins "0" and "00 . . . 0011" to generate 9 bit data "000 . . . 0011" and output it to emphasis converter 2.

Emphasis converter 2 checks the value at the ninth bit of the output data from FF55 to verify whether the current pixel data belongs to an edge. Then, the pixel of data tagged with the edge presence detection is subjected to the emphasis conversion with reference to ROM 3 (conversion table memory), and the emphasis data is output to liquid crystal display panel 4. On the other hand, the pixel of data tagged with the non-edge detection is output straight through without conversion by making reference to ROM 31 (non-conversion table memory).

As described above, also in the liquid crystal display of this embodiment, accelerative drive is turned off and the normal drive is effected for the pixel areas that have been determined to belong to image edges. Therefore, adverse effects from the accelerative drive such as unnatural hues, white spots, flickering and the like occurring at and around edges can be removed, whereby it is possible to realize high-quality image display.

In the above third embodiment, the table contents of ROMs 3 and 31 may also be stored in a single table memory. Illustratively the non-conversion parameters and the emphasis conversion parameters are stored in respective table areas as shown in FIG. 16, and the table area to be referred to is selected based on the edge detection result, i.e., the value at the ninth bit, whereby it is possible to produce the same effect as that when ROMs 3 and 31 are provided separately.

THE FOURTH EMBODIMENT

Figure 17:
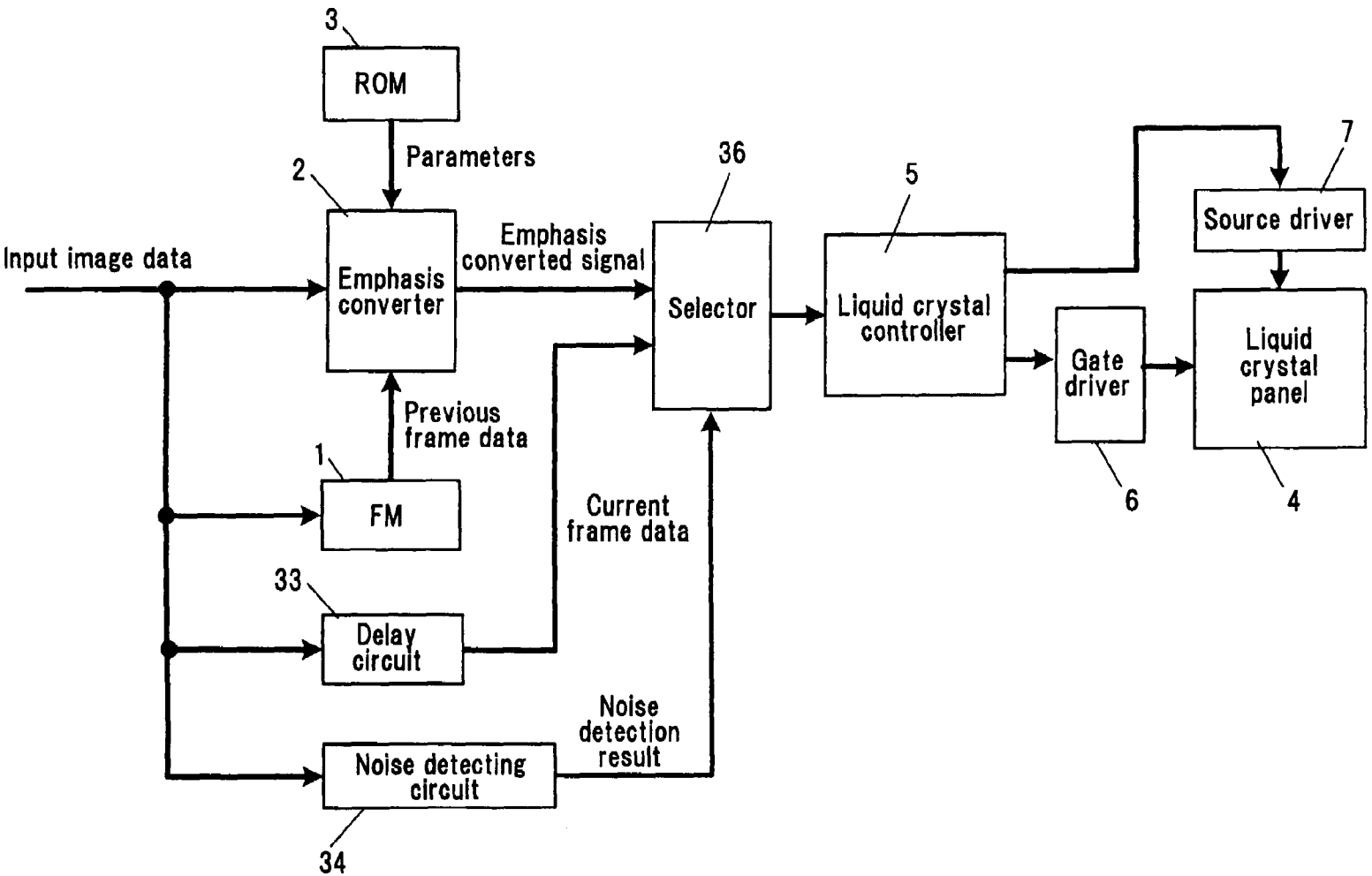
FIG. 17 is a block diagram showing a schematic configuration of exemplary components in the fourth embodiment of a liquid crystal display of the present invention.
Figure 19:
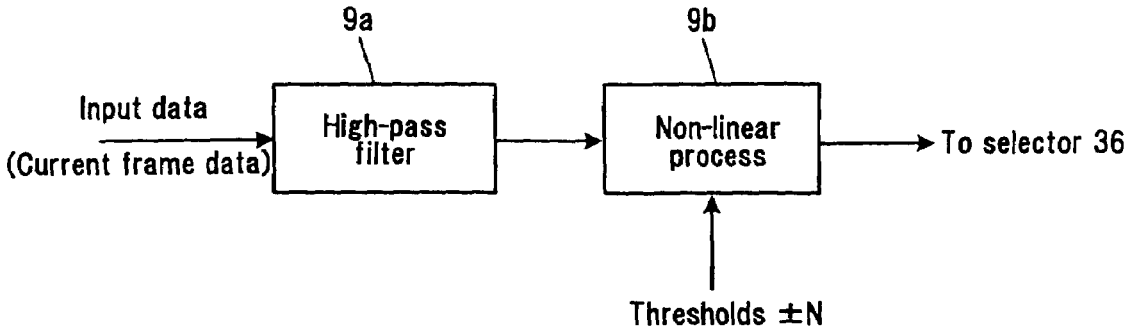
FIG. 19 is a block diagram showing a noise detecting circuit in the fourth embodiment.
Figure 20:
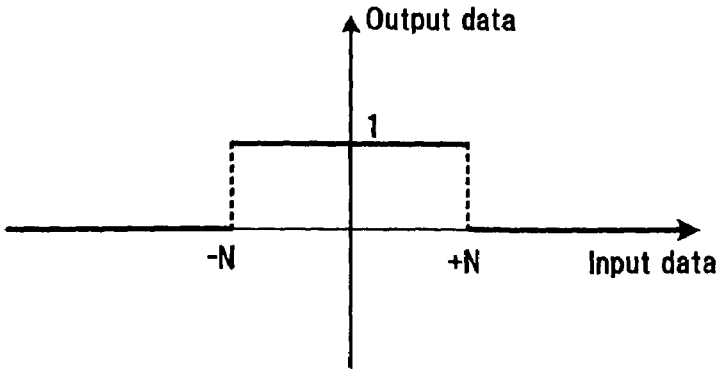
FIG. 20 is an illustrative view for explaining the noise detecting circuit in the fourth embodiment.

Next, the fourth embodiment of the present invention will be described in detail with reference to FIGS. 17 through 20. FIG. 17 is a block diagram showing a schematic configuration of exemplary components in a liquid crystal display of the present embodiment; FIG. 18 is a schematic illustration showing the ROM table content in the liquid crystal display of the present embodiment; FIG. 19 is a block diagram showing a noise detecting circuit in the liquid crystal display of the present embodiment; and FIG. 20 is a view for explaining the noise detecting circuit in the liquid crystal display of the present embodiment.

Designated at 1 is a frame memory (FM), 3 a ROM storing emphasis conversion parameters depending on the gray scale level transitions of input image data, 2 an emphasis converter which, by comparing the current frame image data with the previous frame image data read out from FM2 and reading out emphasis conversion parameters corresponding to the comparison results (gray scale level transitions), determines and outputs the emphasis-converted data (corrected image data), and 5 a liquid crystal controller which, based on the emphasis-converted data from emphasis converter 2, outputs liquid crystal drive signals to a gate driver 6 and a source driver 7 of liquid crystal display panel 4.

Designated at 33 is a delay circuit for compensating the operation processing time of emphasis converter 2 in order to make the input image data in phase, with respect to the time axis, with the emphasis-converted data; 34 a noise detecting circuit for detecting noise laid over the input image data; 36 a selector for selecting either the current frame input image data or the emphasis-converted data from the emphasis converter 2, pixel by pixel, based on the noise detection result from noise detecting circuit 34, and outputting the selected data to liquid crystal controller 5.

In the above arrangement, ROM 3 stores a table in which emphasis conversion parameters corresponding to gray scale level transitions of the input image data from one frame to the next. When the number of display signal levels, i.e., the amount of display data, is 256 gray scales represented by 8 bits, emphasis conversion parameters for all 256×256 gray scale level transition patterns may be contained in ROM 3, but herein in order to reduce the memory capacity of ROM 3, a table storing only 9×9 emphasis conversion parameters (actually measured values) that represent nine representative gray scale levels every 32 gray scale levels as shown in FIG. 18 may be used.

Emphasis converter 2 reads out corresponding emphasis conversion parameters in accordance with the gray scale level transitions from one frame to the next by reference to ROM 3 and implements linear interpolation or other operations based on the emphasis conversion parameters so as to be able to determine the emphasis-converted data (corrected image data) for all the gray scale level transitions to be output to liquid crystal controller 5.

As described above, according to the present embodiment, since selector 36 which is provided independently from the emphasis conversion processor is provided so as to select and output either the input image data or the emphasis-converted data, which are in phase with each other, it is possible, as will be described hereinbelow, to implement selection control between OS drive and normal drive based not only on the one-dimensional (with respect to the temporal axis) noise detection result as in the above-described conventional example but also on multi-dimensional noise detection result.

Specifically, in the present embodiment, the noise detecting circuit 34 is composed of, as shown in FIG. 19, a high-pass filter 9*a* for extracting high frequency components contained in the current frame input image data and a non-linear processor 9*b* for implementing non-linear processing on the high frequency components extracted by high-pass filter 9*a*, and performs noise detection based on the correlation between pixels of the input image data with respect to the horizontal direction and the vertical direction on the image frame.

Non-linear processor 9*b* regards any data having an amplitude level falling within the range between thresholds ±N as a noise component as shown in FIG. 20, and outputs "1" for the portion on which noise is superposed. In this way, two-dimensional spatial noise in the input image data can be detected, so that selector 36 can be controlled to select and output the current frame input image data for a pixel area where noise has been detected. Therefore, it is possible to positively reduce adverse effects from OS drive, such as white spots, flickering etc., generated by emphasis of unwanted noise components.

Here, the above noise detecting circuit 34 performs noise detection based on the correlation between pixels in the horizontal direction and in the vertical direction on the image frame, but the correlation between pixels is not limited to that between neighboring ones, and the correlation between pixels one or more pixels apart may also be used for noise detection. Further, various types of circuits can be adopted as a specific circuit configuration for detecting the spatial noise as above, and obviously the present invention should not be limited to the circuit configuration described above.

For example, when the coded image data encoded based on a coding scheme that implements orthogonal transformation for every block made up of, for example, M×N pixels, is input/decoded to perform image display, block distortion whereby boundaries of processed blocks appear in the flat portion of the decoded image, and mosquito noise that causes haze around edges of characters and contours occur, depending on the compression ratio of the image coded data. It is obviously understood that provision of a circuit configuration for detecting these noises may prevent image degradation occurring due to enhancement of block distortion and mosquito noise.

Further, though in the above embodiment the emphasis conversion processor is constituted of ROM 3 and emphasis converter 2, a two-dimensional function f(pre, cur) defined by, for instance, two variables, i.e., the gray scale level before transition and the gray scale level after transition, may be provided instead of ROM 3, so as to determine the emphasis-converted data for compensating the optical response characteristic of liquid crystal display panel 4.

Moreover, in the above embodiment, the response speed of liquid crystal display panel 4 is improved by comparing the previous frame image data and the current flame image data and using the emphasis conversion parameters obtained based on the comparison. However, it is of course possible to provide a configuration in which the emphasis conversion parameters are determined based on image data two frames before or three frames before.

THE FIFTH EMBODIMENT

Next, the fifth embodiment of the present invention will be described in detail with reference to FIG. 21. The same components as those in the above fourth embodiment are allotted with the same reference numerals and description for those is omitted. Here, FIG. 21 is a block diagram showing a noise detecting circuit in a liquid crystal display of the present embodiment.

The arrangement of the liquid crystal display of this embodiment is constructed such that, in the above-described fourth embodiment described with reference to FIG. 17, the previous frame image data from FM2, as well as the current frame image data, is input to noise detecting circuit 34, and the noise detecting circuit 34, based on both pieces of image data, implements three-dimensional noise detection so as to perform switching control of selector 36 to thereby remove adverse effects from OS drive in a more reliable manner.

Figure 21:
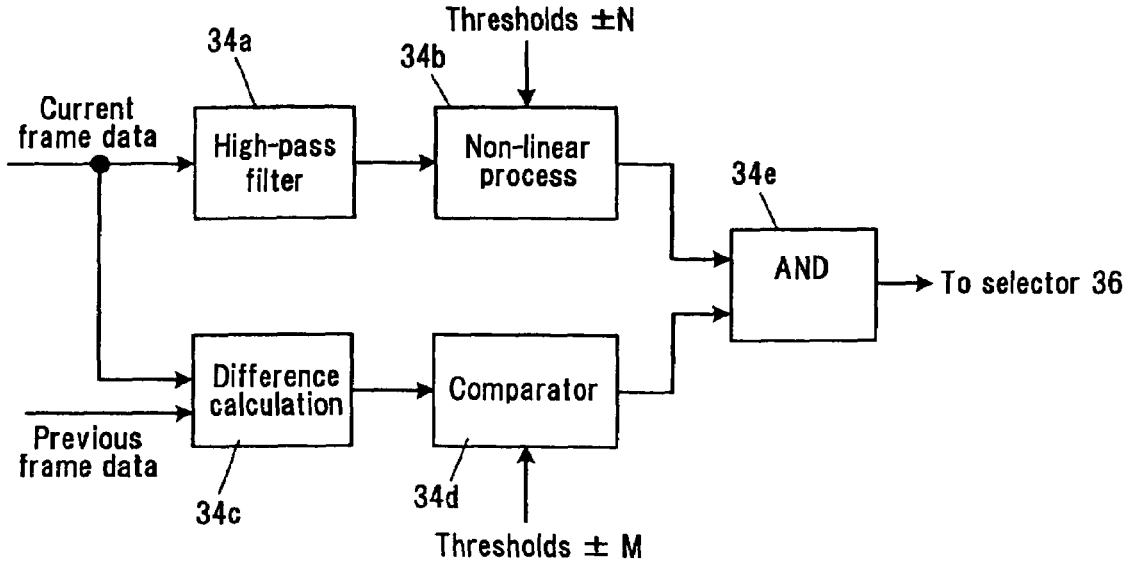
FIG. 21 is a block diagram showing a noise detecting circuit in the fifth embodiment of a liquid crystal display of the present invention.

Specifically, noise detecting circuit 34 of this embodiment includes: as shown in FIG. 21, a high-pass filter 34*a* for detecting two-dimensional spatial noise; a non-linear processor 34*b*; a difference calculator 34*c* for detecting temporal noise; a comparator 34*d*; and an AND circuit 34*e* for producing the logical product of the spatial noise detection result and the temporal noise detection result.

Difference calculator 34*c* calculates the differential value in image data level between one frame and the next. Comparator 34*d* compares the differential value with the thresholds ±M. When the differential value falls between the thresholds ±M, the comparator outputs "1" regarding the data as noise. Thus, it is possible to detect noise based on the correlation of the input image data between pixels with respect to the temporal direction.

Also herein, it is obvious that temporal noise detection can be done based on the difference in image data level between frames one or more frame periods apart, not being limited to the two continuous frames. Further, various types of circuits can be adopted as a specific circuit configuration for detecting temporal noise.

AND circuit 34*e* outputs "1" only when the output signal from non-linear processor 9*b* and the output signal from comparator 9*d* are both "1", regarding the data as a noise component for the noise overlapping portion. With the above arrangement, it is possible to detect three-dimensional noise on the input image data. That is, selector 36 is controlled to switch so as to output the current frame input image data for the portions of pixels where noise has been detected, whereby it is possible to positively reduce adverse effects from OS drive, such as white spots, flickering etc., generated by emphasis of unwanted noise components.

As described heretofore, according to the embodiment of the present invention, since selector (switching means) 10 which is provided independently from the emphasis converter is adapted to perform the switching between the input image data and the emphasis-converted data for the image data to be supplied to liquid crystal display panel 4, it is possible to perform two or greater dimensional noise detection and implement selection control between OS drive and normal drive in accordance with the noise detection result, regardless of the way the noise detection is done. Accordingly, it is possible to positively reduce adverse effects due to emphasis of unwanted noise components, hence prevent degradation of the displayed image.

In the above-described embodiment of the present invention, the thresholds for noise judgment ±N and ±M may be fixed values which are determined at the design stage or may be adapted to be variable so as to be set at arbitrary values in accordance with the user command input or various conditions such the source type of the input image data and other factors.

THE SIXTH EMBODIMENT

Figure 22:
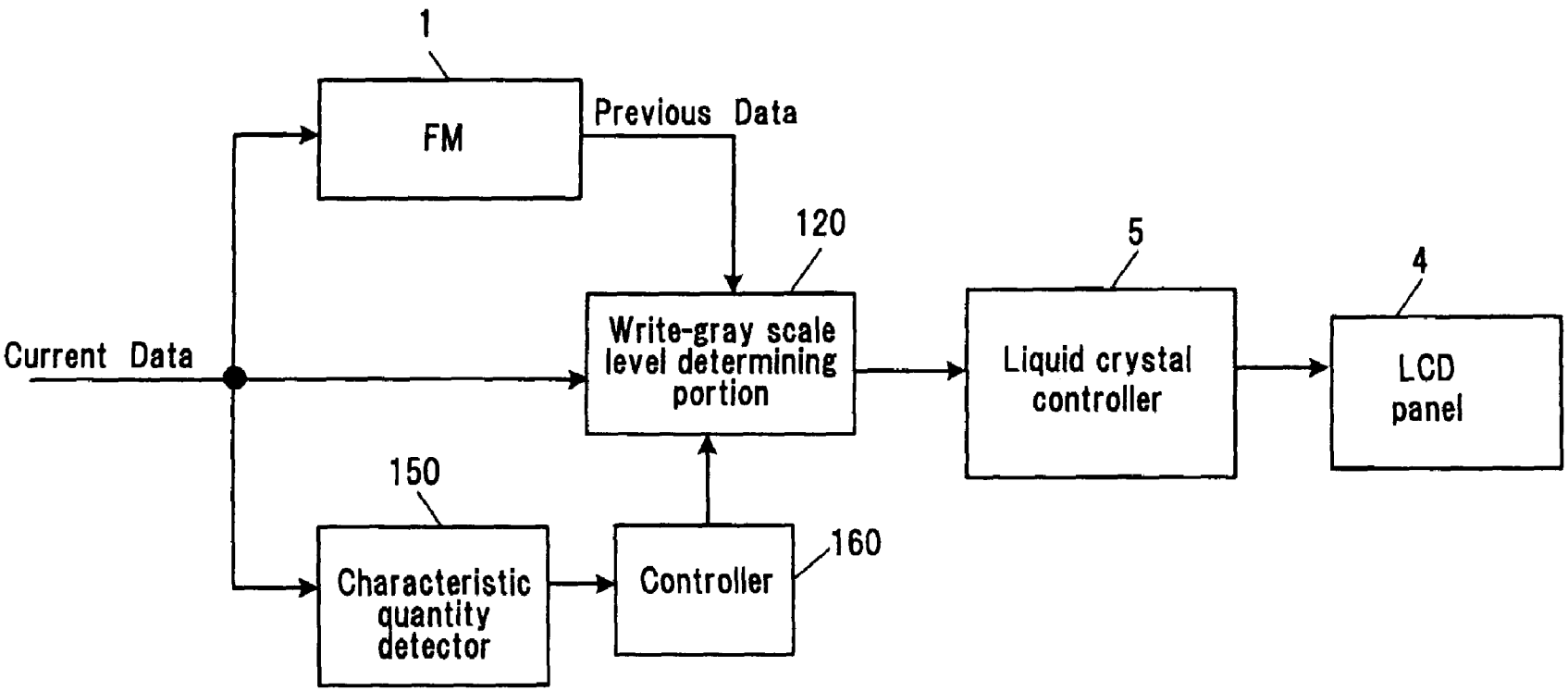
FIG. 22 is a block diagram showing a schematic configuration of exemplary components in the sixth embodiment of a liquid crystal display of the present invention.

FIG. 22 is a block diagram showing the sixth embodiment of a liquid crystal display according to the present invention.

The liquid crystal display of FIG. 22 includes a frame memory (FM) 1, a write-gray scale level determining portion 120, a liquid crystal display panel 4, a liquid crystal controller 5, a characteristic quantity detector 150 and a controller 160.

First, characteristic quantity detector 150 detects a characteristic quantity of the input image data (Current data). The characteristic quantity herein is defined as an index representing the cause of adverse effects (image degradation) such as white spots, flickering etc., which occur when liquid crystal display panel 4 is driven using the emphasis-converted data determined for compensating the optical response characteristic (response speed) of liquid crystal display panel 4. For example, the characteristic quantity is the quantity that is of high frequency components higher than a fixed value, indicating noise overlapped portions, edges of characters, contours etc., and contour enhancement corrected portions, or block noise and mosquito noise portions due to video compression processing.

If a picture area where this characteristic quantity is detected is just subjected to the normal OS drive process (emphasis process) in write-gray scale level determining portion 120, the noise component is enhanced and the image quality degrades. To avoid this, controller 160 controls write-gray scale level determining portion 120 so as to limit the amount of OS drive for the area where the characteristic quantity has been detected, or stop OS drive and output the input image data straight through.

Thus, the write-gray scale level data for liquid crystal display panel 4 is determined in such a manner that OS drive is adjusted to inhibit its strength for the areas where the characteristic quantity has been detected from the input image data while the normal OS drive is done for the other areas. Since liquid crystal display panel 4 is driven by liquid crystal controller 5 based on this write-gray scale level data, it is possible to realize high quality image display with correct reproduction of half gray scales while reducing adverse effects of OS drive due to noise etc. to as low as possible. It should be added that this OS drive control is implemented in display data units (for every pixel).

EXAMPLE 1

Figure 23:
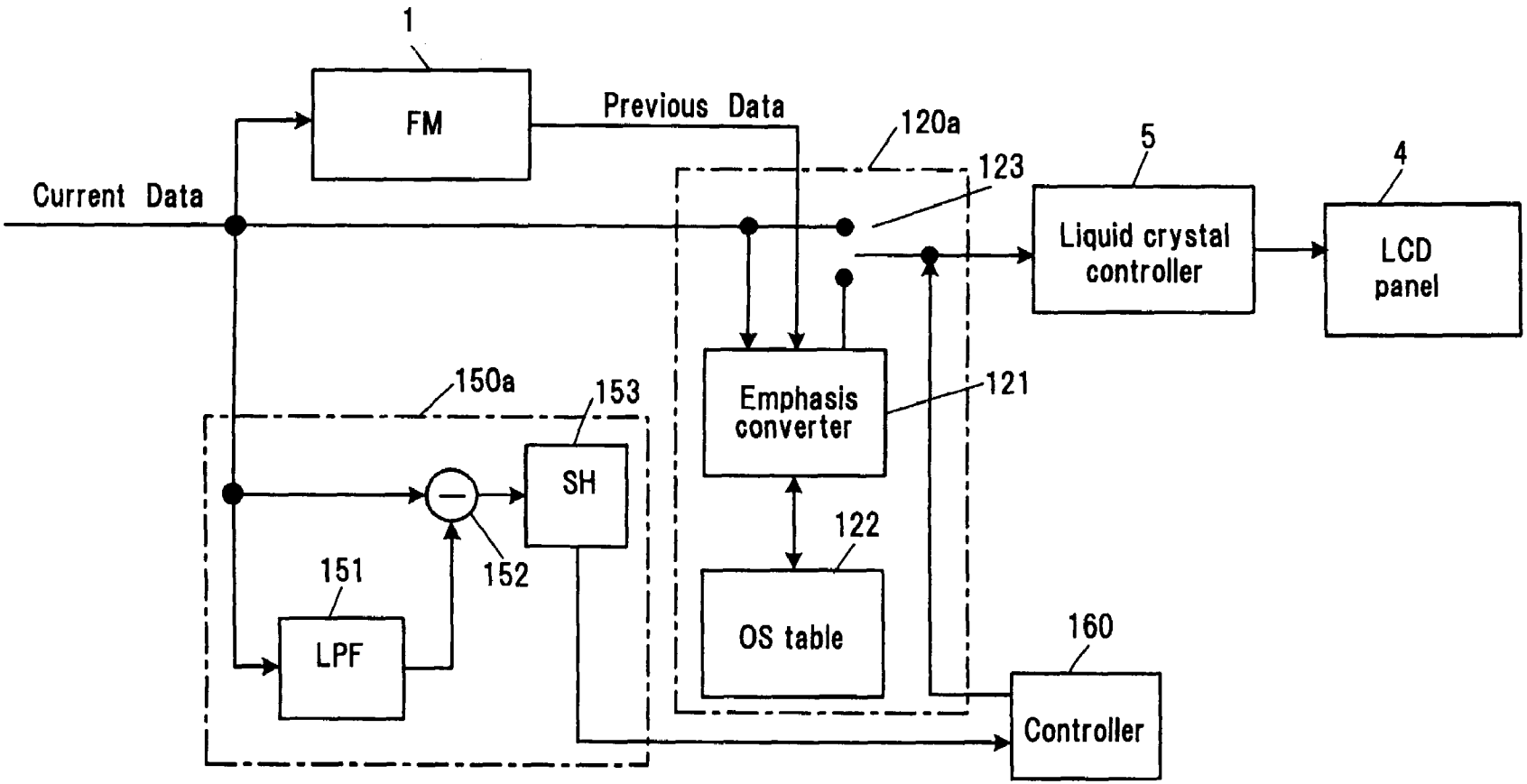
FIG. 23 is a block diagram showing example 1 of a liquid crystal display in the sixth embodiment.

FIG. 23 is a block diagram showing example 1 of a liquid crystal display in this embodiment. In FIG. 23, a characteristic quantity detector 150*a* is composed of a low-pass filter (LPF) 151, a subtracter 152 and a threshold portion 153. A write-gray scale level determining portion 120*a* is composed of an emphasis converter 121, an OS table memory 122 and a switch 123.

The input image data (Current Data) is input to characteristic quantity detector 150*a*, where low frequency components only are extracted by LPF 151. The low frequency components are subtracted from the input image data by subtracter 152 so as to obtain high frequency components. Then, high frequency components exceeding the predetermined threshold are extracted as the characteristic quantity of the input image, by threshold portion 153.

Emphasis converter 121 of write-gray scale level determining portion 120*a* compares the N-th frame input image data (Current Data) and the (N−1)-th frame image data (Previous Data) stored in frame memory 1 to determine the gray scale level transition patterns between both pieces of data. Then, based on the gray scale level transition patterns and the N-th frame input image data, the write-gray scale level determining portion determines the write-gray scale level data (emphasis-converted data) needed for image display of the N-th frame by reference to the emphasis conversion parameters stored in OS table memory 122.

Controller 160 controls switch 123 so that the input image data is directly sent to liquid crystal controller 5 for the portions of image data where a high frequency component exceeding the threshold has been detected by characteristic quantity detector 150*a*. For the portions of image data where no high frequency components exceeding the threshold has been detected, switch 123 is controlled so that the emphasis-converted data generated by emphasis converter 121 is sent to liquid crystal controller 5.

In this way, for a portion of the input image data in which a high frequency component exceeding the threshold has been detected, liquid crystal display panel 4 is driven by the input image data that is directly output without being processed through emphasis conversion to liquid crystal controller 5, whereby it is possible to realize high quality image display by reducing the adverse effects from OS drive such as white spots, flickering, etc., due to excessive noise enhancement or the like, to as low as possible.

Also, for a portion of the input image data in which no high frequency component exceeding the threshold has been detected, the normal OS drive is implemented by outputting the emphasis-converted data generated from the input image data to liquid crystal controller 5 as the write-gray scale level data, whereby it is possible to display correct half gray scales by compensating the optical response characteristic (speed) of liquid crystal display panel 4.

EXAMPLE 2

Figure 24:
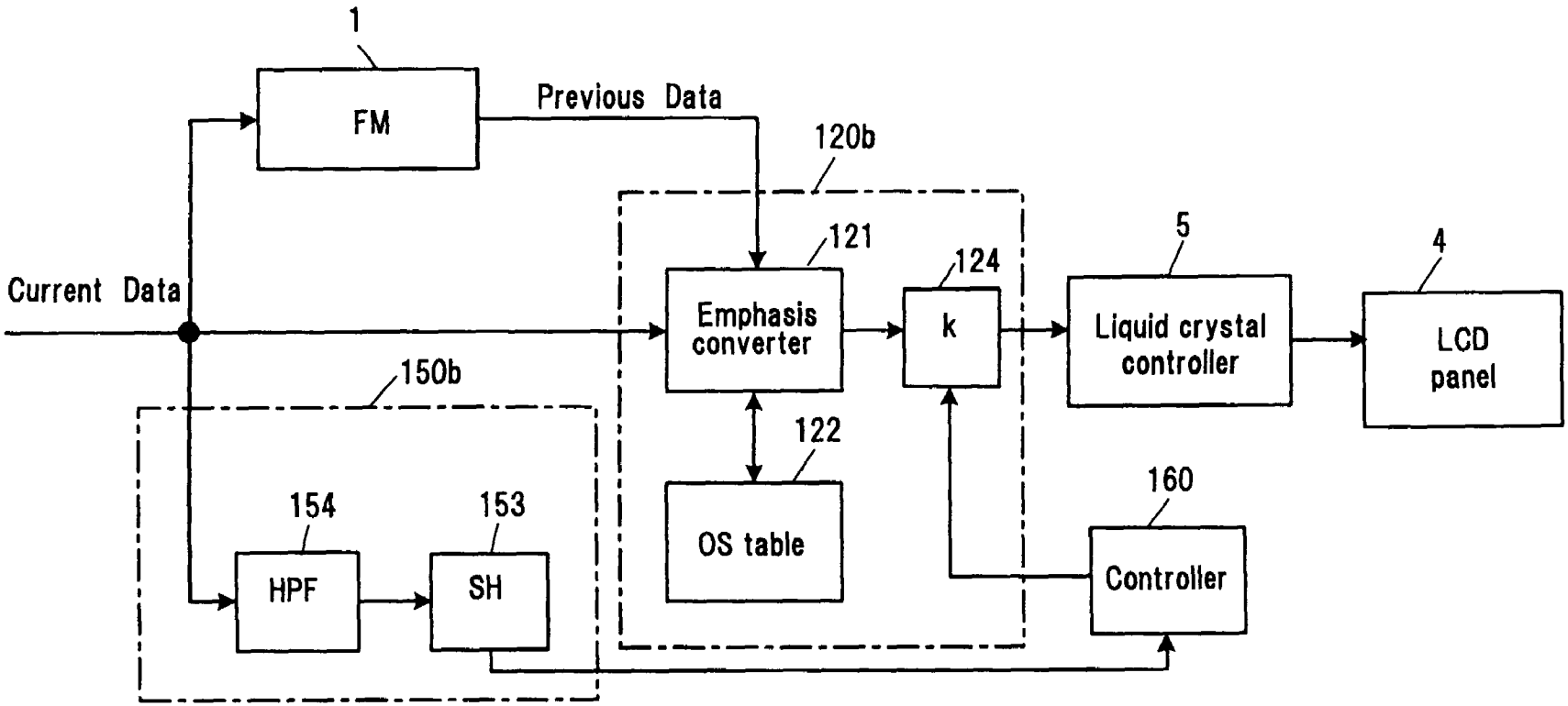
FIG. 24 is a block diagram showing example 2 of a liquid crystal display in the sixth embodiment.

FIG. 24 is a block diagram showing example 2 of a liquid crystal display in the embodiment of the present invention. This liquid crystal display has almost the same configuration as that in FIG. 23, except write-gray scale level determining portion 120*b* and characteristic quantity detector 150*b*. Here, the same components as those in FIG. 23 are allotted with the same reference numerals and description for those is omitted.

The write-gray scale level determining portion 120*b* of this example has a multiplier 124 for multiplying the emphasis-converted data calculated by emphasis converter 121 by a coefficient k (0<k<1), instead of the switch 123 in FIG. 23. The value of coefficient k used in this multiplier 124 is variably controlled by controller 160, so that the emphasis-converted data determined by emphasis converter 121 can be cut down by a predetermined amount and sent out to liquid crystal controller 5.

Characteristic quantity detector 150*b* is composed of a high-pass filter (HPF) 154 and a threshold portion 153. HPF 154 has both the function of the LPF151 and subtracter 152 in FIG. 23 and extracts high frequency components contained in the input image data.

Controller 160 controls the coefficient k in a variable manner such that k is set at a small value for the portions of the input image data where a high frequency component exceeding the threshold has been detected by characteristic quantity detector 150*b* while k is set at "1" for the portions of the input image data where no high frequency component exceeding the threshold has been detected.

In multiplier 124, the emphasis-converted data output from emphasis converter 121 is multiplied by the coefficient k which has been adjusted in accordance with the high frequency components contained in the input image data, and the result is output as the write-gray scale level data to liquid crystal controller 5. Therefore, the picture portions in which high frequency components have been detected can be reduced in emphasis-converted data level, so that it is possible to realize high quality image display by reducing adverse effects such as white spots, flickering and the like due to excessive enhancement of noise etc.

Here, controller 160 varies the value of coefficient k stepwise in accordance with the amount (level) of the high frequency components detected by characteristic quantity detector 150*b*. That is, since the greater the amount of high frequency components (for example, the higher the level of noise) the more the image quality degrades because of excessive enhancement of the high frequency components, the value of coefficient k is set to be smaller so that the level of OS drive (write-gray scale level data) will be lowered.

In this way, since the level of OS drive is suppressed for the high frequency components such as noise and the like that would cause image degradation while the level of OS drive in other portions is normally output to liquid crystal controller 5 so as to drive liquid crystal display panel 4, it is possible to realize high quality image display with correct reproduction of half gray scales while reducing harmful effects from OS drive such as white spots, flickering and the like due to excessive enhancement of noise etc., to as low as possible.

EXAMPLE 3

Figure 25:
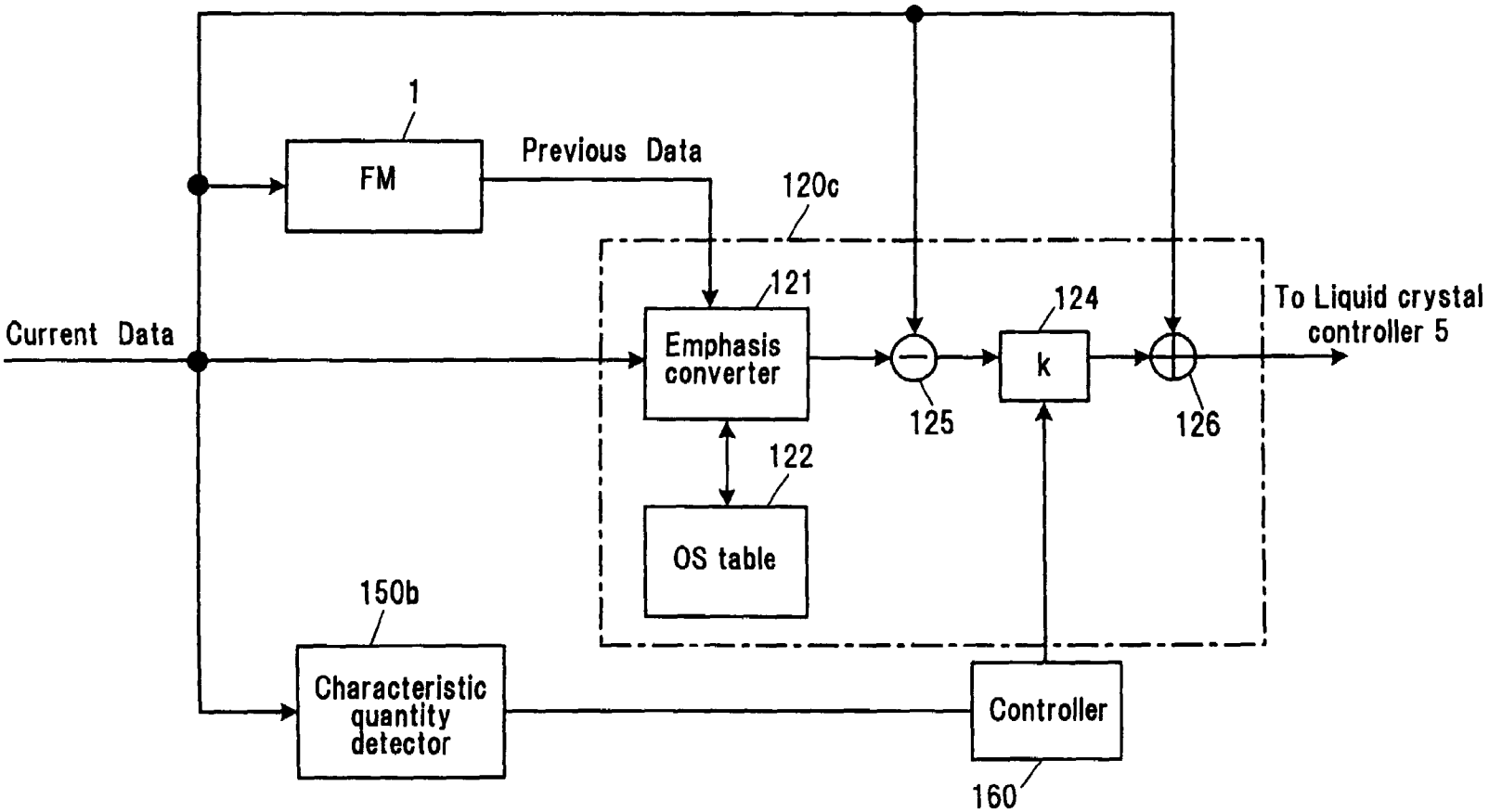
FIG. 25 is a block diagram showing example 3 of a liquid crystal display in the sixth embodiment.

FIG. 25 is a block diagram showing example 3 of a liquid crystal display in the embodiment of the present invention. This liquid crystal display differs from the above-described examples 1 and 2 in write-gray scale level determining portion 2*c*. Here, the same components as those in FIG. 24 are allotted with the same reference numerals and description for those is omitted.

As shown in FIG. 25 write-gray scale level determining portion 120*c* of this example includes: a subtracter 125 for subtracting the input image data from the emphasis-converted data calculated by emphasis converter 121; a multiplier 124 for multiplying the output signal from this subtracter 125 by coefficient k (0<k<1); and an adder 126 for adding the output signal from this multiplier 124 to the input image data and outputting the sum to liquid crystal controller 5.

A controller 160 controls the coefficient k in a variable manner such that k is set at "0" for the portions of the input image data where a high frequency component exceeding the threshold has been detected by characteristic quantity detector 150*b* while k is set at "1" for the portions of the input image data where no high frequency component exceeding the threshold has been detected.

Accordingly, since, for the portions of the input image data where a high frequency component exceeding the threshold has been detected, the input image data is not emphasis-converted (i.e., the emphasis-converted data is cut down) and is output to liquid crystal controller 5 while, for the portions where no high frequency component exceeding the threshold has been detected, the normally emphasis-converted data is output to liquid crystal controller 5, it is possible to realize high quality image display with correct reproduction of half gray scales while reducing adverse effects from OS drive such as white spots, flickering and the like due to excessive enhancement of noise etc., to as low as possible.

Here, controller 160 is also able to vary the value of coefficient k stepwise in accordance with the amount (level) of the high frequency components detected by characteristic quantity detector 150*b*. That is, if the input image presents a poor S/N and contains a great amount of high frequency components (meaning that it contains a high level of noise), the image quality is degraded more by excessive enhancement of the high frequency components. Therefore, the value of coefficient k can be adjusted so that the level of OS drive (write-gray scale level data) will be lowered.

EXAMPLE 4

Figure 26:
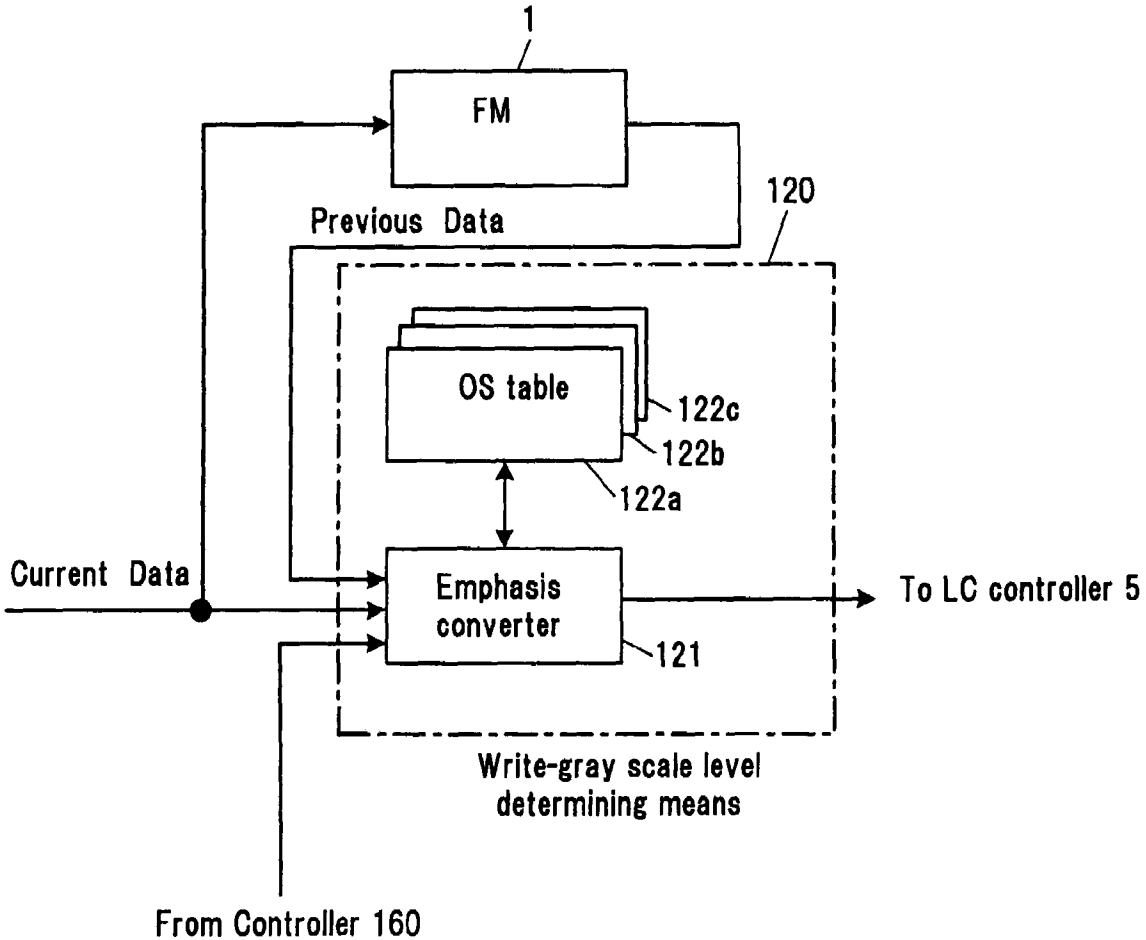
FIG. 26 is a block diagram showing example 4 of a liquid crystal display in the sixth embodiment.

FIG. 26 is a block diagram showing example 4 of a liquid crystal display in the embodiment of the present invention. This liquid crystal display differs from the above-described examples 1 to 3 in write-gray scale level determining portion 2*d*. Here, the same components as those in FIG. 23 are allotted with the same reference numerals and description for those is omitted.

An OS table memory (ROM) 122 holds plural OS table memories each holding a different set of conversion parameters, in accordance with the amount (level) of high frequency components detected by a characteristic quantity detector 150, or the S/N ratio of the input image. An emphasis converter 121, based on the amount (level) of the high frequency components detected by characteristic quantity detector 150, selects as appropriate one from the above OS table memories.

Here, to make the description simple, in the present embodiment three kinds of ROMs are provided as OS table memory (ROM) 122, namely, OS table memory 122*a* (see FIG. 27) holding high level emphasis conversion parameters, OS table memory 122*b* (see FIG. 28) holding low level emphasis conversion parameters and non-conversion table memory 122*c* (see FIG. 29) holding non-conversion parameters. Emphasis converter 121 refers to one of OS table memories 122*a* to 122*c* based on the control signal from a controller 160 and determines the write-gray scale level data to be supplied to liquid crystal display panel 4.

Though, in those shown in FIGS. 26 to 29, the emphasis conversion parameters (actual measurements) are stored in a 9×9 matrix of representative gray scale level transition patterns every 32 gray scale levels when the number of display signal levels, i.e., the amount of display data is constituted of 8 bits or 256 gray scales, obviously the present invention should not be limited to this.

Further, though description will be made of the case where overshoot drive is implemented by selectively referring to one of three kinds of OS table memories, it goes without saying that four or more kinds of OS table memories (ROMs) may be provided.

To begin with, two thresholds (the first threshold<the second threshold) are set up as the standards based on which controller 160 selects the OS table memory in accordance with the amount (level) of high frequency components detected by characteristic quantity detector 150.

OS table memory 122*a* is selected when the amount (level) of high frequency components detected by characteristic quantity detector 150 is lower than the first threshold, in other words, when noise has not been detected and normal OS drive is implemented. OS table memory 122*b* is selected when the amount (level) of high frequency components detected by characteristic quantity detector 150 is higher than the first threshold and lower than the second threshold, in other words, when some noise has been detected and the level of OS drive needs to be suppressed. OS table memory 122*c* is selected when the amount (level) of high frequency components detected by characteristic quantity detector 150 is higher than the second threshold, in other words, when much noise has been detected and no OS drive is implemented.

That is, controller 160 compares the amount (level) of high frequency components detected by characteristic quantity detector 150 to the first and second thresholds so as to determine the level the detected value falls in, and sends out to emphasis converter 121 a control signal that selects ROM 122*a* if this level is lower the first threshold, ROM 122*b* if the level is between the first and second thresholds and ROM 122*c* if the level is above the second threshold. Emphasis converter 121 determines the write-gray scale level data to be supplied to liquid crystal display panel 4 by referring to one of OS table memories 122*a* to 122*c*, based on the control signal from controller 160.

Thus, liquid crystal display panel 4 is driven based on the selection from OS table memories 122*a* to 122*c*, that is, by controlling the level of OS drive to be supplied to liquid crystal controller 5 in such a manner that the level of OS drive is cut down for the portions of high frequency components where the image quality would lower due to noise etc., and no OS drive is effected for the portions of high frequency components where the image quality would markedly lower due to noise etc., while normal level of OS drive is effected for the other portions. Therefore, it is possible to realize high quality image display with correct reproduction of half gray scales while reducing adverse effects from OS drive such as white spots, flickering and the like due to excessive enhancement of noise etc., to as low as possible.

Here, the tables in the OS table memories (ROMs) 122*a* to 122*c* may be stored in a single memory. Illustratively, the high level emphasis conversion parameters, the low level emphasis conversion parameters and the non-conversion parameters may be stored in respective table areas (LEVEL0 to LEVEL2), as shown in FIG. 30, and based on the amount (level) of high frequency components detected by characteristic quantity detector 150, reference may be selectively switched between the reference table areas (LEVEL0 and LEVEL1) in which the emphasis conversion parameters are stored and the table area (LEVEL2) for the non-conversion parameters.

In sum, the necessary parameter can be selectively read out from the emphasis conversion parameters and non-conversion parameters, by selecting one of the table areas (LEVEL0 to LEVEL2) to be referred to based on the control signal from controller 160 and referring to the address in each table area (LEVEL0 to LEVEL2), in accordance with the gray scale level transition from one frame to the next.

In this way, it is possible to obtain the same effect as that when OS table memories (ROMs) 122*a* to 122*c* are used.

EXAMPLE 5

Figure 31:
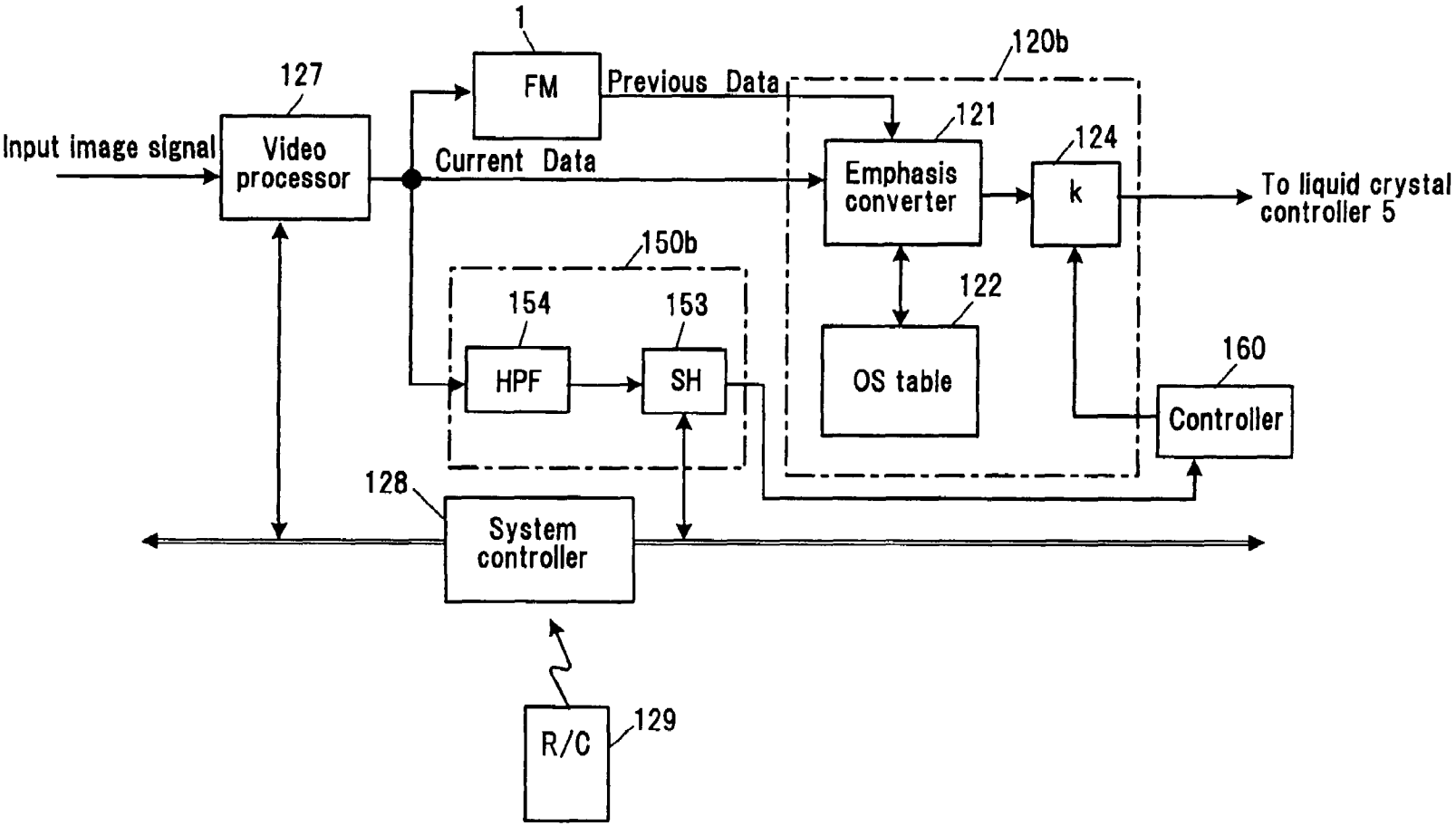
FIG. 31 is a block diagram showing example 5 of a liquid crystal display in the sixth embodiment.

FIG. 31 is a block diagram showing example 5 of a liquid crystal display in the embodiment of the present invention. This liquid crystal display has the same configuration as that shown in FIG. 24, further including a video processor 127 for making various video adjustments for the input image signal; a system controller 128; and a remote controller (R/C) 129. Here, the same components as those in FIG. 24 are allotted with the same reference numerals and description for those is omitted.

The user is able to command a video adjustment such as contour enhancement correction and the like by R/C 129. System controller 128, based on the video adjustment command from the user, gives the order of the video adjustment for the input image data to video processor 127. For example, in accordance with the user's command for contour enhancement correction, video processor 127 extracts contours from the input image data and performs the enhancement process.

At the same time, system controller 128 sends out the content of the video adjustment command from the user to a threshold portion 153 and controller 160. Based on the command content, threshold portion 153 controls or varies the thresholds for detecting the characteristic quantity that represents the possible occurrence of image degradation due to OS drive.

In this way the threshold of threshold portion 153 can be varied in accordance with the content of the video adjustment command from the user, so that it is possible to detect the suitable characteristic quantity in conformity with the video adjustment commanded by the user. For example, when the user gave a command of contour enhancement correction, it is possible to realize high quality image display by preventing occurrence of adverse effects due to OS drive such as white spots, flickering and the like around the contour enhanced areas.

The video adjustment herein should not be limited to contour enhancement correction. It is obvious that reduction control of the level of OS drive or stopping OS drive (to directly output the input image data) is effective in order to remove the adverse effects from OS drive, which are entailed with the adjustment as to the video frequency characteristic or gray scale level characteristic (dynamic range)

EXAMPLE 6

Figure 32:
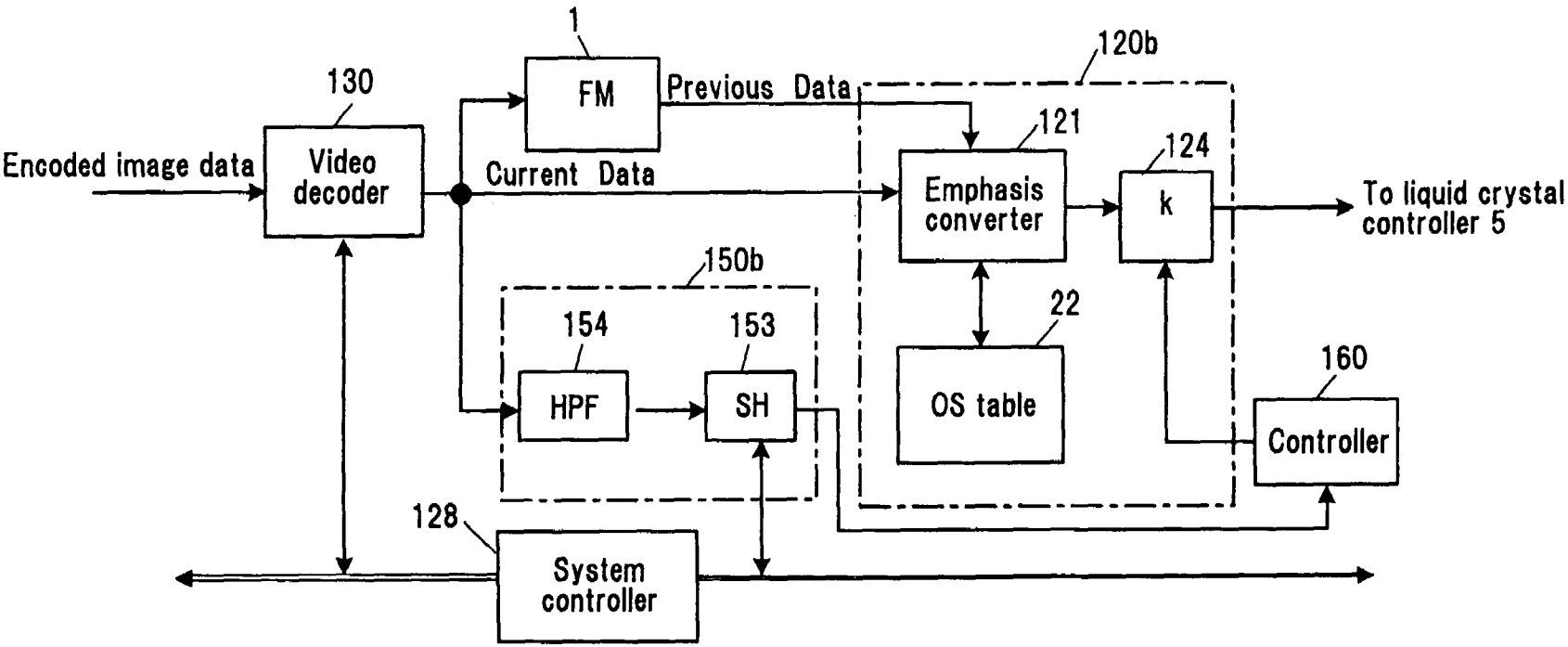
FIG. 32 is a block diagram showing example 6 of a liquid crystal display in the sixth embodiment.

FIG. 32 is a block diagram showing example 6 of a liquid crystal display in the embodiment of the present invention. This liquid crystal display has the same configuration as that shown in FIG. 24, further including a video decoder 130 for decoding image encoded data and a system controller 128. Here, the same components as those in FIG. 24 are allotted with the same reference numerals and description for those is omitted.

In video decoder 130 the input image encoded data is decoded and the encoding parameters (quantization step size, bit rate etc.) contained in the image encoded data are extracted and transferred to system controller 128. System controller 128, in accordance with the encoding parameters, controls and varies the thresholds of threshold portion 153, so as to be able to positively detect encoding noise (block noise, mosquito noise).

Illustratively, since block noise and mosquito noise are liable to take place when, for example, the quantization step size for image encoded data is large, the thresholds at threshold portion 153 are set to be smaller so as to reliably detect these noises. For the portions where occurrence of block noise or mosquito noise is detected, the level of OS drive is lowered or OS drive is stopped so as to inhibit excessive emphasis of these noises, whereby it is possible to output suitable write-gray scale level data to liquid crystal controller 5.

Thus, it is possible to realize high quality image display by inhibiting adverse effects in OS drive due to block noise and mosquito noise while achieving compensation of OS drive for the optical response characteristic (response speed) of liquid crystal display panel 4.

In the present embodiment, it is possible to provide a configuration in which the thresholds at threshold portion 153 can be controlled to vary by making use of the information as to the transfer (bandwidth) characteristics of the post-filter used in video decoder 130 in addition to the aforementioned encoding parameters.

EXAMPLE 7

Figure 33:
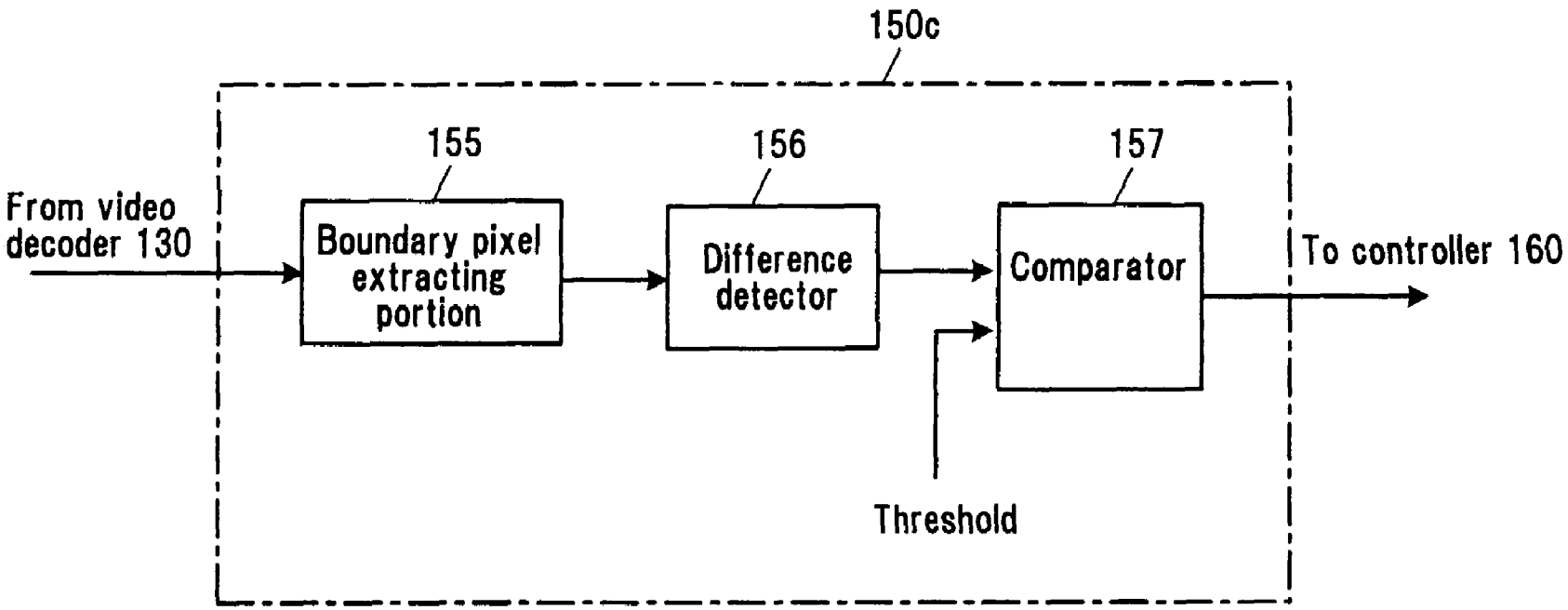
FIG. 33 is a block diagram showing example 7 of a liquid crystal display in the sixth embodiment.

FIG. 33 is a block diagram showing example 7 of a liquid crystal display in the embodiment of the present invention. This liquid crystal display, on the basis of the configuration of example 6 described above with reference to FIG. 32, includes as a characteristic quantity detector 150*c*, a block noise detector for detecting block distortion which will appear in flat areas of the decoded image when the image coded data which in particular has been compression coded by MPEG or the like is input and decoded to implement image display.

Characteristic quantity detector 150*c* of this example is composed of, as shown in FIG. 33, a boundary pixel extracting portion 155 for extracting the pixel values of a predetermined number of pixels at the block boundaries based on the predetermined block pattern (the pattern of encoding units or MxN blocks into which the image frame is divided) which is determined by the encoding scheme, a difference detector 156 for detecting difference between the pixel values that are extracted by the boundary pixel extracting portion 155, and a comparator 157 for comparing the differential data detected by the difference detector 156 with a predetermined threshold.

Specifically, when the differential data between plural pixels at the block boundary is greater than the threshold, a comparator 157 determines that the block noise is taking place and notifies a controller 160 of this fact. Controller 160 controls a write-gray scale level determining portion 120*b* for the input image data areas where block noise has been detected by characteristic quantity detector 150*c* so that it outputs the input image data to liquid crystal controller 5 instead of the emphasis-converted data, or it outputs the reduced level of the emphasis-converted data to liquid crystal controller 5. Thereby it is possible to realize high quality image display preventing occurrence of image degradation due to excessive enhancement of block noise.

Here, in the present example, and also similarly to the above example 6, the threshold used at comparator 157 is adapted to be arbitrary variable in accordance with the encoding parameters such as the quantization step size of the image encoded data, whereby it is possible to detect block noise occurring in the decoded image in a more reliable manner. It is also possible to provide a configuration in which the threshold at a threshold portion 153 can be controlled to vary by making use of the information as to the transfer (bandwidth) characteristics of the post-filter used in a video decoder 130.

It should be noted that the present invention is not limited by the above embodiments and various modifications can be added without departing from the spirit and scope of the present invention. For example, it is possible to provide a configuration in which various factors that cause adverse effects from OS drive are detected as the characteristic quantities of the input image data. Obviously it is possible to provide a configuration in which OS drive is controlled by an appropriate combination of the above-described examples 1 through 7.

THE SEVENTH EMBODIMENT

Figure 34:
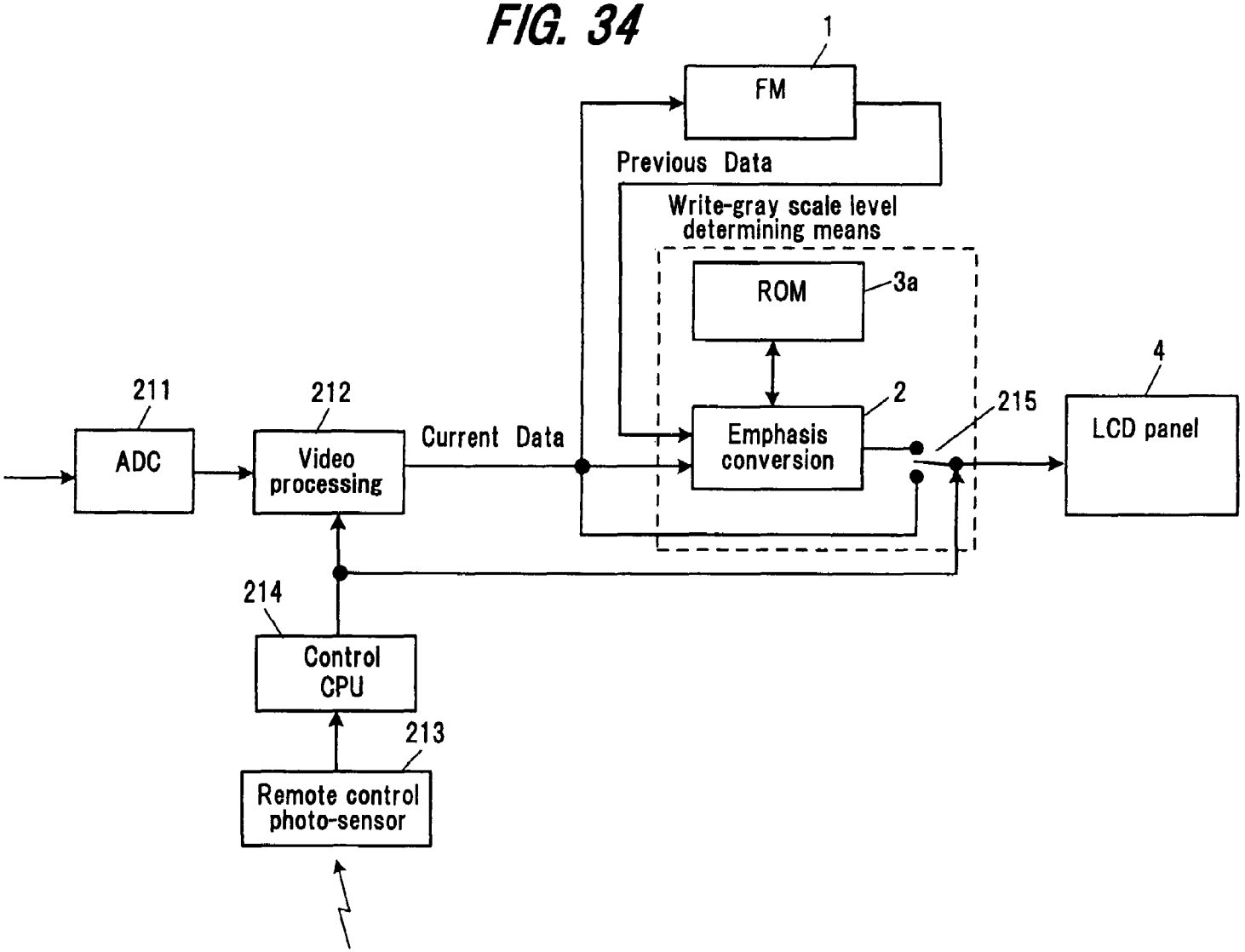
FIG. 34 is a block diagram showing a schematic configuration of exemplary components in the seventh embodiment of a liquid crystal display of the present invention.
Figure 36:
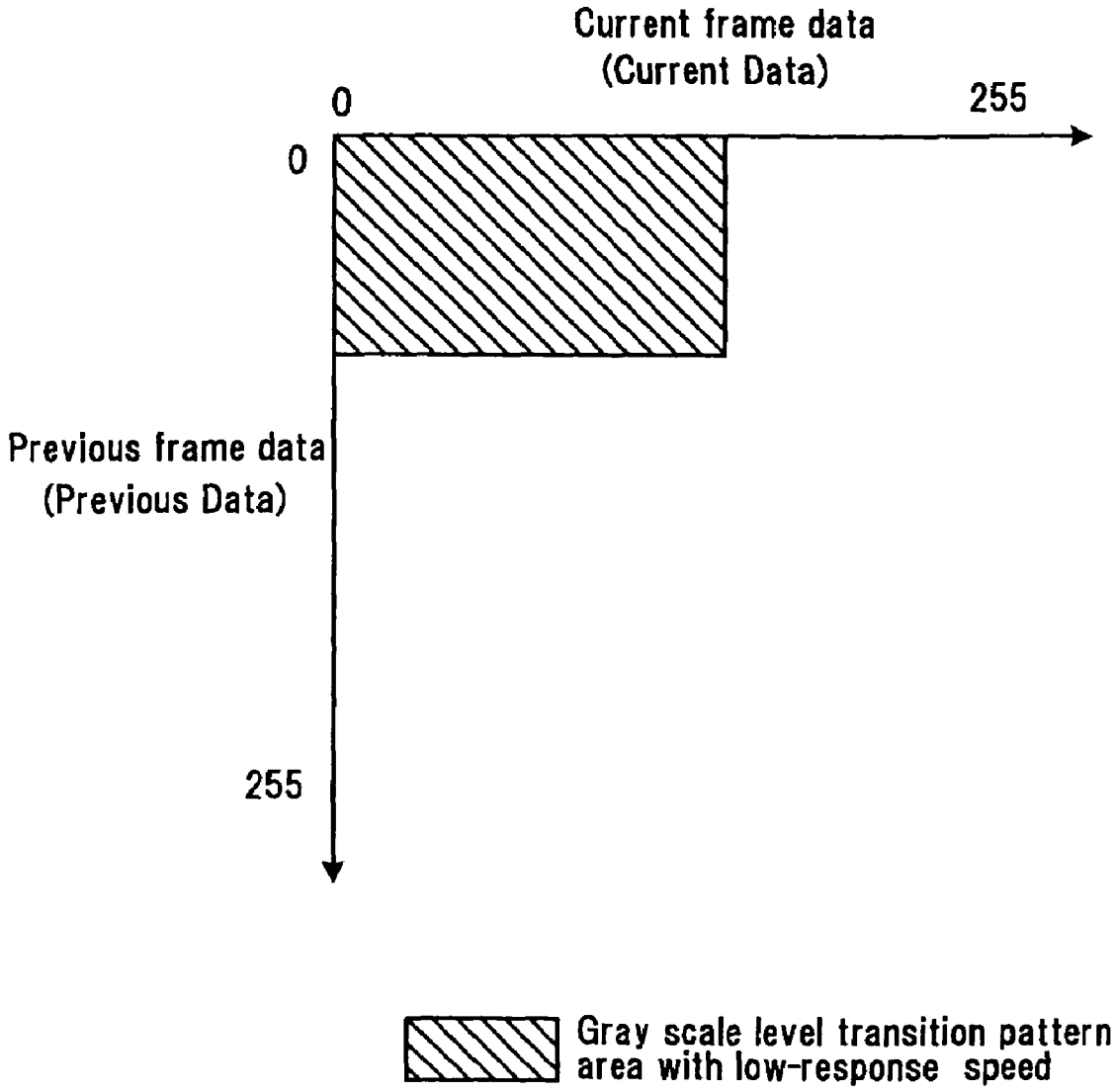
FIG. 36 is a schematic illustrative view showing the optical response characteristic of a liquid crystal display panel for use in the seventh embodiment.

Next, the seventh embodiment of the present invention will be described in detail with reference to FIGS. 34 to 39. The same components as those in FIG. 1 are allotted with the same reference numerals and description for those is omitted. Here, FIG. 34 is a block diagram showing a schematic configuration of a liquid crystal display of the present embodiment; FIG. 35 is a schematic illustration showing the table content of an OS table memory for use in the liquid crystal display of this embodiment; and FIG. 36 is a schematic illustrative view showing the optical response characteristic of a liquid crystal display panel for use in the liquid crystal display of this embodiment.

Figure 37:
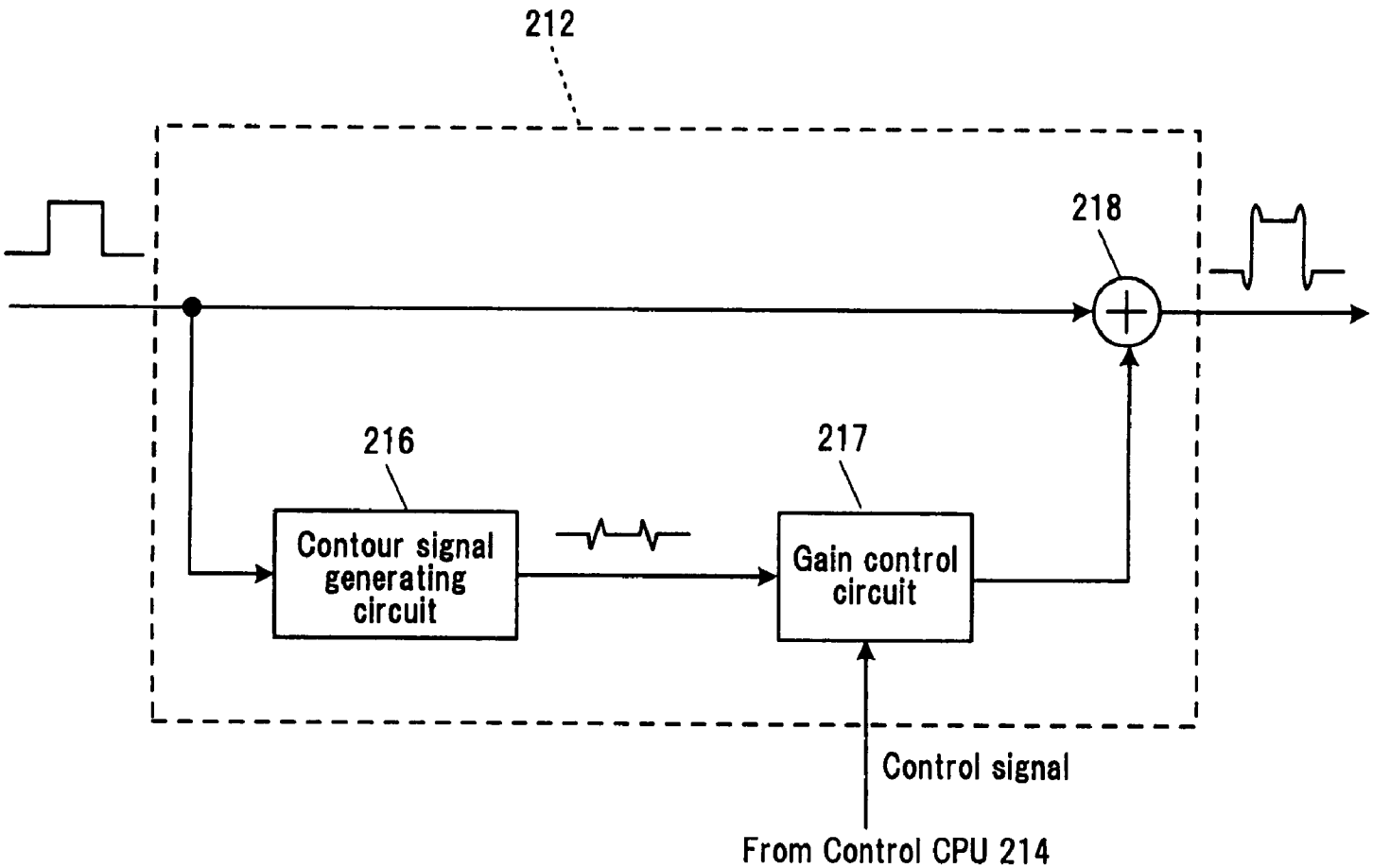
FIG. 37 is a block diagram showing one example of a video processor (contour enhancement correcting circuit) in the seventh embodiment.
Figure 38:
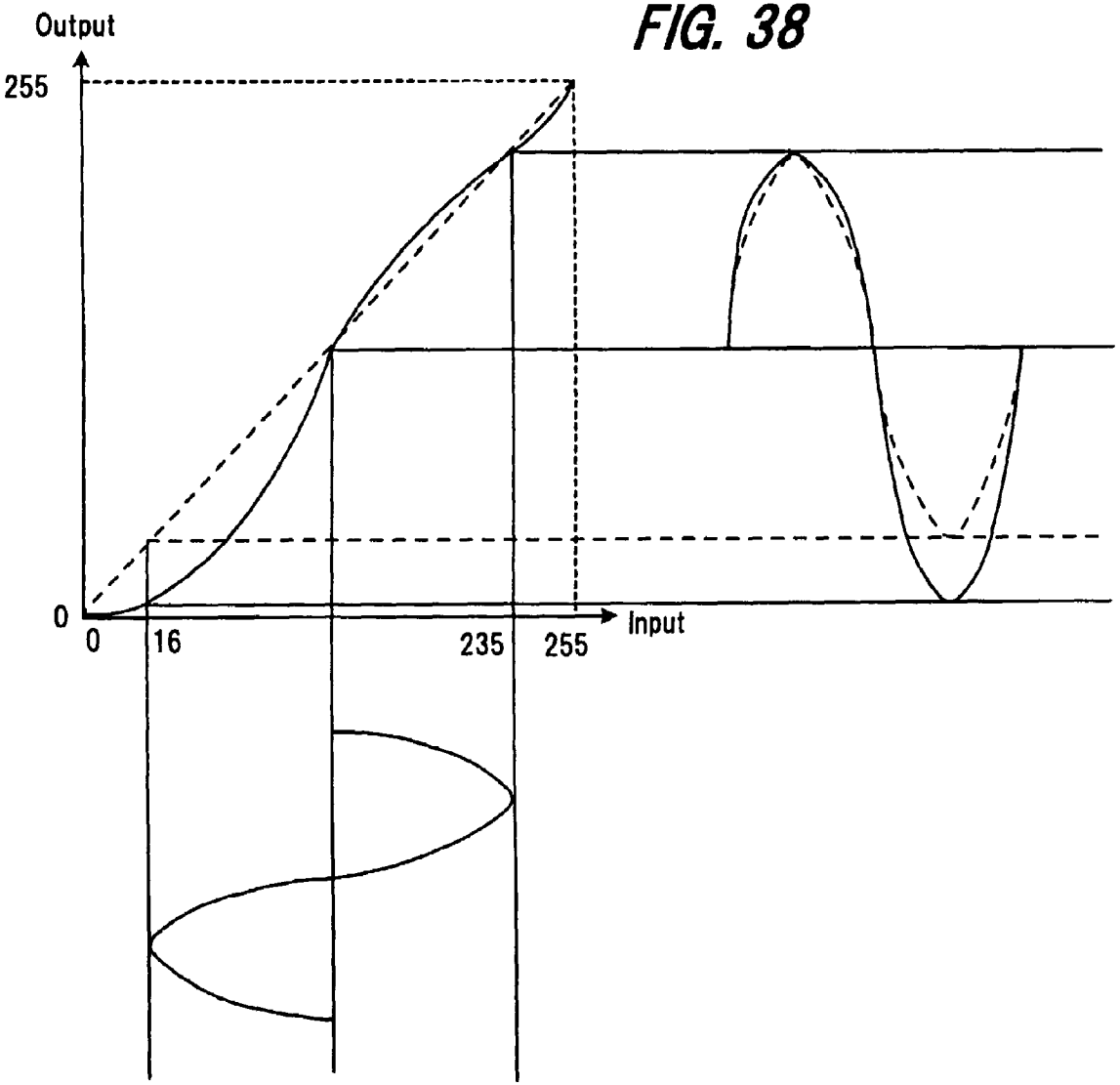
FIG. 38 is an illustrative chart showing another video processor example (gray scale level correction characteristic) in the seventh embodiment.
Figure 39:
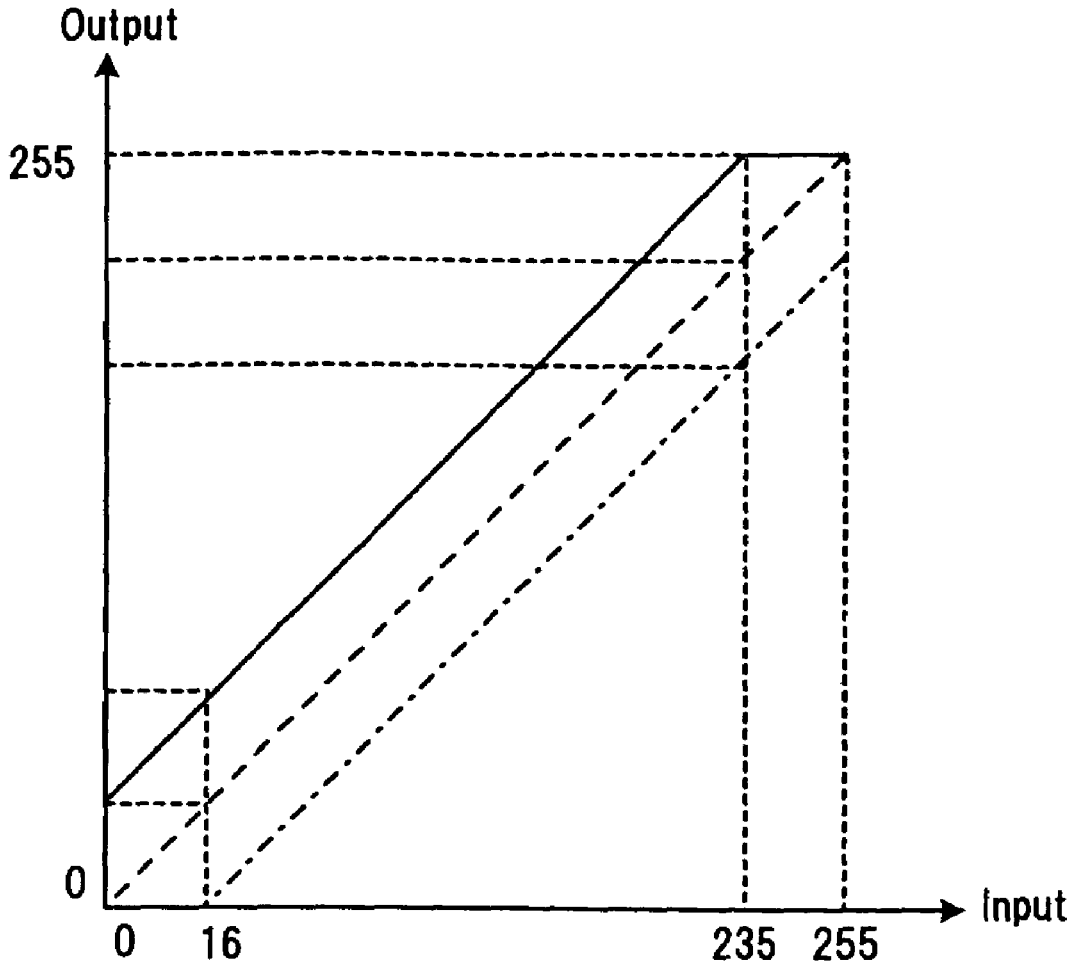
FIG. 39 is an illustrative chart showing still another video processor example (gray scale level correction characteristic) in the seventh embodiment.

FIG. 37 is a block diagram showing one example of a video processor (contour enhancement correction circuit) in the liquid crystal display of this embodiment; FIG. 38 is an illustrative chart showing another example of a video processor (gray scale level correction characteristic) in the liquid crystal display of this embodiment; and FIG. 39 is an illustrative chart showing still another example of a video processor (gray scale level correction characteristic) in the liquid crystal display of this embodiment.

As shown in FIG. 34, the liquid crystal display of the present embodiment includes: an A/D converter 211 for converting the input image data into digital signals; a video processor 212 for subjecting the A/D converted input image data to predetermined video adjustment processes; a remote control photo-sensor 213 for receiving a command signal input by the user through an unillustrated remote control transmitter (remote controller); and a control CPU 214 for controlling each processor by analyzing the command signal received by remote control photo-sensor 213. That is, the user is able to create favorite image rendering by giving a command for a desired video adjustment by means of a remote controller so as to cause control CPU 214 to control video processor 212.

A write-gray scale level determining means includes: an emphasis converter 2 which receives the previous frame image data (Previous Data) stored in a frame memory 1 and the current frame input image data (Current Data), reads out corresponding emphasis conversion parameters from OS table memory (ROM) 3*a* based on the combination of the input data (gray scale level transitions) and determines the emphasis-converted data for the input image data of the current frame so as to compensate the optical response characteristic of liquid crystal display panel 4; and a selector switch 215 for achieving selective switching between the emphasis-converted data and the input image data in frame units, in accordance with the user's video adjustment command, and outputting the selected one as the display image data to liquid crystal display panel 4.

Here, though, as shown in FIG. 35, the emphasis conversion parameters (actual measurements) are stored in a 9×9 matrix of representative gray scale level transition patterns every 32 gray scale levels when the number of display signal levels, i.e., the amount of display data is constituted of 8 bits or 256 gray scales, obviously the present invention should not be limited to this.

For simplicity, description hereinbelow will be described on the assumption that the liquid crystal display panel 4 used in this embodiment is one that operates in the normally black mode having such an optical response characteristic that a transition from black or a low gray scale level to an intermediate gray scale level, in particular, takes a longer time, as shown in FIG. 36. However, it is obvious that the present invention can be applied to liquid crystal display panels of various optical response characteristics, not being limited to the aforementioned characteristic.

Next, specific examples of video processor 212 in this embodiment and the OS drive control scheme in each example will be described in detail.

(1) Contour Enhancement Correction Circuit

This circuit is to emphasize contours in the reproduced picture so as to increase sharpness by adding preshoot and overshoot at leading and trailing edges of the image signal, and is composed of, as shown in FIG. 37 for example, a contour signal generating circuit 216 for generating a contour signal at an edge, a gain control circuit 217 for controlling the strength of contour enhancement by adjustment of the amplitude of the contour signal, and an adder 218 for adding the contour signal adjusted as to the amplitude to the original image signal.

Here, receiving a video adjustment command from the user, control CPU 214 outputs a control signal to gain control circuit 217 which controls the amplitude of the contour signal, whereby the strength of contour enhancement can be adjusted by varying the amount of preshoot and the amount of overshoot to be added to the edge. In other words, the user is able to adjust the frequency characteristics of the input image data by video adjustment and implement favorite contour enhancement correction to obtain a sharp and clear displayed image.

When the user adjusts the strength of contour enhancement so as to increase the amount of preshoot and the amount of overshoot to be added to edges, these preshoot and overshoot areas (contour enhanced areas) are further excessively emphasized by emphasis converter 2, thus produces whitened spots of pixels, unnatural hues, flickering and the like, causing image degradation of the displayed image.

To deal with this, in the present embodiment, when a command of contour enhancement exceeding a predetermined level is given from the user, control CPU 214 detects this and controls a selector switch 215 so that the input image data will be output straight through as the display image data to liquid crystal display panel 4. That is, selector switch 215 is controlled to switch in accordance with the content of the command for contour enhancement correction given by the user, whereby either the emphasis-converted data from emphasis converter 2 or the input image data is selectively supplied as the display image data to liquid crystal display panel 4.

As described above, when the user gives a command for increasing the strength of contour enhancement, OS drive is turned off (stopped) in response with this so that the input image data is directly output as the display image data to liquid crystal display panel 4. Thereby, it is possible to realize high quality image display by inhibiting occurrence of whitened spots of pixels, unnatural hues, flickering and the like, due to excessive emphasis of contour enhanced areas.

(2) Black Extension Correcting Circuit

This function is to extend the low gray scale level side of the image signal to improve the gray scale level reproducibility on the low gray scale level side, and is achieved by providing a selectively controllable processor, LUT table (ROM) or the like having an input/output characteristic (gray scale level conversion characteristic) shown in FIG. 38. This black extension correction can also be activated when the user selects the "movie mode" in the menu setup frame.

Here, when the user selects execution of black extension correction by video adjustment so as to adjust the displayed image to improve gray scale level reproducibility on the low gray scale level side (by selecting the characteristic indicated by the solid line in FIG. 38), more pixels of the input image data fall on black or the low gray scale level side. This means that a larger number of gray scale level transition patterns which slow down the liquid crystal response speed take place. Illustratively, most of the gray scale level transitions will possibly occur within the hatching range shown in FIG. 36. As a result, little improvement of the liquid crystal response speed can be obtained even if OS drive (emphasis conversion process) is implemented, while, conversely, emphasis converter 2 determines the emphasis-converted data on the basis that the previous frame has reached the target gray scale level despite the fact the gray scale level has not yet been reached. Consequently, gray scale levels which are deviated from the correct gray scale levels to be displayed are reproduced, and if such gray scale level transitions repeatedly occur, the displayed image will degrade due to occurrence of whitened and/or blackened pixels.

To deal with this, in the present embodiment, when a command of black extension correction exceeding a predetermined level is given from the user, control CPU 214 detects this and controls a selector switch 215 so that the input image data will be directly output as the display image data to liquid crystal display panel 4. That is, selector switch 215 is controlled to switch in accordance with the content of the command for black extension correction (selection of video source) from the user, whereby either the emphasis-converted data from emphasis converter 2 or the input image data is selected and supplied as the display image data to liquid crystal display panel 4.

As described above, when the user gives a command for black extension correction, OS drive is turned off (stopped) in response to this so that the input image data is directly output as the display image data to liquid crystal display panel 4. Thereby, it is possible to realize high quality image display by inhibiting occurrence of whitened or blackened pixels and the like, which would arise when gray scale level transition patterns that slow down liquid crystal display panel 4 in response speed repeatedly appear as a result of black extension correction.

In connection with above, when a command for white extension correction is given, the possibility of repeated appearance of gray scale level transition patterns that slow down liquid crystal display panel 4 in response speed is reduced. Therefore, in this case it is obvious that the display image data to be supplied to liquid crystal display panel 4 should be the emphasis-converted data that has been emphasis-converted by emphasis converter 2 with OS drive activated.

(3) Black Level Correction Circuit

This function is to adjust the brightness of the displayed image by correcting the black level of the image signal, and is achieved by providing a selectively controllable processor, LUT table (ROM), or the like, having an input/output characteristic (gray scale level conversion characteristic) shown in FIG. 39, for example. This black level correction is the same as the typical "brightness adjustment" which can be adjusted in the menu setup frame by the user.

Here, when the user selects execution of black level correction by video adjustment so as to make the displayed image dark overall (by selecting the characteristic shown by the chain line in FIG. 39), more pixels of the input image data fall on black or the low gray scale level side. This means that a greater number of gray scale level transition patterns which slow down the liquid crystal response speed take place. Illustratively, most of the gray scale level transitions will possibly occur within the hatching range shown in FIG. 36. As a result, little improvement of the liquid crystal response speed can be obtained even if OS drive (emphasis conversion process) is implemented, while, conversely, emphasis converter 2 determines the emphasis-converted data on the basis that the previous frame has reached the target gray scale level despite the fact the gray scale level has not yet been reached. Consequently, gray scale levels which are deviated from the correct gray scale levels to be displayed are reproduced, and if such gray scale level transitions repeatedly occur, the displayed image will degrade due to occurrence of whitened and/or blackened pixels.

To deal with this, in the present embodiment, when a command of black level correction exceeding a predetermined level is given from the user, control CPU 214 detects this and controls a selector switch 215 so that the input image data will be directly output as the display image data to liquid crystal display panel 4. That is, selector switch 215 is controlled to switch in accordance with the content of the command for black level correction (brightness adjustment) from the user, whereby either the emphasis-converted data from emphasis converter 2 or the input image data is selected and supplied as the display image data to liquid crystal display panel 4.

As described above, when the user gives a command for black level correction, OS drive is turned off (stopped) in response to this so that the input image data is directly output as the display image data to liquid crystal display panel 4. Thereby, it is possible to realize high quality image display by inhibiting occurrence of whitened or blackened pixels and the like, which would arise when gray scale level transition patterns that slow down liquid crystal display panel 4 in response speed repeatedly appear as a result of black level correction.

In connection with above, when the displayed image is made bright overall (by selecting the characteristic indicated by the solid line in FIG. 39) by black level correction (brightness adjustment), the possibility of repeated appearance of gray scale level transition patterns that slow down liquid crystal display panel 4 in response speed is reduced. Therefore, in this case it is obvious that the display image data to be supplied to liquid crystal display panel 4 should be the emphasis-converted data that has been emphasis-converted by emphasis converter 2 with OS drive activated.

As stated above, according to the liquid crystal display panel of the present embodiment, the output as the display image data to be supplied to liquid crystal display panel 4 is selectively switched between the emphasis-converted data that has been emphasis-converted by emphasis converter 2 and the input image data, in accordance with the command content of video adjustment for the frequency characteristics or gray scale level characteristics of the input image data, designated by the user. Therefore, adverse effects due to overshoot drive resulting from the video adjustment can be cancelled, whereby it is possible to reduce image degradation of the displayed image.

Though in the above seventh embodiment the write-gray scale level determining means is constituted of emphasis converter 2 and OS table memory (ROM) 3*a*, a two-dimensional function f(pre, cur) defined by, for instance, two variables, i.e., the gray scale level before transition and the gray scale level after transition, may be provided instead of OS table memory 3*a*, so as to determine the emphasis-converted data for compensating the optical response characteristic of liquid crystal display panel 4.

THE EIGHTH EMBODIMENT

Next, the eighth embodiment of the present invention will be described in detail with reference to FIG. 40. The same components as those in the above seventh embodiment are allotted with the same reference numerals and description for those is omitted. Here, FIG. 40 is a block diagram showing a schematic configuration of exemplary components in a liquid crystal display of the present embodiment.

Figure 40:
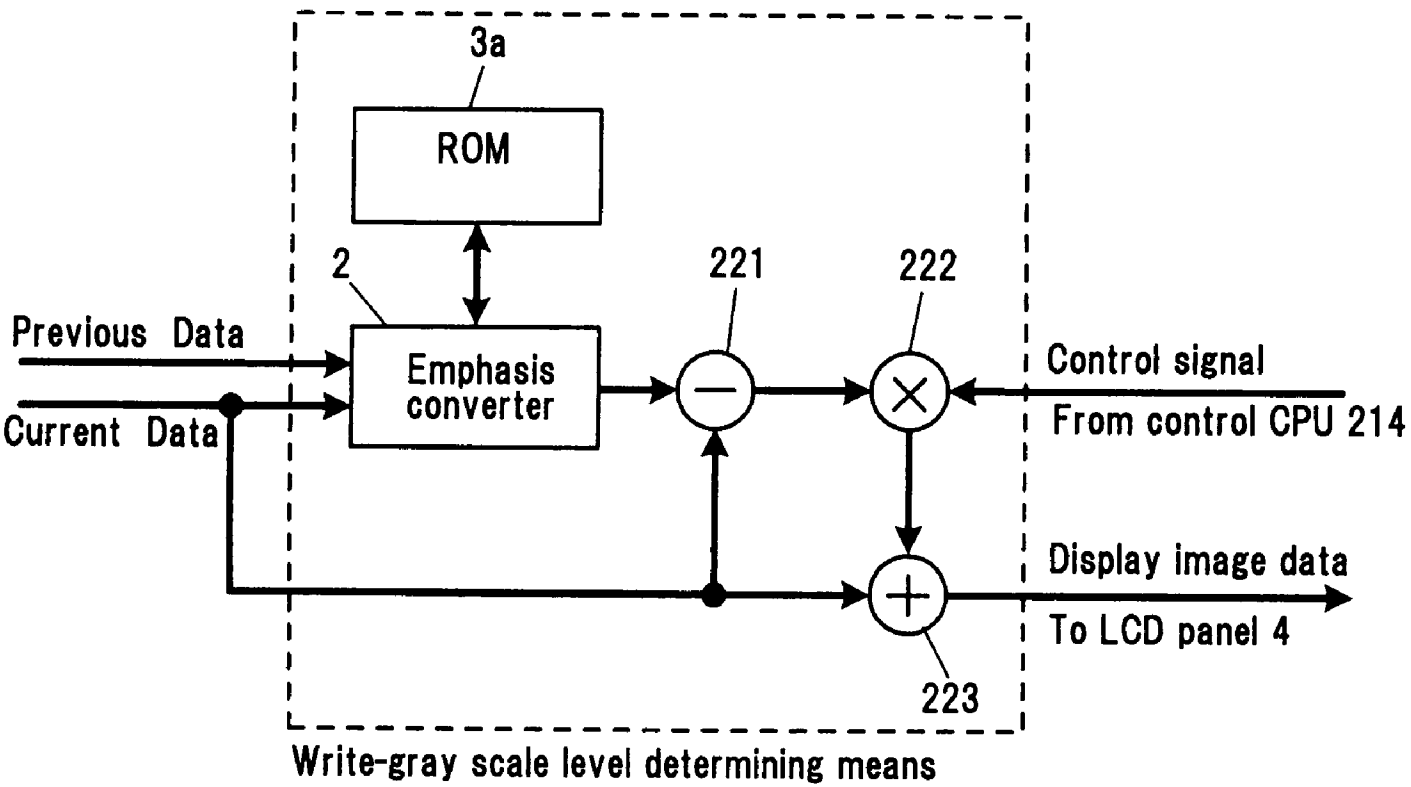
FIG. 40 is a block diagram showing a schematic configuration of exemplary components in the eighth embodiment of a liquid crystal display of the present invention.

As shown in FIG. 40, the liquid crystal display of the present embodiment has a write-gray scale level determining means comprised of an emphasis converter 2 for determining emphasis-converted data based on the emphasis conversion parameters read out from an OS table memory (ROM) 3*a*, a subtracter 221 for subtracting the input image data from the emphasis-converted data determined by the emphasis converter 2, a multiplier 222 for multiplying the output data from the subtracter 221 by a weight coefficient k ($0 \leqq k \leqq 1$) and an adder 223 for adding the output data from this multiplier 222 to the input image data to produce display image data.

Here, the value of weight coefficient k is variably controlled based on the control signal output from control CPU 214 in accordance with the content of the video adjustment command given by the user. That is, in response to the video adjustment command from the user, the display image data to be supplied to liquid crystal display panel 4 is variably controlled.

Specifically, in the normal setup usage mode, control CPU 214 controls so that the weight coefficient k of multiplier 222 is set at 1, whereby the emphasis-converted data for compensating the optical response characteristic of liquid crystal display panel 4 can be output as the display image data to liquid crystal display panel 4, while, when the user gives: (1) a command of contour enhancement correction in excess of a predetermined amount, (2) a command of black extension correction in excess of a predetermined amount, or (3) a command of black level correction in excess of a predetermined amount, control CPU 214 controls so that the weight coefficient k=0, whereby the input image data can be directly output without being processed through emphasis conversion to liquid crystal display panel 4.

In the above way, according to the liquid crystal display panel of the present embodiment, the output as the display image data to be supplied to liquid crystal display panel 4 is selectively switched between the emphasis-converted data and the input image data, in accordance with the command content of video adjustment for the frequency characteristics or gray scale level characteristics of the input image data, designated by the user. Therefore, adverse effects due to overshoot drive resulting from the video adjustment can be cancelled, whereby it is possible to reduce image degradation of the displayed image.

It should be noted that in the present embodiment, the value of weight coefficient k ($0 \leqq k \leqq 1$) may be varied stepwise in accordance with the video adjustment command content designated by the user. Specifically, the weight coefficient k is controlled to be lessened from 1 to 0 as (1) the strength of contour enhancement correction becomes greater, (2) the amount of extension in black extension correction becomes greater or (3) the amount of reduction in back level in black level correction becomes greater, whereby the display image data to be supplied to liquid crystal display panel 4 can be varied stepwise, or in one word, the amount of OS drive can be reduced stepwise.

Thus, based on the video adjustment command content designated by the user, the emphasis-converted data for compensating the optical response characteristic of liquid crystal display panel 4 is variably controlled in a stepwise manner and supplied as the display image data to liquid crystal display panel 4, whereby it is possible to cancel adverse effects in overshoot drive resulting from the video adjustment, in a flexible manner, hence control the image degradation of the displayed image subtly.

THE NINTH EMBODIMENT

Figure 41:
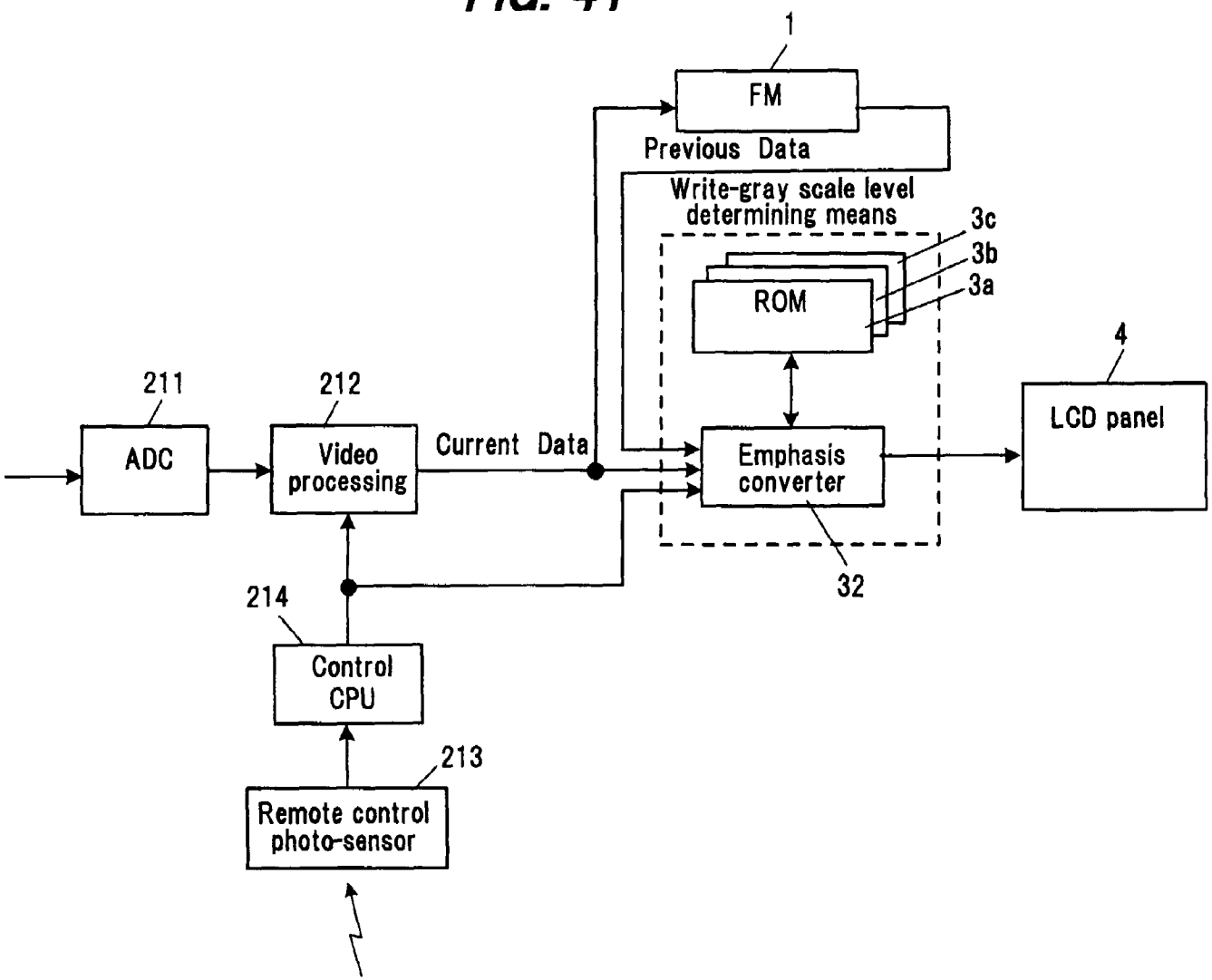
FIG. 41 is a block diagram showing a schematic configuration of exemplary components in the ninth embodiment of a liquid crystal display of the present invention.

Next, the ninth embodiment of the present invention will be described in detail with reference to FIGS. 41 to 43. The same components as those in the above seventh embodiment are allotted with the same reference numerals and description for those is omitted. Here, FIG. 41 is a block diagram showing a schematic configuration of a liquid crystal display of this embodiment; FIG. 42 is a schematic illustration showing the table content of a weak-conversion table memory for use in the liquid crystal display of this embodiment; and FIG. 43 is a schematic illustration showing the table content of a non-conversion table memory for use in the liquid crystal display of this embodiment.

As shown in FIG. 42 the liquid crystal display of the present embodiment, in comparison with the above seventh embodiment, includes: in addition to conversion table memory (ROM) 3*a*, a weak-conversion table memory (ROM) 3*b* storing weak-conversion parameters and a non-conversion table memory (ROM) 3*c* storing non-conversion parameters, with selector switch 215 omitted. Therefore, an emphasis converter 32 determines the display image data to be supplied to a liquid crystal display panel 4, referring to one of table memories (ROMs) 3*a* to 3*c* in accordance with the control signal from a control CPU 214.

Here, the write-gray scale level determining means is constructed of table memories (ROMs) 3*a* to 3*c* and emphasis converter 32 which determines the display image data to be output to liquid crystal display panel 4 by referring to the table memories (ROMs) 3*a* to 3*c* in a switchable manner based on the control signal from control CPU 214.

In the above configuration, weak-conversion table memory (ROM) 3*b* holds emphasis conversion parameters which are reduced in value compared to the emphasis conversion parameters stored in conversion table memory (ROM) 3*a*, as shown in FIG. 42. When this weak-conversion table memory 3*b* is selected to be referred to, the input image data is subjected to weak-emphasis conversion and output to liquid crystal display panel 4.

On the other hand, non-conversion table memory (ROM) 3*c* holds non-conversion parameters for directly outputting the input image data without conversion, as shown in FIG. 43. When this non-conversion table memory 3*c* is selected to be referred to, the input image data is adapted to be output straight through.

Specifically, in the normal setup usage mode, control CPU 214 makes control to select and refer to conversion table memory 3*a*, whereby the input image data is subjected to strong emphasis conversion which compensates the optical response characteristic of liquid crystal display panel 4 and the thus emphasis-converted data can be output as the display image data to liquid crystal display panel 4.

On the other hand, when the user gives: (1) a command of contour enhancement correction below a predetermined amount, (2) a command of black extension correction below a predetermined amount, or (3) a command of black level correction below a predetermined amount, control CPU 214 selects and refers to weak-conversion table memory 3*b*, whereby the input image data is subjected to weak emphasis conversion and the thus emphasis-converted data can be output as the display image data to liquid crystal display panel 4.

Further, when the user gives: (1) a command of contour enhancement correction in excess of a predetermined amount, (2) a command of black extension correction in excess of a predetermined amount, or (3) a command of black level correction in excess of a predetermined amount, control CPU 214 selects to refer to non-conversion table memory 3*c*, whereby the input image data can be directly output as the display image data, without being emphasis-converted, to liquid crystal display panel 4.

Thus, the display image data to be supplied to liquid crystal display panel 4 (the level of OS drive) is variably controlled stepwise, selecting a different table memory to refer to it based on the video adjustment command content designated by the user, whereby it is possible to cancel adverse effects in overshoot drive resulting from the video adjustment, in a flexible manner, hence control the image degradation of the displayed image subtly.

Here, to make the description simple, in the present embodiment three kinds of table memories constituted of two kinds of conversion table memories 3*a* and 3*b* and a non-conversion memory 3*c*, are provided. However, the present invention should not be limited thereto, and it is obvious that four or more table memories may be provided so that each table can be selected to be referred to in correspondence to a different video adjustment command content designated by the user.

THE TENTH EMBODIMENT

Next, the tenth embodiment of the present invention will be described in detail with reference to FIGS. 44 and 45. The same components as those in the above ninth embodiment are allotted with the same reference numerals and description for those is omitted. Here, FIG. 44 is a block diagram showing a schematic configuration of a liquid crystal display of this embodiment and FIG. 45 is a schematic illustration showing the table content of a table memory for use in the liquid crystal display of this embodiment.

Figure 44:
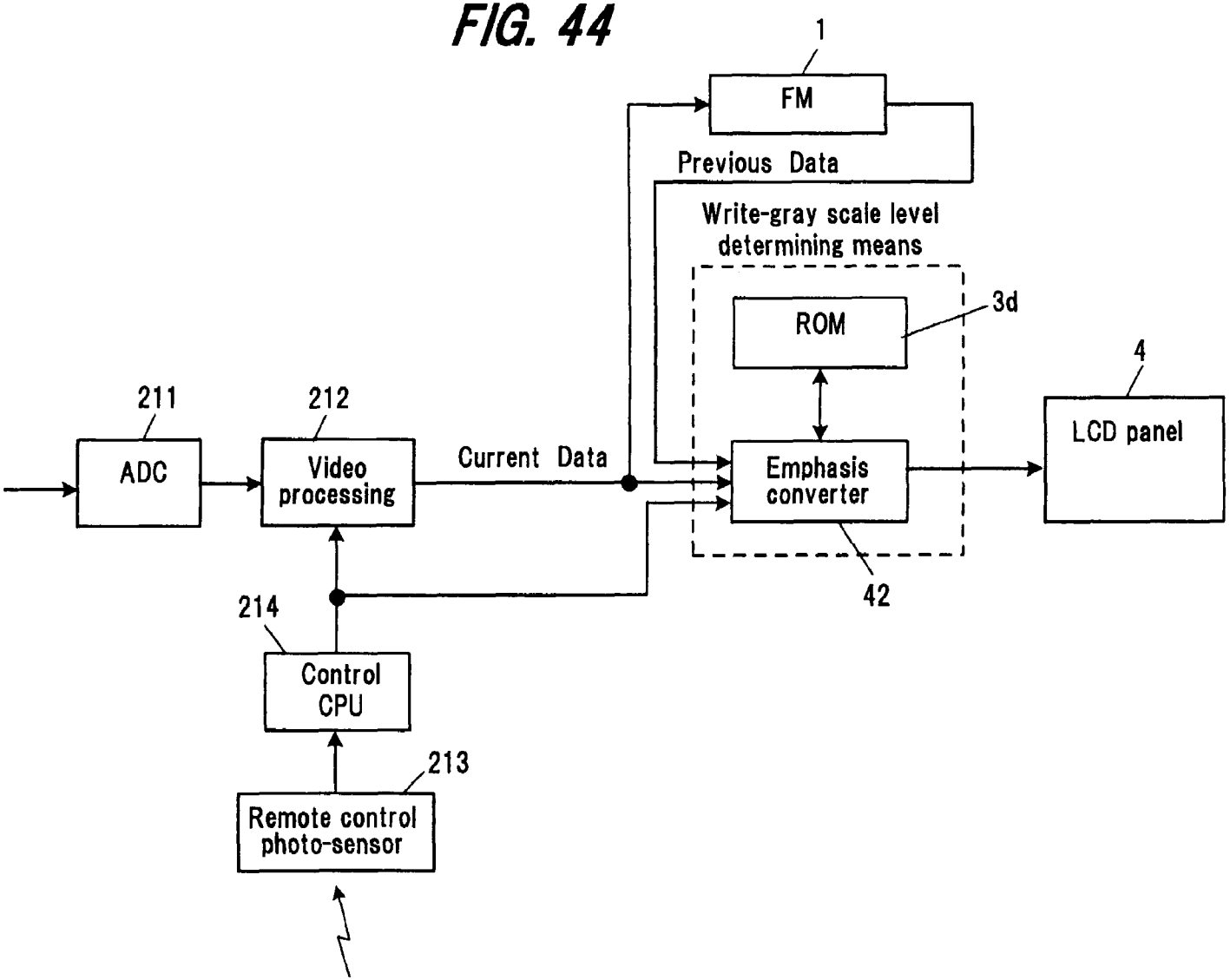
FIG. 44 is a block diagram showing a schematic configuration of exemplary components in the tenth embodiment of a liquid crystal display of the present invention.

As shown in FIG. 44 the liquid crystal display of the present embodiment has a single ROM 3*d* as a table memory for storing plural sets of emphasis conversion parameters and non-conversion parameters in respective reference table areas, and is configured so that an emphasis converter 42 determines the display image data to be supplied to a liquid crystal display panel 4 by reference to this ROM 3*d*.

Here, the write-gray scale level determining means is constructed of table memory (ROM) 3*d* and emphasis converter 42 which determines the display image data to be output to liquid crystal display panel 4 by referring to the reference table areas in this table memory (ROM) 3*d* in a switchable manner based on the control signal from control CPU 214.

This table memory (ROM) 3*d*, as shown in FIG. 45, stores emphasis conversion parameters for strong emphasis, emphasis conversion parameters for weak emphasis and non-conversion parameters, in respective table areas. These reference table areas are selectively switched for reference based on the control signal from control CPU 214.

Specifically, in the normal setup usage mode, the reference table area that stores the emphasis conversion parameters for strong emphasis is selected based on the control signal from control CPU 214, whereby the input image data is subjected to strong emphasis conversion which compensates the optical response characteristic of liquid crystal display panel 4 and the thus emphasis-converted data can be output as the display image data to liquid crystal display panel 4.

On the other hand, when the user gives: (1) a command of contour enhancement correction below a predetermined amount, (2) a command of black extension correction below a predetermined amount, or (3) a command of black level correction below a predetermined amount, control CPU 214 selects to refer to the reference table area that stores the emphasis conversion parameters for weak emphasis based on the control signal from control CPU 214, whereby the input image data is subjected to weak emphasis conversion and the thus emphasis-converted data can be output as the display image data to liquid crystal display panel 4.

Further, when the user gives: (1) a command of contour enhancement correction in excess of a predetermined amount, (2) a command of black extension correction in excess of a predetermined amount, or (3) a command of black level correction in excess of a predetermined amount, control CPU 214 selects to refer to the reference table area that stores the non-conversion parameters based on the control signal from control CPU 214, whereby the input image data can be directly output as the display image data, without being emphasis-converted, to liquid crystal display panel 4.

Thus, the display image data to be supplied to liquid crystal display panel 4 (the level of OS drive) is variably controlled stepwise, selecting a different reference table area to be referred to based on the video adjustment command content designated by the user, whereby it is possible to cancel adverse effects in overshoot drive resulting from the video adjustment, in a flexible manner, hence suppress the image degradation of the displayed image subtly.

Here, to make the description simple, the present embodiment is described with reference to table memory 3*d* which has three kinds of reference table areas storing two sets of emphasis conversion parameters and non-conversion parameters. However, the present invention should not be limited thereto, and it is obvious that four or more reference table areas may be provided so that each table area can be selected to be referred to in correspondence to a video adjustment command content designated by the user.

Additionally, though each embodiment of the present invention has been described taking a configuration that allows the user to make a command input of video adjustment through a remote controller, obviously, the user's command input can be made through a control panel portion provided for the device body.

THE ELEVENTH EMBODIMENT

Figure 46:
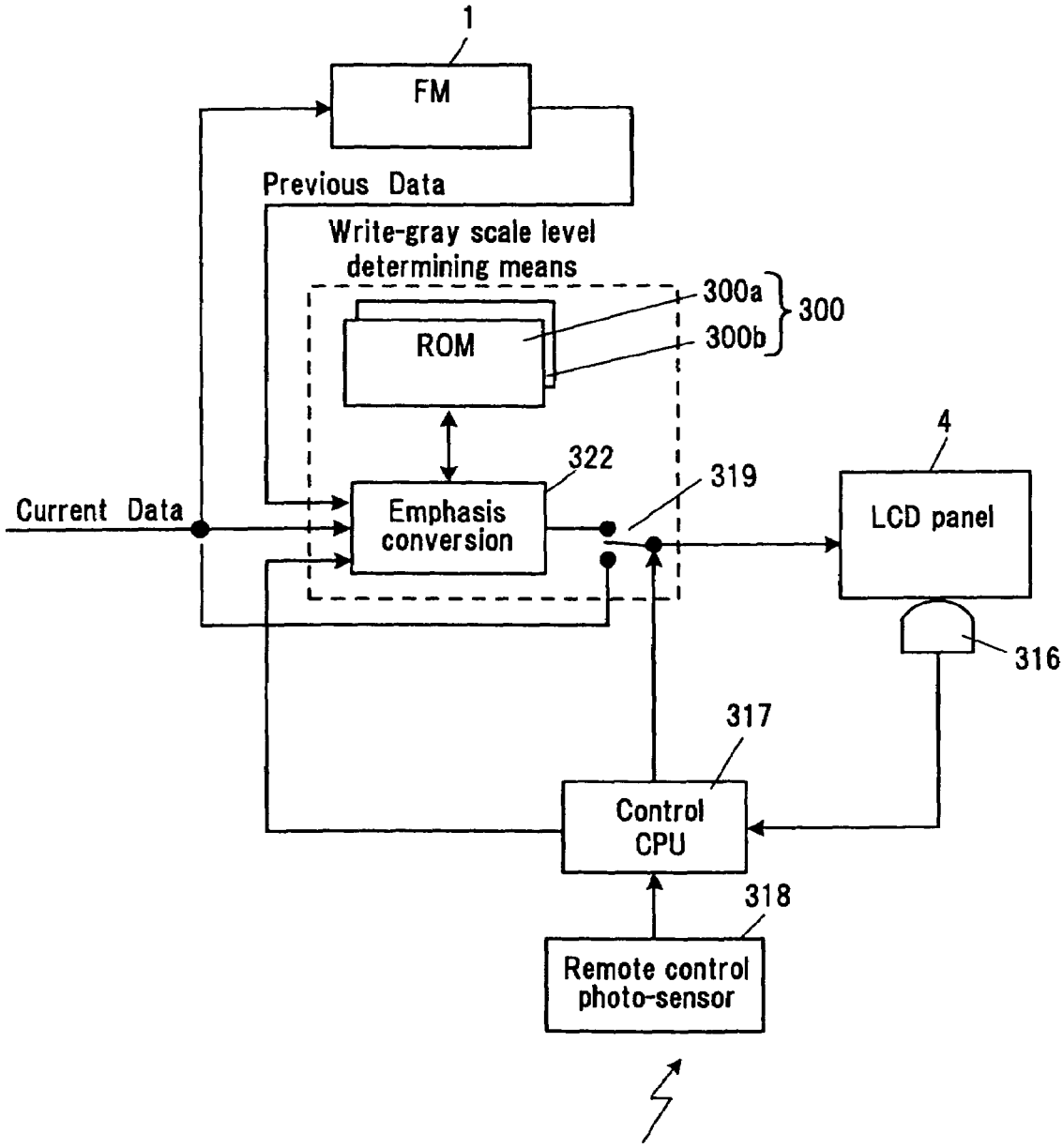
FIG. 46 is a block diagram showing a schematic configuration of exemplary components in the eleventh embodiment of a liquid crystal display of the present invention.
Figure 48:
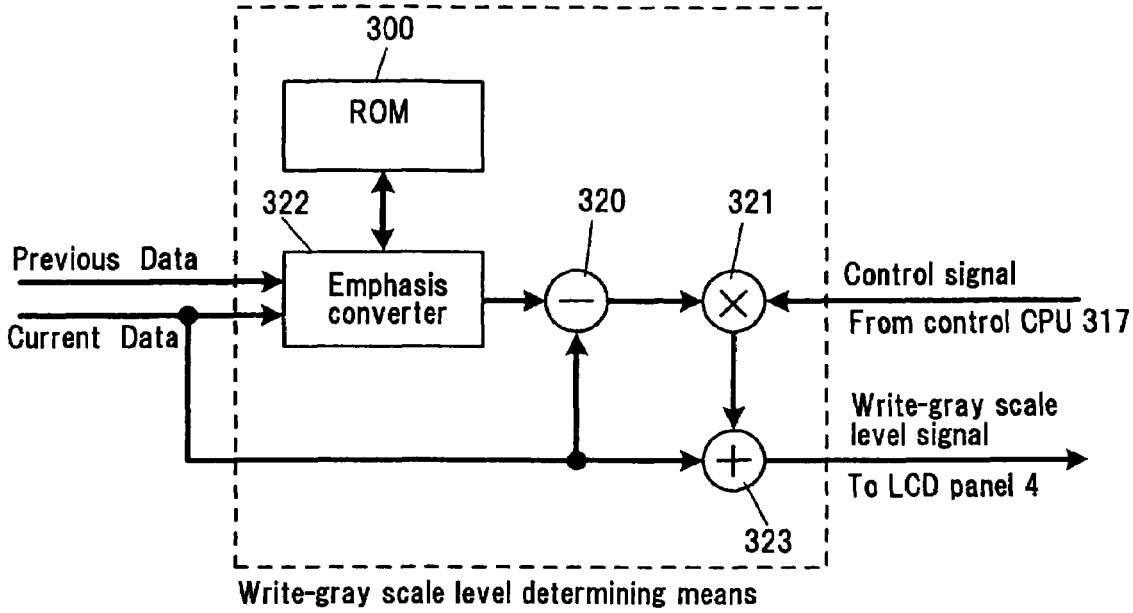
FIG. 48 is a block diagram showing another configurational example of a write-gray scale level means in the eleventh embodiment.

Next, the eleventh embodiment of the present invention will be described in detail with reference to FIGS. 46 to 48. The same components as those in FIG. 1 are allotted with the same reference numerals and description for those is omitted. Here, FIG. 46 is a block diagram showing a schematic configuration of exemplary components in a liquid crystal display of this embodiment; FIG. 47 is a schematic illustration showing the table content of an OS table memory for use in the liquid crystal display of this embodiment; and FIG. 48 is a block diagram showing another configurational example of a write-gray scale level determining means in the liquid crystal display of this embodiment.

In this embodiment, as shown in FIG. 46, a write-gray scale level determining means includes: an emphasis converter 322 which receives the previous frame image data (Previous Data) stored in a frame memory 1 and the current frame input image data (Current Data), reads out corresponding emphasis conversion parameters from OS table memory (ROM) 3 based on the combination of the input data (gray scale level transitions) and determines the emphasis-converted data for the input image data of the current frame so as to compensate the optical response characteristic of liquid crystal display panel 4; and a selector switch 319 for achieving selective switching between the emphasis-converted data and the input gray scale level data, in accordance with the user's command input and outputting the selected one as the write-gray scale level data to liquid crystal display panel 4.

Here, OS table memory (ROM) 300 is composed of OS table memories 300*a* and 300*b* that store different sets of conversion parameters corresponding to the temperature of liquid crystal display panel 4. There is also a control CPU 317 which makes appropriate selective switching between the OS table memories 300*a* and 300*b* based on the temperature of liquid crystal display panel 4 detected by a temperature sensor 316.

Here, to make the description simple, the present embodiment will be described taking an example in which two kinds of ROMs, one for an OS table memory 300*a* used for LEVEL0 when the detected temperature of temperature sensor 316 is lower than the predetermined threshold temperature and the other for an OS table memory 300*b* used for LEVEL1 when the detected temperature of temperature sensor 316 is higher than the predetermined threshold temperature, are provided as OS table memory (ROM) 300 as shown in FIG. 47, and overshoot drive is implemented by selectively referring to either of them. However, it goes without saying that three or more kinds of ROMs that correspond to three or more predetermined temperature ranges may be used.

Further, though, in FIG. 47, the emphasis conversion parameters (actual measurements) are stored in a 9×9 matrix of representative gray scale level transition patterns every 32 gray scale levels when the number of display signal levels, i.e., the amount of display data is constituted of 8 bits or 256 gray scales, obviously the present invention should not be limited to this. Moreover, instead of a single temperature sensor 316 for detecting the temperature of liquid crystal display panel 4, a plurality of temperature sensors may be arranged at different positions within the panel plane.

This embodiment further includes a remote control photo-sensor 318 for receiving a command signal input by the user through an unillustrated remote controller. Control CPU 317 analyzes the command signal received by remote control photo-sensor 318 and controls each processor. The selector switch 319 which selects the write-gray scale level data to be supplied to liquid crystal display panel 4 by achieving selective switching between the emphasis-converted data that has been converted by the emphasis converter 322 to compensate the optical response characteristic of the liquid crystal display panel 4 and the input image data, is controlled to switch by control CPU 317, in accordance with the command data of "stop overshoot drive" designated by the user through the remote controller.

Illustratively, while overshoot drive is actuated in the normal usage mode, either OS table memory 300*a* or 300*b* is selected in accordance with the detected temperature obtained through temperature sensor 316, and the emphasis conversion parameters corresponding to the gray scale transitions from one frame to the next are read out with reference to the selected OS table memory 300*a* or 300*b*. These emphasis conversion parameters are subjected to linear interpolation or other operations so as to determine the emphasis-converted data for the input gray scale level data for all the gray scale level transition patterns, which is supplied to liquid crystal display panel 4.

When undesirable degradation of the displayed image such as occurrence of white spots, noise emphasis, shadow tailing etc., takes place due to device failure, the installed state of the device or the properties of the input image, the user can input a "stop overshoot drive" command using the remote controller. This command signal is received by remote control photo-sensor 318, and control CPU 317 analyzes this and controls selector switch 319 to switch so that the input gray scale level data will be directly supplied to liquid crystal display panel 4.

Accordingly, if adverse effects entailed with overshoot drive occur due to device failure, the installed state of the device or the properties of the input image, it is possible for the user to avoid degradation of the displayed image, by canceling the adverse effects from overshoot drive.

Though in the above eleventh embodiment the write-gray scale level determining means is constituted of emphasis converter 322 and OS table memory (ROM) 300, a two-dimensional function f(pre, cur) defined by, for instance, two variables, i.e., the gray scale level before transition and the gray scale level after transition, may be provided instead of OS table memory 300, so as to determine the write-gray scale level data for compensating the optical response characteristic of liquid crystal display panel 4.

Alternatively, the write-gray scale level determining means may be comprised of, for example as shown in FIG. 48, emphasis converter 322 for determining emphasis-converted data based on the emphasis conversion parameters read out from OS table memory (ROM) 300, subtracter 320 for subtracting the input gray scale level data from the emphasis-converted data determined by the emphasis converter 322, a multiplier 321 for multiplying the output signal from the subtracter 320 by a weight coefficient k and an adder 323 for adding the output signal from this multiplier 321 to the input image data to produce write-gray scale level data, and based on the control signal from control CPU 317, the value of the weight coefficient k can be controlled so as to vary, to thereby variably control the write-gray scale level data to be supplied to liquid crystal display panel 4.

In this case, in the normal usage mode (in the overshoot drive active mode), control CPU 317 makes the control of varying the weight coefficient of multiplier 321 to $k=1\pm\alpha$ in accordance with the detected temperature obtained from temperature sensor 316, whereby it is possible to implement suitable emphasis conversion of the input image data in accordance with the temperature of liquid crystal display panel 4. On the other hand, when the "stop overshoot drive" command is input by the user, control CPU 317 sets the weight coefficient at k=0, whereby the input gray scale level data can be directly supplied, without being emphasis-converted, to liquid crystal display panel 4.

THE TWELFTH EMBODIMENT

Next, the twelfth embodiment of the present invention will be described in detail with reference to FIGS. 49 and 50. The same components as those in the above eleventh embodiment are allotted with the same reference numerals and description for those is omitted. Here, FIG. 49 is a block diagram showing a schematic configuration of exemplary components in the liquid crystal display of this embodiment; and FIG. 50 is a schematic illustration showing the table content of a non-conversion table memory for use in the liquid crystal display of this embodiment.

Figure 49:
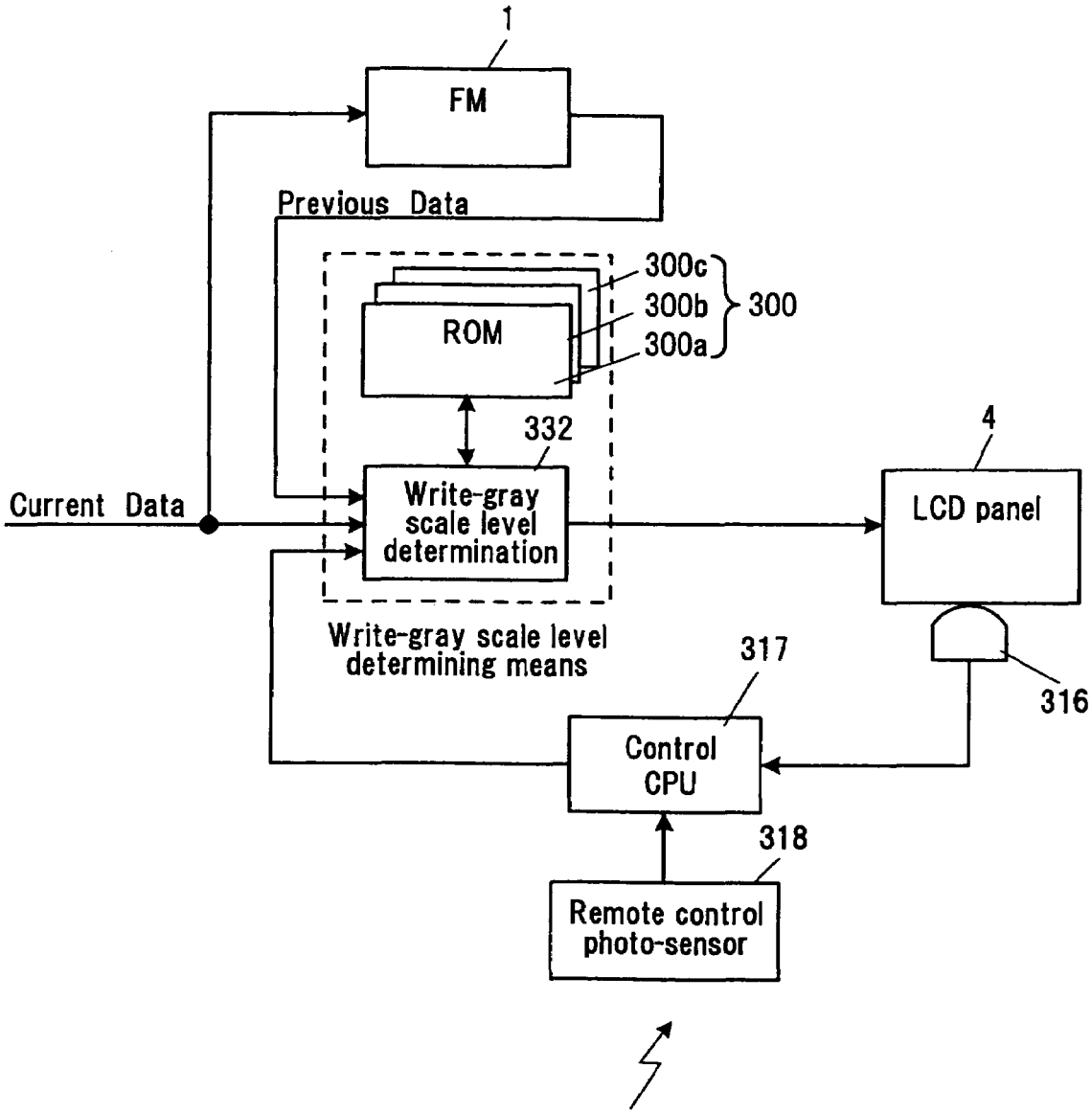
FIG. 49 is a block diagram showing a schematic configuration of exemplary components in the twelfth embodiment of a liquid crystal display of the present invention.

As shown in FIG. 49 the liquid crystal display of the present embodiment, in comparison with the above eleventh embodiment, further has a non-conversion table memory (ROM) 300*c* storing non-conversion parameters in the write-gray scale level determining means with selector switch 19 omitted. Therefore, a write-gray scale level determining portion 32 determines the write-gray scale level data to be supplied to a liquid crystal display panel 4, referring to one of table memories (ROMs) 300*a* to 300*c*. Here, the write-gray scale level determining means is constructed of these table memories (ROMs) 300*a* to 300*c* and a write-gray scale level determining portion 332 for determining write-gray scale level data by selectively referring to table memories (ROMs) 300*a* to 300*c* in accordance with the control signal from a control CPU 317.

Non-conversion table memory (ROM) 300*c* holds non-conversion parameters for directly outputting the input gray scale level data without conversion, as shown in FIG. 50. When this non-conversion table memory 300*c* is selected, the input gray scale level data is adapted to be output straight through. OS table memories 300*a* and 300*b* and non-conversion table memory 300*c* are selectively switched to be referred to, in accordance with the user's command input.

Illustratively, in the normal usage mode (in the overshoot drive active mode), either OS table memory 300*a* or 300*b* is selected in accordance with the detected temperature obtained through temperature sensor 316, and the write-gray scale level determining portion 332 reads out the emphasis conversion parameters corresponding to the gray scale transitions from one frame to the next with reference to the selected OS table memory 300*a* or 300*b*. These emphasis conversion parameters are subjected to linear interpolation or other operations so as to determine the emphasis-converted data for the input gray scale level data for all the gray scale level transition patterns, which is supplied to liquid crystal display panel 4.

On the other hand, when undesirable degradation of the displayed image, such as occurrence of white spots, noise emphasis, shadow tailing etc., takes place due to device failure, the installed state of the device or the properties of the input image, the user can give an input of a "stop overshoot drive" command using the remote controller. This command signal is received by remote control photo-sensor 318, and control CPU 317 analyzes this and makes switching control from OS table memory 300*a* or 300*b* to non-conversion table memory 300*c*, so that write-gray scale level determining portion 332 reads out the non-conversion parameters from non-conversion table memory 300*c*, and outputs the input gray scale level data as it is (outputs it straight through), without being emphasis-converted, to liquid crystal display panel 4.

Accordingly, if adverse effects entailed with overshoot drive occur due to device failure, the installed state of the device or the properties of the input image, it is possible for the user to avoid degradation of the displayed image, by canceling the adverse effects from overshoot drive.

THE THIRTEENTH EMBODIMENT

Next, the thirteenth embodiment of the present invention will be described in detail with reference to FIGS. 51 and 52. The same components as those in the above twelfth embodiment are allotted with the same reference numerals and description for those is omitted. Here, FIG. 51 is a block diagram showing a schematic configuration of exemplary components in a liquid crystal display of this embodiment, and FIG. 52 is a schematic illustration showing the table content of a table memory for use in the liquid crystal display of this embodiment.

Figure 51:
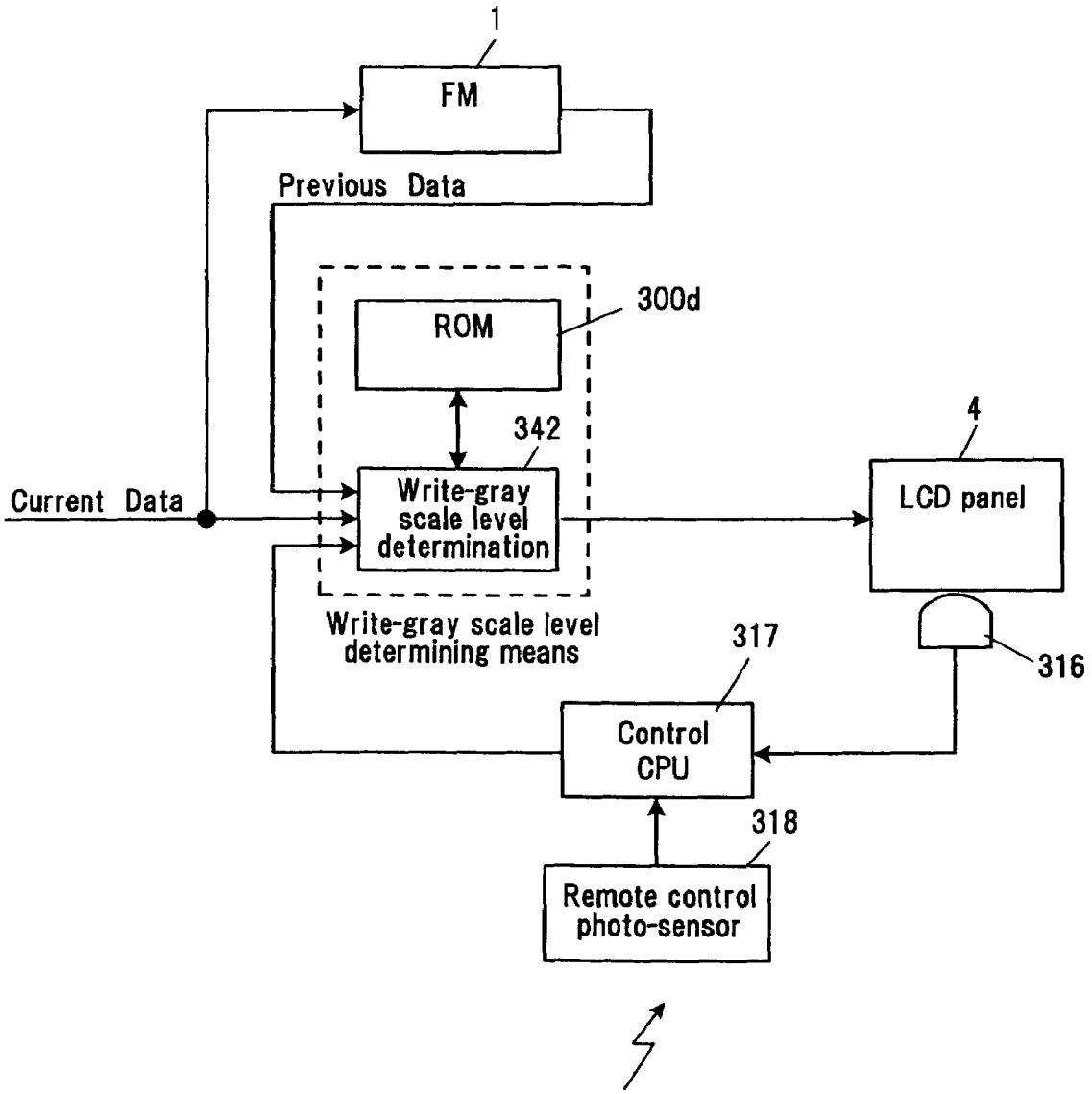
FIG. 51 is a block diagram showing a schematic configuration of exemplary components in the thirteenth embodiment of a liquid crystal display of the present invention.

As shown in FIG. 51 the liquid crystal display of the present embodiment has a single ROM 300*d* as table memory 300, and is configured so that a write-gray scale level determining portion 342 determines the write-gray scale level data to be supplied to a liquid crystal display panel 4 by reference to this ROM 300*d*. Here, the write-gray scale level determining means is constructed of table memory (ROM) 300*d* and write-gray scale level determining portion 342 for determining the write-gray scale level data by referring to the reference table areas in this table memory (ROM) 300*d* in a switchable manner based on the control signal from a control CPU 317.

This table memory (ROM) 300*d*, as shown in FIG. 52, stores emphasis conversion parameters for low temperature, emphasis conversion parameters for high temperature and non-conversion parameters, in respective table areas (LEVEL0 to LEVEL2). The reference table areas (LEVEL0 and LEVEL1) holding the emphasis conversion parameters and the table area (LEVEL2) for non-conversion parameters are selectively switched for reference based on the user's command input.

Specifically, based on the control signal from control CPU 317, the table areas (LEVEL0 to LEVEL2) to be referred to, are variably switched while the emphasis conversion parameters and non-conversion parameters can be selectively switched and read out referring to the address in each table area, in accordance with the gray scale level transition from one frame to the next.

Accordingly, in the normal usage mode (in the overshoot drive active mode), one of the conversion table areas (LEVEL0 to LEVEL1) in table memory 300*d* is selected in accordance with the detected temperature through temperature sensor 316, and write-gray scale level determining portion 342 reads out the emphasis conversion parameters corresponding to the gray scale level transitions from one frame to the next, by referring to the selected correction table area (LEVEL0 or LEVEL1). These emphasis conversion parameters are subjected to linear interpolation or other operations so as to determine the emphasis-converted data for the input gray scale level data for all the gray scale level transition patterns, which is supplied to liquid crystal display panel 4.

When undesirable degradation of the displayed image such as occurrence of white spots, noise emphasis, shadow tailing etc., takes place due to device failure, the installed state of the device or the properties of the input image, the user can give an input of a "stop overshoot drive" command using the remote controller. This command signal is received by remote control photo-sensor 318, and control CPU 317 analyzes this and controls to select the non-conversion table area (LEVEL2) of table memory 300*d*, so that write-gray scale level determining portion 342 reads out the non-conversion parameters from the non-conversion table area (LEVEL2) and outputs the input gray scale level data as it is (outputs it straight through), without being emphasis-converted, to liquid crystal display panel 4.

As described above, if adverse effects entailed with overshoot drive occur due to device failure, the installed state of the device or the properties of the input image, it is possible for the user to avoid degradation of the displayed image, by canceling the adverse effects from overshoot drive.

Additionally, though each embodiment of the present invention has been described taking a configuration where user command input is made through a remote controller, obviously, the user's command input can be made through a control portion provided for the device body.

THE FOURTEENTH EMBODIMENT

Next, the fourteenth embodiment of the present invention will be described in detail with reference to FIGS. 53 and 54. The same components as those in FIG. 1 are allotted with the same reference numerals and description for those is omitted. Here, FIG. 53 is a block diagram showing a schematic configuration of exemplary components in a liquid crystal display of this embodiment, and FIG. 54 is a schematic illustration showing the table content of an OS table memory for use in the liquid crystal display of this embodiment.

Figure 53:
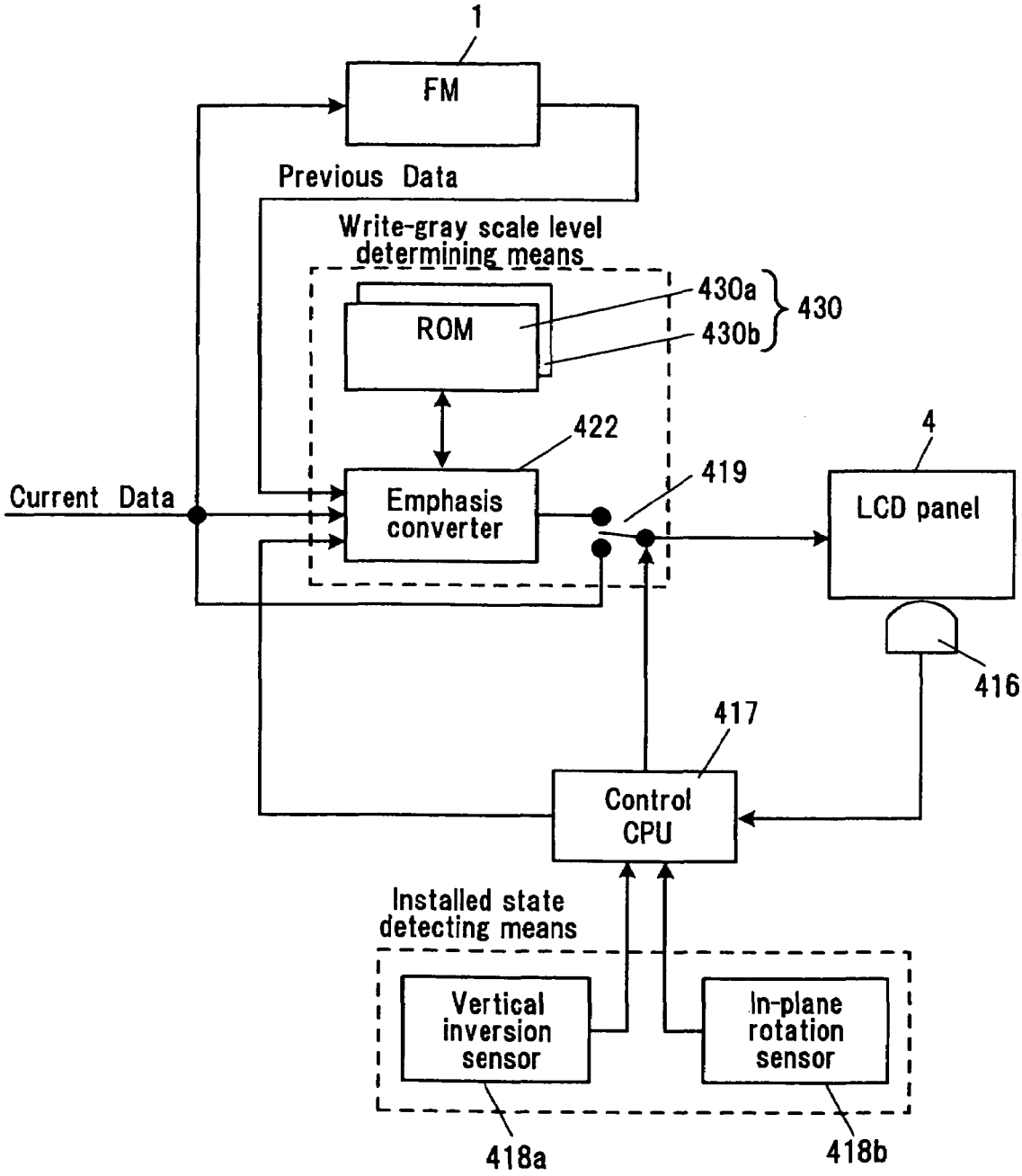
FIG. 53 is a block diagram showing a schematic configuration of exemplary components in the fourteenth embodiment of a liquid crystal display of the present invention.

In this embodiment, as shown in FIG. 53, a write-gray scale level determining means includes: an emphasis converter 422 which receives the previous frame image data (Previous Data) stored in a frame memory 1 and the current frame input image data (Current Data), reads out corresponding emphasis conversion parameters from OS table memory (ROM) 430 based on the combination of the input data (gray scale level transitions) and determines the emphasis-converted data for the gray scale level data of the current frame so as to compensate the optical response characteristic of a liquid crystal display panel 4; and a selector switch 419 for achieving selective switching between the emphasis-converted data and the input gray scale level data, based on the mounted state of the device and outputting the selected one as the write-gray scale level data to liquid crystal display panel 4.

Here, OS table memory (ROM) 430 is composed of OS table memories 430*a* and 430*b* that store different sets of conversion parameters depending on the temperature of liquid crystal display panel 4. There is also a control CPU 417 which makes appropriate selective switching between the OS table memories 430*a* and 430*b* based on the temperature of liquid crystal display panel 4 detected by a temperature sensor 16.

Here, to make the description simple, the present embodiment will be described taking an example in which two kinds of ROMs, one for OS table memory 430*a* used for LEVEL0 when the detected temperature of temperature sensor 416 is lower than the predetermined threshold temperature and the other for OS table memory 430*b* used for LEVEL1 when the detected temperature of temperature sensor 416 is higher than the predetermined threshold temperature, are provided as OS table memory (ROM) 430 as shown in FIG. 54, and overshoot drive is implemented by selectively referring to either of them. However, it goes without saying that three or more kinds of ROMs that correspond to three or more predetermined temperature ranges may be used.

Further, though, in FIG. 54, the emphasis conversion parameters (actual measurements) are stored in a 9×9 matrix of representative gray scale level transition patterns every 32 gray scale levels when the number of display signal levels, i.e., amount of display data is constituted of 8 bits or 256 gray scales, obviously the present invention should not be limited to this. Moreover, instead of a single temperature sensor 416 for detecting the temperature of liquid crystal display panel 4, a plurality of temperature sensors may be arranged at different positions within the panel plane.

There is also a means for detecting the mounted state of the device, which includes a vertical inversion sensor 418*a* for detecting vertical inverted state of liquid crystal display panel 4 and an in-plane rotation sensor 418*b* for detecting the in-plane rotated state of liquid crystal display panel 4. Control CPU 417 analyzes the detected signals from these sensors 418*a* and 418*b* and controls each processor.

Figure 9:
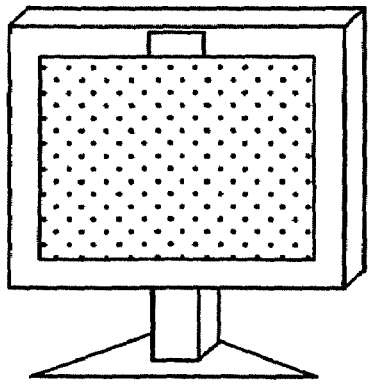
FIG. 9 Conventional Art
FIG. 9 includes illustrative views of a liquid crystal display, (a) normal installed state, (b) vertically inverted state and (c) 90 degree rotated state.
Figure 9:
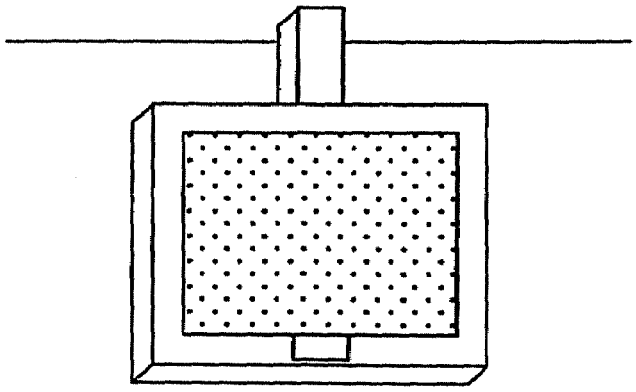
FIG. 9 Conventional Art
Figure 9:
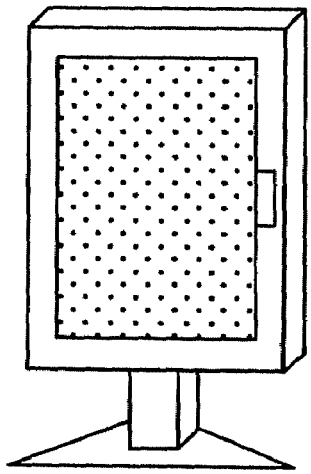
FIG. 9 Conventional Art

Here, vertical inversion sensor 418*a* is to detect state change between the normal installed state (stand-mounted state) shown in FIG. 9(*a*) and the vertically inverted state (ceiling suspended state) shown in FIG. 9(*b*). In-plane rotation sensor 418*b* is to detect state change between the normal installed state (stand-mounted state) shown in FIG. 9(*a*) and the 90 degree rotated state (the portrait orientation state) shown in FIG. 9(*c*). These sensors 418*a* and 418*b* may be constituted by respective gravity switches, etc., or may use a common orientation sensor such as a gyro sensor etc.

Selector switch 419 for selecting the write-gray scale level data to be supplied to liquid crystal display panel 4 by switching between the emphasis-converted data that has been converted by the emphasis converter 422 for compensating the optical response characteristic of the liquid crystal display panel 4 and the input image data, is controlled by control CPU 417 based on the detection result of sensors 418*a* and 418*b* as to the device installed state.

Illustratively, when the device is used in the normal installed state (stand-mounted state), either OS table memory 430*a* or 430*b* is selected in accordance with the detected temperature obtained through temperature sensor 416, and the emphasis conversion parameters corresponding to the gray scale transitions from one frame to the next are read out with reference to the selected OS table memory 430*a* or 430*b*. These emphasis conversion parameters are subjected to linear interpolation or other operations so as to determine the emphasis-converted data for the input gray scale level data for all the gray scale level transition patterns, which is supplied to liquid crystal display panel 4.

When the installed state of the device is switched to the vertically inverted state (ceiling suspended state) or to the 90 degree rotated state (portrait orientation state), flow passage of heated air in the device housing varies, so that temperature sensor 416 cannot detect the correct temperature of liquid crystal display panel 4. As a result, it is no longer possible to read out correct emphasis conversion parameters and incorrect emphasis-converted data may be supplied to liquid crystal display panel 4, causing degradation in the displayed image such as occurrence of white spots, shadow tailing etc.

Accordingly, in the present embodiment, when the device installed state has changed as such, the change is detected by vertical inversion sensor 418*a* or in-plane rotation sensor 418*b* and control CPU 417 makes control to change over selector switch 419, whereby the input gray scale level data is output as it is to liquid crystal display panel 4. In this way, when the device installed state has changed, overshoot drive is automatically stopped so as to cancel adverse effects due to overshoot drive, thus making it possible to avoid image degradation of the displayed image.

Though in the above fourteenth embodiment the write-gray scale level determining means is constituted of emphasis converter 422 and OS table memory (ROM) 430, a two-dimensional function f(pre, cur) defined by, for instance, two variables, i.e., the gray scale level before transition and the gray scale level after transition, may be provided instead of OS table memory 430, so as to determine the write-gray scale level data for compensating the optical response characteristic of liquid crystal display panel 4.

THE FIFTEENTH EMBODIMENT

Next, the fifteenth embodiment of the present invention will be described in detail with reference to FIG. 55. The same components as those in the above fourteenth embodiment are allotted with the same reference numerals and description for those is omitted. Here, FIG. 55 is a block diagram showing a write-gray scale level determining means in a liquid crystal display of this embodiment.

Figure 55:
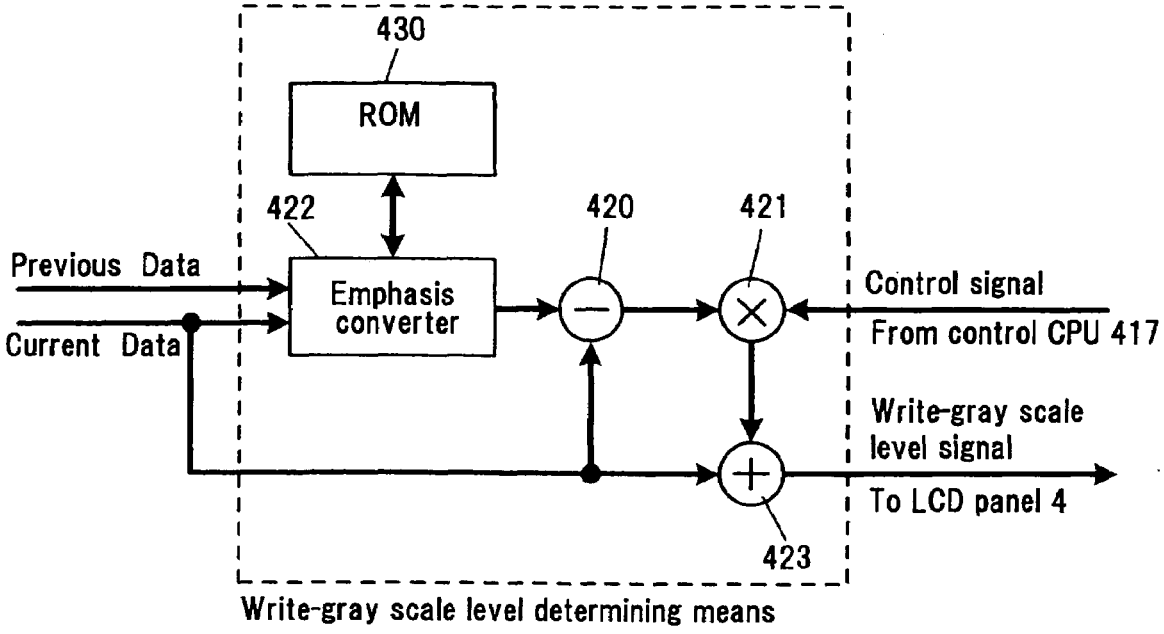
FIG. 55 is a block diagram showing a configurational example of a write-gray scale level means in the fifteenth embodiment of a liquid crystal display of the present invention.

As shown in FIG. 55, the liquid crystal display of the present embodiment has a write-gray scale level determining means comprised of, for example, an emphasis converter 422 for determining emphasis-converted data based on the emphasis conversion parameters read out from an OS table memory (ROM) 430, a subtracter 420 for subtracting the input gray scale level data from the emphasis-converted data determined by the emphasis converter 422, a multiplier 421 for multiplying the output signal from the subtracter 420 by a weight coefficient k and an adder 423 for adding the output signal from this multiplier 421 to the input image data to produce write-gray scale level data, and based on the control signal from a control CPU 417, the value of the weight coefficient k can be controlled so as to vary, to thereby variably control the write-gray scale level data to be supplied to a liquid crystal display panel 4.

Illustratively, when the device is used in the normal installed state (stand-mounted state), control CPU 417 variably controls the weight coefficient of multiplier 421 50 that $k=1\pm\alpha$ in accordance with the detected temperature from temperature sensor 416, whereby it is possible to make suitable emphasis conversion of the input gray scale level data in conformity with the temperature of liquid crystal display panel 4.

Further, when the installed state of the device is switched to the vertically inverted state (ceiling suspended state), this change is detected by a vertical inversion sensor 418*a* and control CPU 417 sets the weight coefficient k at 0, whereby the input gray scale level data can be output as it is, without being emphasis-converted, to liquid crystal display panel 4.

Alternatively, when, in the vertically inverted state (ceiling suspended state), it is known that temperature sensor 416 is affected by generation of heat from other elements and detects a temperature higher than the actual temperature of liquid crystal display panel 4, the weight coefficient may be variably controlled so that $k=1\pm\alpha-\beta$, whereby it is possible to remove influence of heat from other elements and supply the correct write-gray scale level data in conformity with the actual temperature of liquid crystal display panel 4, to liquid crystal display panel 4.

When the installed state of the device is switched to the 90 degree rotated state (portrait orientation state), this change is detected by an in-plane rotation sensor 418*b* and control CPU 417 sets the weight coefficient k at 0, whereby the input gray scale level data can be output as it is, without being emphasis-converted, to liquid crystal display panel 4.

Alternatively, when, in the 90 degree rotated state (portrait orientation state), it is known that temperature sensor 416 is affected by generation of heat from other elements and detects a temperature higher than the actual temperature of liquid crystal display panel 4, the weight coefficient may be variably controlled so that $k=1\pm\alpha-\beta$, whereby it is possible to remove influence of heat from other elements and supply the correct write-gray scale level data in conformity with the actual temperature of liquid crystal display panel 4, to liquid crystal display panel 4.

As stated above, when the installed state of the device has changed, the write-gray scale level data to be supplied to liquid crystal display panel 4 is produced so that the input gray scale level data is output as it is or the emphasis-converted data is output with its degree of emphasis varied so as to automatically cancel adverse effects from overshoot drive. Thus, it is possible to avoid image degradation of the displayed image.

THE SIXTEENTH EMBODIMENT

Next, the sixteenth embodiment of the present invention will be described in detail with reference to FIGS. 56 and 57. The same components as those in the above fourteenth embodiment are allotted with the same reference numerals and description for those is omitted. Here, FIG. 56 is a block diagram showing a schematic configuration of exemplary components in a liquid crystal display of this embodiment, and FIG. 57 is a schematic illustration showing the table content of a non-conversion table memory for use in the liquid crystal display of this embodiment.

Figure 56:
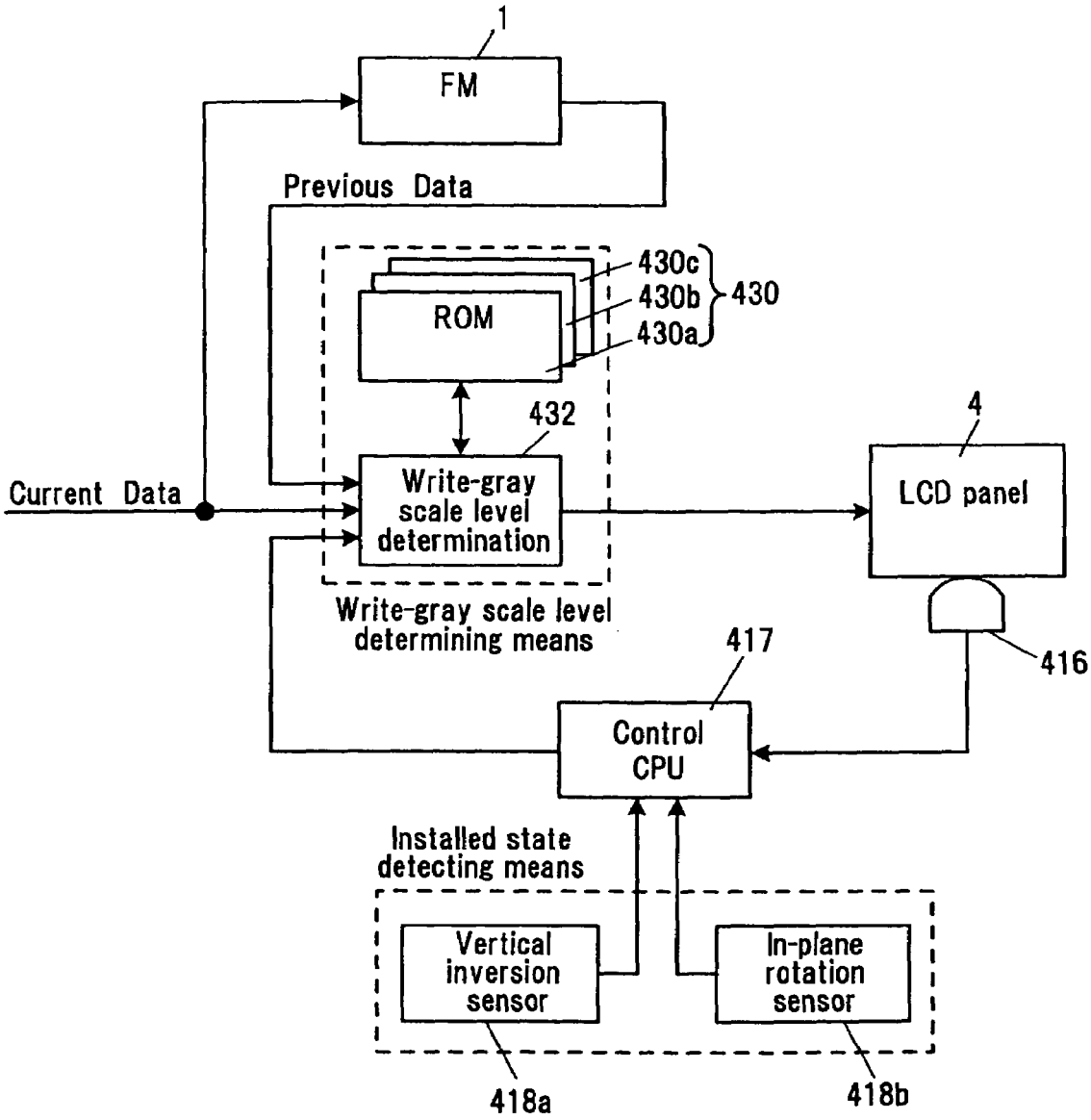
FIG. 56 is a block diagram showing a schematic configuration of exemplary components in the sixteenth embodiment of a liquid crystal display of the present invention.

As shown in FIG. 56 the liquid crystal display of the present embodiment, in comparison with the above fourteenth embodiment, further has a non-conversion table memory (ROM) 3*c* storing non-conversion parameters in the write-gray scale level determining means with selector switch 19 omitted. Therefore, a write-gray scale level determining portion 32 determines the write-gray scale level data to be supplied to a liquid crystal display panel 4, referring to one of table memories (ROMs)430*a* to 430*c*. Here, the write-gray scale level determining means is constructed of these table memories (ROMs) 430*a* to 430*c* and a write-gray scale level determining portion 432 for determining write-gray scale level data by selectively referring to table memories (ROMs) 430*a* to 430*c* in accordance with the control signal from a control CPU 417.

Non-conversion table memory (ROM) 430*c* holds non-conversion parameters for directly outputting the input gray scale level data without conversion, as shown in FIG. 57. When this non-conversion table memory 430*c* is selected, the input gray scale level data is adapted to be output straight through. OS (conversion) table memories 430*a* and 430*b* and non-conversion table memory 430*c* are selectively switched to be referred to, in accordance with the installed state of the device.

Illustratively, when the device is used in the normal installed state (stand-mounted state), either OS table memory 430*a* or 430*b* is selected in accordance with the detected temperature obtained through temperature sensor 416, and write-gray scale determining portion 432 reads out the emphasis conversion parameters corresponding to the gray scale transitions from one frame to the next referring to the selected OS table memory 430*a* or 430*b*. These emphasis conversion parameters are subjected to linear interpolation or other operations so as to determine the emphasis-converted data for the input gray scale level data for all the gray scale level transition patterns, which is supplied to liquid crystal display panel 4.

On the other hand, when the installed state of the device is switched to the vertically inverted state (ceiling suspended state) or to the 90 degree rotated state (portrait orientation state), flow passage of heated air in the device housing varies, so that temperature sensor 416 cannot detect the correct temperature of liquid crystal display panel 4. As a result, it is no longer possible to read out suitable emphasis conversion parameters and incorrect emphasis-converted data may be supplied to liquid crystal display panel 4, causing degradation in the displayed image such as occurrence of white spots, shadow tailing etc.

Accordingly, in the present embodiment, when the device installed state has changed as such, the change can be detected by vertical inversion sensor 418*a* or in-plane rotation sensor 418*b* and control CPU 417 makes switching control from OS table memory 430*a* or 430*b* to non-conversion table memory 3*c*, so that write-gray scale level determining portion 432 reads out the non-conversion parameters from non-conversion table memory 430*c*, and outputs the input gray scale level data as it is (outputs it straight through), without being emphasis-converted, to liquid crystal display panel 4.

In this way, when the device installed state has changed, overshoot drive is automatically stopped so as to cancel adverse effects due to overshoot drive, thus making it possible to avoid image degradation of the displayed image due to occurrence of unwanted white spots, occurrence of shadow tailing or the like.

THE SEVENTEENTH EMBODIMENT

Next, the seventeenth embodiment of the present invention will be described in detail with reference to FIG. 58. The same components as those in the above sixteenth embodiment are allotted with the same reference numerals and description for those is omitted. Here, FIG. 58 is a block diagram showing a schematic configuration of exemplary components in a liquid crystal display of this embodiment.

Figure 58:
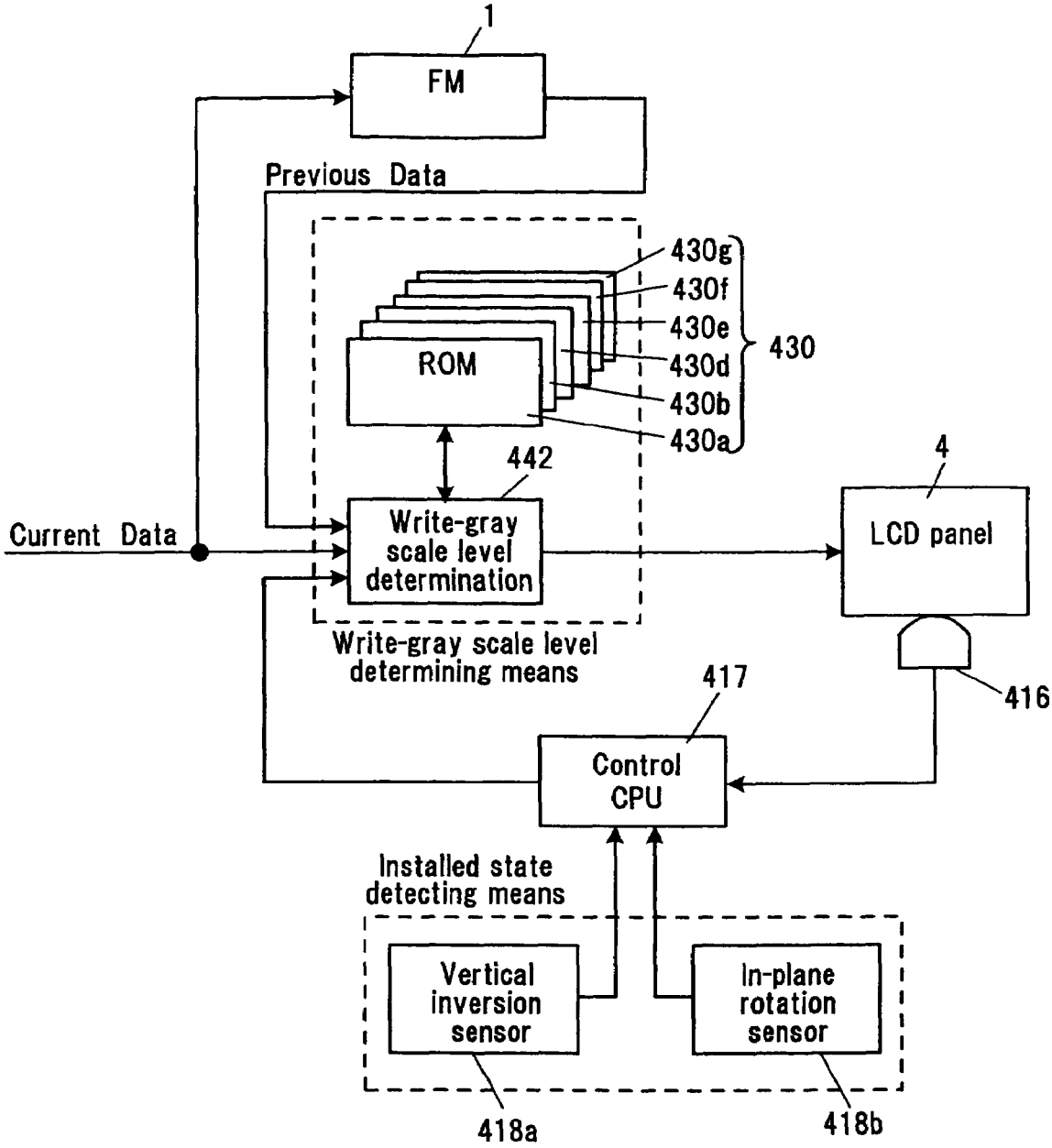
FIG. 58 is a block diagram showing a schematic configuration of exemplary components in the seventeenth embodiment of a liquid crystal display of the present invention.

As shown in FIG. 58 the liquid crystal display of this embodiment, instead of having a non-conversion table memory (ROM) 430*c* as in the above seventeenth embodiment, has emphasis conversion table memories (ROMs) 430*a* and 430*b* for low and high temperatures to be referred to in the normally installed state (stand-mounted state), further including emphasis conversion table memories (ROMs) 430*d* and 430*e* for low and high temperatures to be referred to in the vertical inverted state (ceiling suspended state), and emphasis conversion table memories (ROMs) 430*f* and 430*g* for low and high temperatures to be referred to in the 90 degree rotated state (the portrait orientation state). Here, the write-gray scale level determining means is constructed of table memories (ROMs) 430*a*, 430*b*, 430*d* to 430*g*, and a write-gray scale level determining portion 442 for determining the write-gray scale level data by referring to table memories (ROMs) 430*a*, 430*b*, 430*d* to 430*g* in a switchable manner based on the control signal from a control CPU 417.

Illustratively, when the device is used in the normal installed state (stand-mounted state), either OS table memory 430*a* or 430*b* is selected in accordance with the detected temperature obtained through temperature sensor 416, and write-gray scale determining portion 442 reads out the emphasis conversion parameters corresponding to the gray scale transitions from one frame to the next referring to the selected OS table memory 430*a* or 430*b*. These emphasis conversion parameters are subjected to linear interpolation or other operations so as to determine the emphasis-converted data for the input gray scale level data for all the gray scale level transition patterns, which is supplied to liquid crystal display panel 4.

On the other hand, when the installed state of the device is switched to the vertically inverted state (ceiling suspended state), this change is detected by a vertical inversion sensor 418*a* and control CPU 417 makes switching control from OS table memories 430*a* and 430*b* to OS table memories 430*d* and 430*e*, whereby write-gray scale level determining portion 442 reads out the emphasis conversion parameters referring to emphasis conversion table memory 430*d* and 430*e* so as to determine the emphasis-converted data for the input gray scale level data for all the gray scale level transition patterns and supply it to liquid crystal display panel 4.

Also, when the installed state of the device is switched to the 90 degree rotated state (portrait orientation state), this change is detected by a in-plane rotation sensor 418*b* and control CPU 417 makes switching control from OS table memories 430*a* and 430*b* to OS table memories 430*f* and 430*g*, whereby write-gray scale level determining portion 442 reads out the emphasis conversion parameters referring to emphasis conversion table memories 430*f* and 430*g* so as to determine the emphasis-converted data for the input gray scale level data for all the gray scale level transition patterns and supply it to liquid crystal display panel 4.

In this way, a plurality of emphasis conversion table memories 430*a*, 430*b*, 430*d* to 430*g* which store different, most suited, different sets of emphasis conversion parameters for respective installed states are provided, so that the plurality of emphasis conversion table memories 430*a*, 430*b* and 430*d* to 430*g* are switched to be referred to in conformity with the installed state of the device, whereby the emphasis-converted data that is most suitably emphasis-converted for each set state can be output as the write-gray scale level data to liquid crystal display panel 4. Therefore, it is possible to automatically cancel adverse effects due to overshoot drive resulting from the installed state of the device, hence prevent image degradation of the displayed image.

THE EIGHTEENTH EMBODIMENT

Next, the eighteenth embodiment of the present invention will be described in detail with reference to FIGS. 59 and 60. The same components as those in the above sixteenth embodiment are allotted with the same reference numerals and description for those is omitted. Here, FIG. 59 is a block diagram showing a schematic configuration of exemplary components in a liquid crystal display of this embodiment, and FIG. 60 is a schematic illustration showing the table content of a table memory for use in the liquid crystal display of this embodiment.

Figure 59:
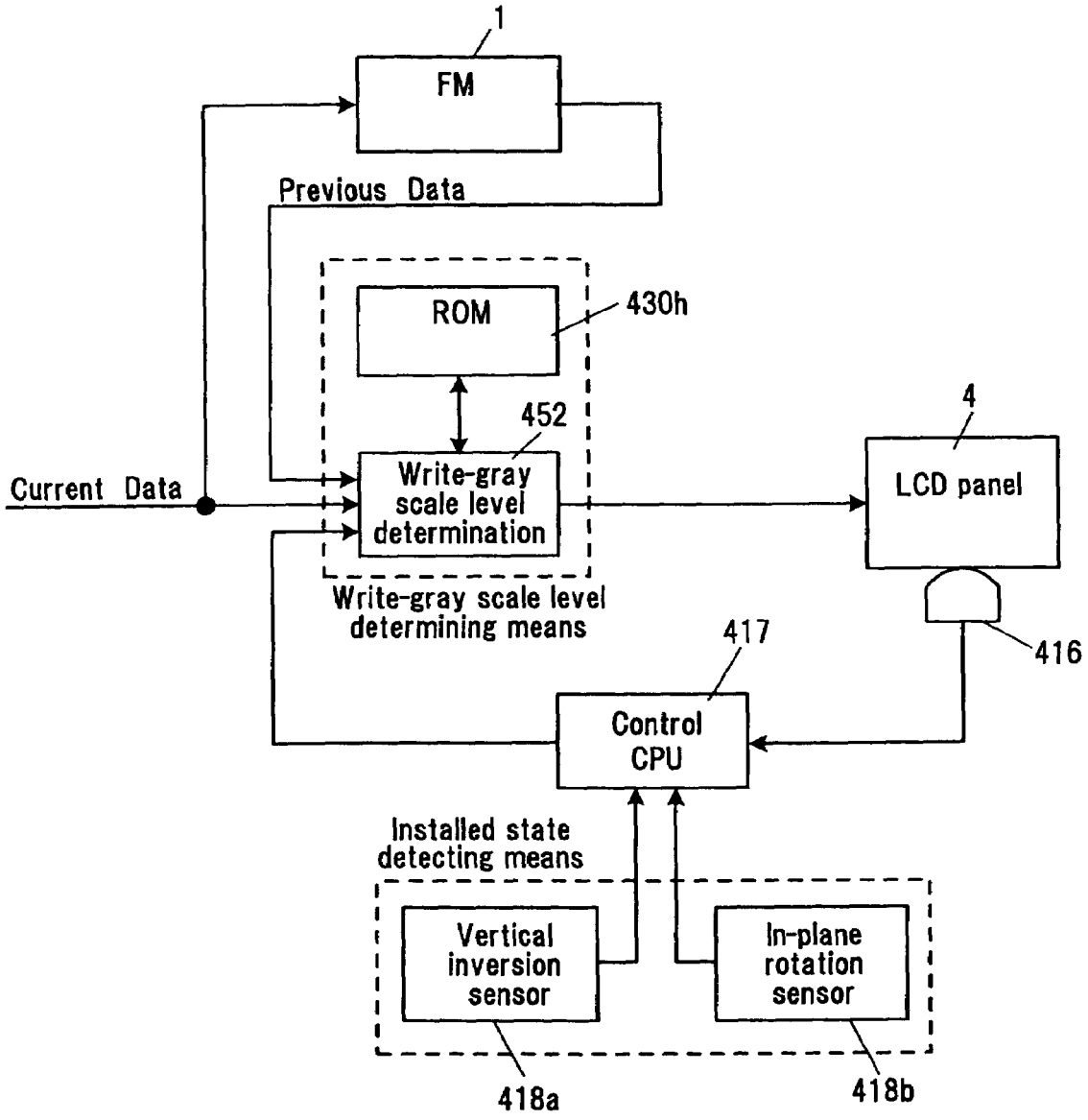
FIG. 59 is a block diagram showing a schematic configuration of exemplary components in the eighteenth embodiment of a liquid crystal display of the present invention.

As shown in FIG. 59 the liquid crystal display of the present embodiment has a single ROM 430*h* as a table memory 430, and is configured so that a write-gray scale level determining portion 452 determines the write-gray scale level data to be supplied to a liquid crystal display panel 4 by reference to this ROM 430*h*. Here, the write-gray scale level determining means is constructed of table memory (ROM) 430*h* and write-gray scale level determining portion 452 for determining the write-gray scale level data by referring to the reference table areas in this table memory (ROM) 430*h* in a switchable manner based on the control signal from a control CPU 417.

This table memory (ROM) 430*h*, as shown in FIG. 60, stores emphasis conversion parameters for low temperature, emphasis conversion parameters for high temperature and non-conversion parameters, in respective table areas (LEVEL0 to LEVEL2). The reference table areas (LEVEL0 and LEVEL1) holding the emphasis conversion parameters and the table area (LEVEL2) for non-conversion parameters are selectively switched for reference based on the installed state of the device.

Specifically, based on the control signal from control CPU 417 in accordance with the outputs from a vertical inversion sensor 418*a* and in-plane rotation sensor 418*b*, the table areas (LEVEL0 to LEVEL2) to be referred to, are variably switched while the emphasis conversion parameters and non-conversion parameters can be selectively switched and read out referring to the corresponding address in each table area, in accordance with the gray scale level transition from one frame to the next.

Accordingly, in use at the normal installed usage state (stand-mounted state), one of the conversion table areas (LEVEL0 to LEVEL1) in table memory 3*h* is selected in accordance with the detected temperature through temperature sensor 416, and write-gray scale level determining portion 452 reads out the emphasis conversion parameters corresponding to the gray scale transitions from one frame to the next, by referring to the selected table area (LEVEL0 or LEVEL1). These emphasis conversion parameters are subjected to linear interpolation or other operations so as to determine the emphasis-converted data for the input gray scale level data for all the gray scale level transition patterns, which is supplied to liquid crystal display panel 4.

When the installed state of the device is switched to the vertically inverted state (ceiling suspended state) or to the 90 degree rotated state (portrait orientation state), this change is detected by vertical inversion sensor 418*a* or in-plane rotation sensor 418*b*, and control CPU 417 controls to select the non-conversion table area (LEVEL2) of table memory 430*h*, so that write-gray scale level determining portion 452 reads out the non-conversion parameters from the non-conversion table area (LEVEL2) and outputs the input gray scale level data as it is (outputs it straight through), without being emphasis-converted, to liquid crystal display panel 4.

In this way, when the device installed state has changed, overshoot drive is automatically stopped so as to cancel adverse effects due to overshoot drive, thus making it possible to avoid image degradation of the displayed image due to occurrence of unwanted white spots, occurrence of shadow tailing or the like.

THE NINETEENTH EMBODIMENT

Next, the nineteenth embodiment of the present invention will be described in detail with reference to FIG. 61. The same components as those in the above eighteenth embodiment are allotted with the same reference numerals and description for those is omitted. Here, FIG. 61 is a schematic illustration showing the table content of a table memory for use in a liquid crystal display of this embodiment.

The liquid crystal display of this embodiment is configured on the basis of that in the above eighteenth embodiment, wherein in place of table memory (ROM) 430*h* having the non-conversion table area (LEVEL2), a table memory (ROM) 430*i* having a plurality of reference table areas (LEVEL0, LEVEL0-1 to 2, LEVEL1, LEVLE1-1 to 2) for storing the most suitable sets of emphasis conversion parameters for individual installed states are provided. Here, the write-gray scale level determining means is constructed of table memory (ROM) 430*i* and a write-gray scale level determining portion for determining the write-gray scale level data by referring to the reference table areas in this table memory (ROM) 430*i* in a switchable manner based on the control signal from a control CPU 417.

This table memory (ROM) 430*i*, as shown in FIG. 61, stores emphasis conversion parameters for low temperature and for high temperature used in the normal installed state (stand-mounted state), emphasis conversion parameters for low temperature and for high temperature used in the vertically inverted state (ceiling suspended state), emphasis conversion parameters for low temperature and for high temperature used in the 640 degree rotated state (portrait orientation state), in respective table areas (LEVEL0, LEVEL1, LEVEL0-1, LEVEL1-1, LEVEL0-2, LEVLE1-2), and these reference table areas holding these sets of emphasis conversion parameters are selectively switched based on the installed state of the device.

Specifically, in use at the normal installed state (stand-mounted state), one of the conversion table areas (LEVEL0 and LEVEL1) in table memory 430*i* is selected in accordance with the detected temperature through temperature sensor 416, and the write-gray scale level determining portion reads out the emphasis conversion parameters corresponding to the gray scale transitions from one frame to the next, by referring to the selected table area (LEVEL0 or LEVEL1). These emphasis conversion parameters are subjected to linear interpolation or other operations so as to determine the emphasis-converted data for the input gray scale level data for all the gray scale level transition patterns, which is supplied to liquid crystal display panel 4.

When the installed state of the device is switched to the vertically inverted state (ceiling suspended state), this change is detected by vertical inversion sensor 418*a*, and control CPU 417 controls to select the conversion table areas (LEVEL0-1 and LEVEL1-1) of table memory 430*i*, so that the write-gray scale level determining portion reads out the emphasis conversion parameters referring to the conversion table areas (LEVEL0-1 and LEVEL1-1) and determines the emphasis-converted data for the input gray scale level data for all the gray scale level transition patterns and supplies it to liquid crystal display panel 4.

Further, when the installed state of the device is switched to the 90 degree rotated state (portrait orientation state), this change is detected by a in-plane rotation sensor 418*b* and control CPU 417 makes control to select the conversion table areas (LEVEL0-2 and LEVEL1-2) of table memory 430*i*, so that the write-gray scale level determining portion reads out the emphasis conversion parameters referring to the conversion table areas (LEVEL0-2 and LEVEL1-2) and determines the emphasis-converted data for the input gray scale level data for all the gray scale level transition patterns and supplies it to liquid crystal display panel 4.

In this way, the plurality of reference table areas LEVEL0, LEVEL0-1 to 2, LEVEL1, LEVLE1-1 to 2) which store different, most suited sets of emphasis conversion parameters for respective installed states are provided, so that these plural reference table areas are switched to be referred to in conformity with the installed state of the device, whereby the emphasis-converted data that is most suitably emphasis-converted for each installed state can be output as the write-gray scale level data to liquid crystal display panel 4. Therefore, it is possible to automatically cancel adverse effects due to overshoot drive resulting from the installed state of the device, hence prevent image degradation of the displayed image.

INDUSTRIAL APPLICABILITY

The liquid crystal display according to the present invention is effective for the displayed image image for computers as well as television receivers. Particularly, it is suitable to further improve the displayed image in image quality in an overshoot drive configuration for enhancing the optical response characteristic of the liquid crystal display panel.

The invention claimed is:

1. A liquid crystal display for image display using a liquid crystal display panel, comprising:

an emphasis converter for determining emphasis-converted data for input image data for compensating an optical characteristic of the liquid crystal display panel, in accordance with a gray scale level transition from a previous vertical period to a current vertical period;

a characteristic quantity detector for detecting a signal characteristic quantity with respect to an edge component or a noise component contained in the input image data; and a selector for selecting either the emphasis-converted data or the input image data, based on the detected signal characteristic quantity and supplying the selected one as display image data to the liquid crystal display panel.

2. A liquid crystal display for image display using a liquid crystal display panel, comprising:

an emphasis converter for determining emphasis-converted data for input image data for compensating an optical characteristic of the liquid crystal display panel, in accordance with a gray scale level transition from a previous vertical period to a current vertical period;

a characteristic quantity detector for detecting a signal characteristic quantity with respect to an edge component or a noise component contained in the input image data; and a controller which variably controls the emphasis-converted data from the emphasis converter, based on the detected signal characteristic quantity and outputs the resultant controlled emphasis-converted data to the liquid crystal display panel.

3. The liquid crystal display according to claim 2, wherein the characteristic quantity detector detects the high frequency component exceeding a threshold which is variably controlled in accordance with a video adjustment command for the input image data, as the signal characteristic quantity.

4. The liquid crystal display according to claim 2, wherein the characteristic quantity detector detects the high frequency component exceeding a threshold which is variably controlled in accordance with an encoding parameter of the input image data, as the signal characteristic quantity.

5. The liquid crystal display according to any one of claims 2 to 4, further comprising a multiplier for multiplying the emphasis-converted data by a weight coefficient, wherein the controller reduces the resultant controlled emphasis-converted data by variably controlling a value of the coefficient in accordance with the signal characteristic quantity and outputs the resultant reduced controlled emphasis-converted data to the liquid crystal display panel.

6. The liquid crystal display according to any one of claims 2 to 4, further comprising:

a subtracter for subtracting the input image data from the emphasis-converted data;

a multiplier for multiplying an output signal from the subtracter by a weight coefficient; and an adder for adding an output signal from the multiplier to the input image data to output the sum to the liquid crystal display panel, wherein the controller reduces the resultant controlled emphasis-converted data by variably controlling a value of the weight coefficient in accordance with the signal characteristic quantity and outputs the resultant reduced controlled emphasis-converted data to the liquid crystal display panel.

7. The liquid crystal display according to any one of claims 2 to 4, further comprising a table memory storing a plurality of different emphasis conversion parameters, wherein the emphasis converter determines the emphasis-converted data based on the emphasis conversion parameters stored in the table memory, and the controller reduces the resultant controlled emphasis-converted data by selecting the emphasis conversion parameters to which the emphasis converter refers, in accordance with the signal characteristic quantity and outputs the resultant reduced controlled emphasis-converted data to the liquid crystal display panel.

8. The liquid crystal display according to claim 2, wherein the characteristic quantity detector detects a differential value between a plurality of pixels exceeding a threshold which is variably controlled in accordance with a video adjustment command for the input image data, as the signal characteristic quantity.

9. The liquid crystal display according claim 2, wherein the characteristic quantity detector detects a differential value between a plurality of pixels exceeding a threshold which is variably controlled in accordance with an encoding parameter of the input image data, as the signal characteristic quantity.

10. The liquid crystal display according to claims 8 or 9, further comprising a multiplier for multiplying the emphasis-converted data by a weight coefficient, wherein the controller reduces the resultant controlled emphasis-converted data by variably controlling a value of the weight coefficient in accordance with the signal characteristic quantity and outputs the resultant reduced controlled emphasis-converted data to the liquid crystal display panel.

11. The liquid crystal display according to claims 8 or 9, further comprising:

a subtracter for subtracting the input image data from the emphasis-converted data;

a multiplier for multiplying an output signal from the subtracter by a weight coefficient; and an adder for adding an output signal from the multiplier to the input image data to output the sum to the liquid crystal display panel, wherein the controller reduces the resultant controlled emphasis-converted data by variably controlling a value of the coefficient in accordance with the signal characteristic quantity and outputs the resultant reduced controlled emphasis-converted data to the liquid crystal display panel.

12. The liquid crystal display according to claims 8 or 9, further comprising: a table memory storing a plurality of different emphasis conversion parameters, wherein the emphasis converter determines the emphasis-converted data based on the emphasis conversion parameters stored in the table memory, wherein the controller reduces the resultant controlled emphasis-converted data by selecting the emphasis conversion parameters to which the emphasis converter refers, in accordance with the signal characteristic quantity and outputs the resultant reduced controlled emphasis-converted data to the liquid crystal display panel.

* * * * *